US006698188B2

(12) United States Patent
Irisawa et al.

(10) Patent No.: US 6,698,188 B2
(45) Date of Patent: Mar. 2, 2004

(54) EMISSION CONTROL APPARATUS OF INTERNAL COMBUSTION ENGINE

(75) Inventors: Yasuyuki Irisawa, Susono (JP); Hiroshi Tanaka, Susono (JP); Junichi Kako, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/998,181

(22) Filed: Dec. 3, 2001

(65) Prior Publication Data

US 2002/0069640 A1 Jun. 13, 2002

(30) Foreign Application Priority Data

Dec. 8, 2000 (JP) ..... 2000-374482
Dec. 21, 2000 (JP) ..... 2000-388978
Jan. 17, 2001 (JP) ..... 2001-009306

(51) Int. Cl.[7] ..... F01N 3/00
(52) U.S. Cl. ..... 60/285; 60/295; 60/301; 60/276
(58) Field of Search ..... 60/285, 295, 301, 60/277, 276

(56) References Cited

U.S. PATENT DOCUMENTS 5,369,956 A * 12/1994 Daudel et al. ..... 60/276
5,483,795 A * 1/1996 Katoh et al. ..... 60/276
5,713,199 A * 2/1998 Takeshima et al. ..... 60/276
5,715,679 A * 2/1998 Asanuma et al. ..... 60/276
5,771,686 A * 6/1998 Pischinger et al. ..... 60/274
5,845,487 A * 12/1998 Fraenkle et al. ..... 60/274
6,017,503 A * 1/2000 Kato et al. ..... 423/235
6,167,695 B1 * 1/2001 Itou et al. ..... 60/274
6,173,568 B1 * 1/2001 Zurbig et al. ..... 60/274
6,244,046 B1 * 6/2001 Yamashita ..... 60/274
6,301,878 B1 * 10/2001 Zhang et al. ..... 60/274
6,305,160 B1 * 10/2001 Hammerle et al. ..... 60/274
6,311,484 B1 * 11/2001 Roth et al. ..... 60/301
6,408,615 B1 * 6/2002 Hahn ..... 60/274
6,427,439 B1 * 8/2002 Xu et al. ..... 60/286

FOREIGN PATENT DOCUMENTS

| | | |
|---|---|---|
| DE | 19823923 | * 12/1999 |
| JP | 6-10725 | 1/1994 |
| JP | A 7-166851 | 6/1995 |
| JP | A 7-189659 | 7/1995 |
| JP | A 8-232646 | 9/1996 |
| JP | 10-176522 | 6/1998 |
| JP | 11-294149 | 10/1999 |
| JP | A 2000-104533 | 4/2000 |
| JP | A 2000-104536 | 4/2000 |
| JP | A 2000-265828 | 9/2000 |
| JP | A 2000-282843 | 10/2000 |

* cited by examiner

*Primary Examiner*—Thomas Denion
*Assistant Examiner*—Diem Tran
(74) *Attorney, Agent, or Firm*—Oliff & Berridge, PLC

(57) ABSTRACT

A NOx occluding member that occludes NOx when the air-fuel ratio is on the fuel-lean side is disposed in an engine exhaust passage. An NOx ammonia sensor is disposed in the engine exhaust passage downstream of the NOx occluding member. A surplus amount of a reducing agent that is not used to release NOx is determined from a change in the ammonia concentration detected by the NOx ammonia sensor when the air-fuel ratio is changed to the fuel-rich side so as to release the NOx from the NOx occluding member.

13 Claims, 27 Drawing Sheets

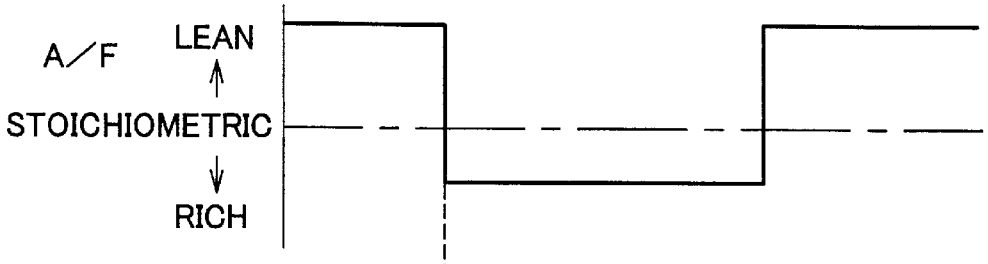
FIG. 11A
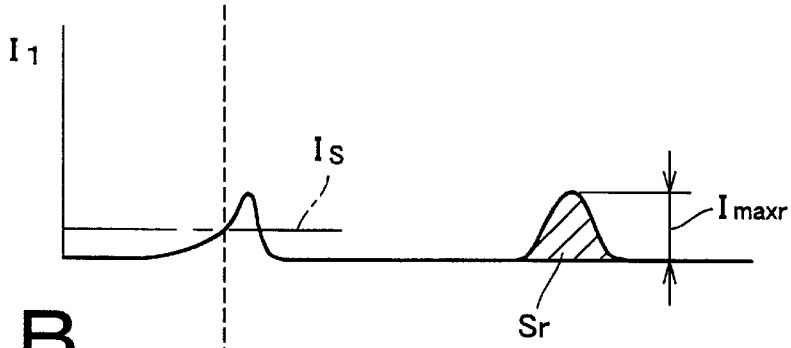
FIG. 11B
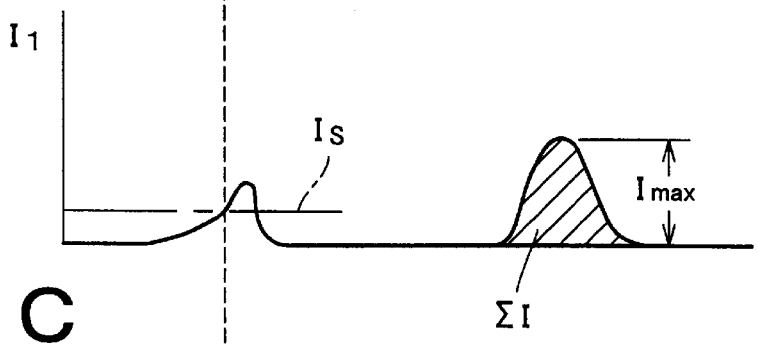
FIG. 11C
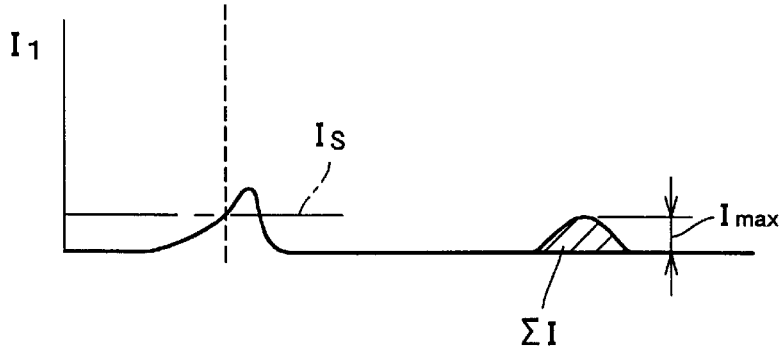

EMISSION CONTROL APPARATUS OF INTERNAL COMBUSTION ENGINE

INCORPORATION BY REFERENCE

The disclosures of Japanese Patent Applications Nos. 2000-374482 filed on Dec. 8, 2000, 2000-388978 filed on Dec. 21, 2000 and 2001-9306 filed on Jan. 17, 2001, each including the specification, drawings and abstract, are incorporated herein by reference in their entireties.

BACKGROUND OF THE INVENTION

1. Field of the Invention

The invention relates to an emission control apparatus of an internal combustion engine.

2. Description of the Related Art

In a known internal combustion engine, a NOx occluding member that occludes NOx when the air-fuel ratio of an inflow exhaust gas is on a fuel-lean side of a stoichiometric fuel-air ratio and that releases occluded NOx and reduces NOx by a reducing agent contained in exhaust gas when the inflow exhaust gas air-fuel ratio changes to the fuel-rich side of the stoichiometric fuel-air ratio is disposed within an engine exhaust passage. During a combustion mode under a fuel-lean air-fuel ratio condition, NOx in exhaust gas is occluded into the NOx occluding member. When NOx is to be released from the NOx occluding member, the air-fuel ratio of exhaust gas that flows into the NOx occluding member is changed toward the rich side.

In order to change the air-fuel ratio of exhaust gas flowing into the NOx occluding member from the fuel-rich side to the fuel-lean side when the release of NOx from the NOx occluding member is completed in an internal combustion engine as described above, there has been proposed an internal combustion engine (Japanese Patent Application Laid-Open No. 2000-104533) in which a NOx sensor capable of detecting the concentration of NOx in exhaust gas is disposed in an engine exhaust passage downstream of the NOx occluding member, and in which when the NOx concentration detected by the NOx sensor decreases to or below a predetermined concentration, the release of NOx from the NOx occluding member is considered to have been completed, and the air-fuel ratio of exhaust gas flowing into the NOx occluding member is changed from the rich side to the lean side.

However, while NOx is being released from the NOx occluding member, the released NOx is reduced by the reducing agent, and therefore is not released in the form of NOx. Therefore, during the release of NOx from the NOx occluding member, the NOx concentration detected by the NOx sensor remains substantially at zero. Therefore, it is not possible to determine whether the release of NOx from the NOx occluding member has been completed, through the use of the NOx sensor.

If the air-fuel ratio of exhaust gas flowing into the NOx occluding member is shifted to the rich side in the aforementioned internal combustion engine, the air-fuel ratio of exhaust gas flowing out of the NOx occluding member is normally a slightly lean air-fuel ratio during the NOx releasing operation of the NOx occluding member. After the release of NOx from the NOx occluding member is completed, the air-fuel ratio of exhaust gas flowing out of the NOx occluding member shifts to the rich side.

In order to change the air-fuel ratio of exhaust gas flowing into the NOx occluding member at the time of completion of the release of NOx from the NOx occluding member in an internal combustion engine as described above, there has been proposed an internal combustion engine (see Japanese Patent Application Laid-Open No. 8-232646) in which an air-fuel ratio sensor that produces an output whose level is proportional to the air-fuel ratio of exhaust gas is disposed in an exhaust passage downstream of a NOx occluding member, and in which after the air-fuel ratio of exhaust gas flowing into the NOx occluding member is changed from the lean side to the rich side so as to release NOx from the NOx occluding member, it is determined that the release of NOx from the NOx occluding member is completed when the rate of change in the output level of the air-fuel ratio sensor when the air-fuel ratio of exhaust gas flowing out of the NOx occluding member changes from the lean side to the rich side exceeds a predetermined rate of change.

The output level of the air-fuel ratio sensor changes in a good response to completion of the release of NOx from the NOx occluding member. Therefore, by determining whether the NOx releasing operation is completed based on a change in the output level of the air-fuel ratio sensor as mentioned above, it becomes possible to change the air-fuel ratio of exhaust gas flowing into the NOx occluding member from the rich side to the lean side in a good response to completion of the NOx releasing operation. However, at the time of completion of the release of NOx, the output level of the air-fuel ratio sensor changes in various fashions, depending on performance variations among air-fuel ratio sensors and NOx occluding members, or time-depending changes thereof. Therefore, the rate of change in the output level exceeding the predetermined rate of change does not necessarily mean that the NOx releasing operation has been completed. Therefore, there is a drawback in the conventional art. That is, it is difficult to change the air-fuel ratio from the fuel-rich side to the fuel-lean side at the time of completion of the release of NOx.

SUMMARY OF THE INVENTION

Through experiments and researches on NOx occluding members carried out by the present inventors and the like, it has been found that if an NOx occluding member is supplied with a reducing agent in an amount that is greater than the amount needed to reduce the amount of NOx occluded in the NOx occluding member when the air-fuel ratio flowing into the NOx occluding member is changed to the fuel-rich side, that is, if the air-fuel ratio of exhaust gas flowing into the NOx occluding member continues to be on the rich side even after completion of the release of NOx from the NOx occluding member, a surplus amount of reducing agent that has not been used to release NOx from the NOx occluding member and reduce NOx is discharged from the NOx occluding member in the form of ammonia.

Therefore, if the amount of ammonia discharged from the NOx occluding member is determined, the surplus amount of the reducing agent is determined, which in turn makes it possible to determine the amount of the reducing agent needed to reduce the amount of NOx occluded in the NOx occluding member. If the amount of the reducing agent needed to reduce the NOx occluded in the NOx occluding member is determined, it become possible to change the air-fuel ratio of exhaust gas flowing into the NOx occluding member at the time of completion of the release of NOx from the NOx occluding member by setting a degree of fuel-richness and a duration of rich-side shift of the air-fuel ratio of exhaust gas flowing into the NOx occluding member so as to supply the needed amount of the reducing agent. Furthermore, if the amount of the reducing agent needed to reduce the NOx is determined, the amount of NOx occludable by the NOx occluding member can be determined, which in turn makes it possible to determine the degree of deterioration of the NOx occluding member.

Thus, given a surplus amount of the reducing agent is determined, the state of the NOx occluding member can be recognized, and the release of NOx from the NOx occluding member can be appropriately controlled.

Furthermore, if the discharge of ammonia from the NOx occluding member is monitored when the air-fuel ratio of exhaust gas flowing into the NOx occluding member is shifted to the rich side so as to release NOx from the NOx occluding member, it is possible to determine whether the release of NOx from the NOx occluding member has been completed.

It is an object of the invention to provide an emission control apparatus of an internal combustion engine capable of appropriately controlling the release of NOx from a NOx occluding member.

A first aspect of the invention is an emission control apparatus of an internal combustion engine in which a NOx occluding member that occludes a NOx when an air-fuel ratio of an inflow exhaust gas is on a fuel-lean side, and that, when the air-fuel ratio of the inflow exhaust gas changes to a fuel-rich side, allows the NOx occluded to be released and reduced by a reducing agent contained in the exhaust gas is disposed in an exhaust passage of the engine, and in which the NOx in the exhaust gas is occluded into the NOx occluding member when a combustion is conducted under a fuel-lean air-fuel ratio condition, and when the NOx is to be released from the NOx occluding member, the air-fuel ratio of the exhaust gas flowing into the NOx occluding member changed to the fuel-rich side. In this aspect, when the air-fuel ratio of the exhaust gas flowing into the NOx occluding member is changed to the fuel-rich side, a surplus amount of a reducing agent that is not used to release and reduce the NOx occluded in the NOx occluding member is let out in a form of ammonia from the NOx occluding member. Furthermore, a sensor capable of detecting an ammonia concentration is disposed in the exhaust passage downstream of the NOx occluding member. A representative value that indicates the surplus amount of the reducing agent is determined from a change in the ammonia concentration detected by the sensor.

In the first aspect, the representative value may be an integrated value of the ammonia concentration detected by the sensor.

In the first aspect, the representative value may be a maximum value of the ammonia concentration detected by the sensor.

In the first aspect, it is possible that as the representative value increases, a total amount of the reducing agent supplied to the NOx occluding member when the air-fuel ratio of the exhaust gas flowing into the NOx occluding member is changed to the fuel-rich side may be reduced.

In the first aspect, it is possible that as the representative value increases, a time during which the air-fuel ratio of the exhaust gas flowing into the NOx occluding member is kept on the fuel-rich side may be reduced.

In the first aspect, a reference value may be pre-set regarding the representative value. If the representative value becomes greater than the reference value, a total amount of the reducing agent supplied to the NOx occluding member when the air-fuel ratio of the exhaust gas flowing into the NOx occluding member is changed to the fuel-rich side may be reduced. If the representative value becomes less than the reference value, the total amount of the reducing agent supplied to the NOx occluding member when the air-fuel ratio of the exhaust gas flowing into the NOx occluding member is changed to the fuel-rich side may be increased.

In the first aspect, if the representative value becomes greater than the reference value, a time during which the air-fuel ratio of the exhaust gas flowing into the NOx occluding member is kept on the fuel-rich side maybe reduced. If the representative value becomes less than the reference value, the time during which the air-fuel ratio of the exhaust gas flowing into the NOx occluding member is kept on the fuel-rich side may be increased.

In the first aspect, the sensor may be capable of detecting a NOx concentration in the exhaust gas besides the ammonia concentration in the exhaust gas, and the air-fuel ratio of the exhaust gas flowing into the NOx occluding member may be changed from the fuel-lean side to the fuel-rich side if a predetermined set value is exceeded by the NOx concentration detected by the sensor while the combustion is conducted under the fuel-lean air-fuel ratio condition.

In the first aspect, the emission control apparatus may further include amount-of-occluded-NOx estimating device that estimates an amount of the NOx occluded in the NOx occluding member. A fuel-rich time interval for temporarily changing the air-fuel ratio of the exhaust gas flowing into the NOx occluding member to the fuel-rich side may be controlled based on the amount of the NOx estimated by the amount-of-occluded-NOx estimating device.

In the first aspect, the air-fuel ratio of the exhaust gas flowing into the NOx occluding member may be temporarily changed from the fuel-lean side to the fuel-rich side when the amount of the NOx occluded estimated by the amount-of-occluded-NOx estimating device exceeds an allowable value.

In the first aspect, the emission control apparatus may further include NOx occluding capability estimating device that estimates a NOx occluding capability of the NOx occluding member. The allowable value may be reduced as the NOx occluding capability estimated by the NOx occluding capability estimating device decreases.

In the first aspect, the sensor may be capable of detecting a NOx concentration in the exhaust gas besides the ammonia concentration in the exhaust gas. The air-fuel ratio of the exhaust gas flowing into the NOx occluding member may be changed from the fuel-lean side to the fuel-rich side if the NOx concentration detected by the sensor exceeds a predetermined set value although the amount of the NOx occluded estimated by the amount-of-occluded-NOx estimating device remains less than or equal to the allowable value while the combustion is conducted under the fuel-lean air-fuel ratio condition.

In the first aspect, the sensor maybe capable of detecting a NOx concentration in the exhaust gas besides the ammonia concentration in the exhaust gas. The allowable value may be reduced if the NOx concentration detected by the sensor exceeds a predetermined set value although the amount of the NOx occluded estimated by the amount-of-occluded-NOx estimating device remains less than or equal to the allowable value while the combustion is conducted under the fuel-lean air-fuel ratio condition.

In the first aspect, a degree of deterioration of the NOx occluding member may be detected based on the representative value.

In the first aspect, it maybe determined that the degree of deterioration of the NOx occluding member increases with a decrease in an amount obtained by subtracting the surplus amount of the reducing agent from a total amount of the reducing agent supplied to the NOx occluding member.

In the first aspect, when the air-fuel ratio of the exhaust gas flowing into the NOx occluding member is changed to the fuel-rich side, a degree of fuel-richness may be reduced with an increase in the degree of deterioration of the NOx occluding member.

A second aspect of the invention is an emission control apparatus of an internal combustion engine in which a NOx occluding member that occludes a NOx when an air-fuel ratio of an inflow exhaust gas is on a fuel-lean side and that releases the occluded NOx when the air-fuel ratio of the inflow exhaust gas changes to a fuel-rich side is disposed in an exhaust passage of the internal combustion engine, and in which the NOx in the exhaust gas is occluded into the NOx occluding member when a combustion is conducted under a fuel-lean air-fuel ratio condition, and the air-fuel ratio of the exhaust gas flowing into the NOx occluding member to the fuel-rich side is changed when the NOx is to be released from the NOx occluding member. In this aspect, a sensor capable of detecting an ammonia concentration is disposed in the exhaust passage downstream of the NOx occluding member. It is determined that a release of the NOx from the NOx occluding member is completed, if the ammonia concentration detected by the sensor starts to rise while the air-fuel ratio of the exhaust gas flowing into the NOx occluding member is kept on the fuel-rich side so as to release the NOx from the NOx occluding member.

In the second aspect, the sensor may generate an output signal having a level proportional to the ammonia concentration, and it may be determined that the release of the NOx from the NOx occluding member is completed, if the level of the output signal of the sensor exceeds a predetermined set value while the air-fuel ratio of the exhaust gas flowing into the NOx occluding member is kept on the fuel-rich side so as to release the NOx from the NOx occluding member.

In the second aspect, the air-fuel ratio of the exhaust gas flowing into the NOx occluding member may be changed from the fuel-rich side to the fuel-lean side if it is determined that the release of the NOx from the NOx concentration is completed.

In the second aspect, the sensor may be capable of detecting a NOx concentration in the exhaust gas besides the ammonia concentration in the exhaust gas, and the air-fuel ratio of the exhaust gas flowing into the NOx occluding member may be changed from the fuel-lean side to the fuel-rich side if a predetermined set value is exceeded by the NOx concentration detected by the sensor while the combustion is conducted under the fuel-lean air-fuel ratio condition.

In the second aspect, the emission control apparatus may further include amount-of-occluded-NOx estimating device that estimates an amount of the NOx occluded in the NOx occluding member. A fuel-rich time interval for temporarily changing the air-fuel ratio of the exhaust gas flowing into the NOx occluding member to the fuel-rich side may be changed based on the amount of the NOx estimated by the amount-of-occluded-NOx estimating device.

In the aforementioned aspect, the air-fuel ratio of the exhaust gas flowing into the NOx occluding member may be temporarily changed from the fuel-lean side to the fuel-rich side when the amount of the NOx occluded estimated by the amount-of-occluded-NOx estimating device exceeds an allowable value.

In the aforementioned aspect, the emission control apparatus may further include NOx occluding capability estimating device that estimates a NOx occluding capability of the NOx occluding member. The allowable value may be reduced as the NOx occluding capability estimated by the NOx occluding capability estimating device decreases.

In the aforementioned aspect, the sensor may be capable of detecting a NOx concentration in the exhaust gas besides the ammonia concentration in the exhaust gas, and the air-fuel ratio of the exhaust gas flowing into the NOx occluding member may be changed from the fuel-lean side to the fuel-rich side if the NOx concentration detected by the sensor exceeds a predetermined set value although the amount of the NOx occluded estimated by the amount-of-occluded-NOx estimating device remains less than or equal to the allowable value while the combustion is conducted under the fuel-lean air-fuel ratio condition.

In the aforementioned aspect, the sensor may be capable of detecting a NOx concentration in the exhaust gas besides the ammonia concentration in the exhaust gas, and the allowable value maybe reduced if the NOx concentration detected by the sensor exceeds a predetermined set value although the amount of the NOx occluded estimated by the amount-of-occluded-NOx estimating device remains less than or equal to the allowable value while the combustion is conducted under the fuel-lean air-fuel ratio condition.

A third aspect of the invention is an emission control apparatus of an internal combustion engine in which a NOx occluding member that occludes a NOx when an air-fuel ratio of an inflow exhaust gas is on a fuel-lean side, and that, when the air-fuel ratio of the inflow exhaust gas changes to a fuel-rich side, allows the NOx occluded to be released and reduced by a reducing agent contained in the exhaust gas is disposed in an exhaust passage of the engine, and in which air-fuel ratio detector is disposed in the exhaust passage of the engine downstream of the NOx occluding member. In the emission control apparatus, the NOx in the exhaust gas is occluded into the NOx occluding member when a combustion is conducted under a fuel-lean air-fuel ratio condition. The air-fuel ratio of the exhaust gas flowing into the NOx occluding member is changed to the fuel-rich side when the NOx is to be released from the NOx occluding member. At a time near completion of the release the NOx from the NOx occluding member, the air-fuel ratio of the exhaust gas flowing into the NOx occluding member is changed from the fuel-rich side to the fuel-lean side if an output signal level of the air-fuel ratio detector exceeds a reference level while the output signal level of the air-fuel ratio detector is changing toward a level that indicates a fuel-rich air-fuel ratio. In this aspect, when the air-fuel ratio of the exhaust gas flowing into the NOx occluding member is changed to the fuel-rich side, a surplus amount of a reducing agent that is not used to release and reduce the NOx occluded in the NOx occluding member is let out in a form of ammonia from the NOx occluding member. A sensor capable of detecting an ammonia concentration is disposed in the exhaust passage downstream of the NOx occluding member. The reference level is changed so that the air-fuel ratio of the exhaust gas is changed from the fuel-rich side to the fuel-lean side when a release of the NOx from the NOx occluding member is completed based on a change in the ammonia concentration detected by the sensor.

In the third aspect, the representative value that indicates the surplus amount of the reducing agent may be determined from a change in the ammonia concentration detected by the sensor, and the reference level may be changed so that the representative value reaches a target value.

In the third aspect, the representative value may be an integrated value of the ammonia concentration detected by the sensor.

In the third aspect, the representative value may be a maximum value of the ammonia concentration detected by the sensor.

In the third aspect, the sensor maybe capable of detecting a NOx concentration in the exhaust gas besides the ammonia concentration in the exhaust gas, and the air-fuel ratio of the exhaust gas flowing into the NOx occluding member may be changed from the fuel-lean side to the fuel-rich side if a predetermined set value is exceeded by the NOx concentration detected by the sensor while the combustion is conducted under the fuel-lean air-fuel ratio condition.

In the third aspect, the emission control apparatus may further include amount-of-occluded-NOx estimating device that estimates an amount of the NOx occluded in the NOx occluding member. A fuel-rich time interval for temporarily changing the air-fuel ratio of the exhaust gas flowing into the NOx occluding member to the fuel-rich side may be controlled based on the amount of the NOx estimated by the amount-of-occluded-NOx estimating device.

In the foregoing aspect, the air-fuel ratio of the exhaust gas flowing into the NOx occluding member may be temporarily changed from the fuel-lean side to the fuel-rich side when the amount of the NOx occluded estimated by the amount-of-occluded-NOx estimating device exceeds an allowable value.

In the foregoing aspect, the emission control apparatus may further include NOx occluding capability estimating device that estimates a NOx occluding capability of the NOx occluding member. The allowable value may be reduced as the NOx occluding capability estimated by the NOx occluding capability estimating device decreases.

In the foregoing aspect, the sensor may be capable of detecting a NOx concentration in the exhaust gas besides the ammonia concentration in the exhaust gas. The air-fuel ratio of the exhaust gas flowing into the NOx occluding member may be changed from the fuel-lean side to the fuel-rich side if the NOx concentration detected by the sensor exceeds a predetermined set value although the amount of the NOx occluded estimated by the amount-of-occluded-NOx estimating device remains less than or equal to the allowable value while the combustion is conducted under the fuel-lean air-fuel ratio condition.

In the foregoing aspect, the sensor may be capable of detecting a NOx concentration in the exhaust gas besides the ammonia concentration in the exhaust gas. The allowable value maybe reduced if the NOx concentration detected by the sensor exceeds a predetermined set value although the amount of the NOx occluded estimated by the amount-of-occluded-NOx estimating device remains less than or equal to the allowable value while the combustion is conducted under the fuel-lean air-fuel ratio condition.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIGS. 11A to 11C are time charts indicating electric currents detected by a NOx ammonia sensor in accordance with the second embodiments of the invention;

DETAILED DESCRIPTION OF PREFERRED EMBODIMENTS

Figure 1:
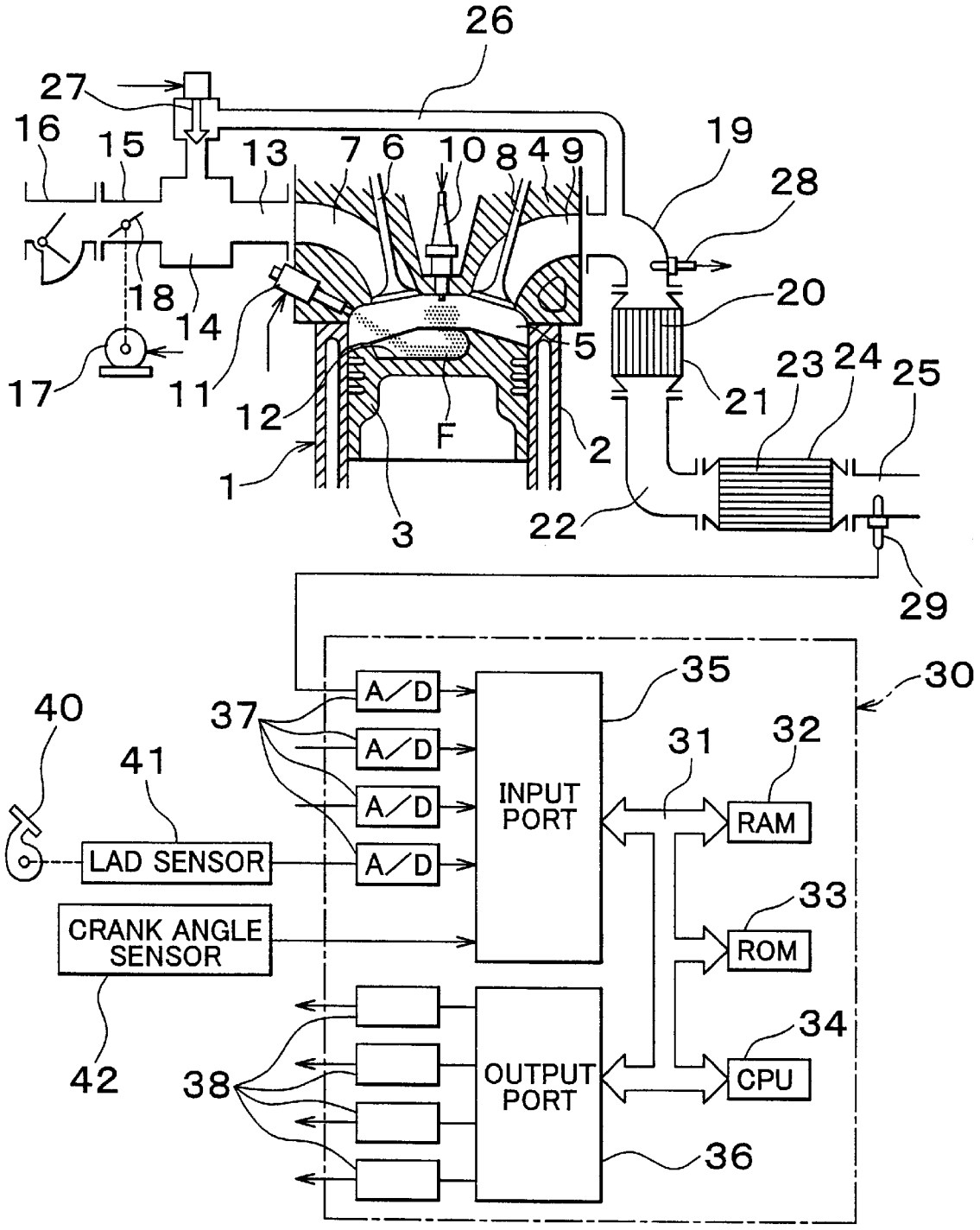
FIG. 1 is a diagram illustrating an overall construction of an internal combustion engine in accordance with first to fifth embodiments of the invention.

FIG. 1 illustrates a direct injection-type spark injection engine to which first to fifth embodiments of the invention are applied. The invention is also applicable to compression ignition internal combustion engines.

FIG. 1 shows an engine body 1, a cylinder block 2, a piston 3 movable back and forth in the cylinder block 2, a cylinder head 4 fixed to an upper portion of the cylinder block 2, a combustion chamber 5 defined between the piston 3 and the cylinder head 4, an intake valve 6, an intake port 7, an exhaust valve 8, and an exhaust port 9. As shown in FIG. 1, an ignition plug 10 is disposed in a central portion of an inner wall surface of the cylinder head 4, and a fuel injection valve 11 is disposed in a peripheral portion of the inner wall surface of the cylinder head 4. Furthermore, a top surface of the piston 3 has a cavity 12 that extends from below the fuel injection valve 11 to below the ignition plug 10.

The intake port 7 of each cylinder is connected to a surge tank 14 via a corresponding intake branch pipe 13. The surge tank 14 is connected to an air cleaner (not shown) via an intake duct 15 and an air flow meter 16. Disposed in the intake duct 15 is a throttle valve 18 that is driven by a stepping motor 17. The exhaust port 9 of each cylinder is connected to an exhaust manifold 19. The exhaust manifold 19 is connected to a casing 24 that contains an NOx occluding member 23, via a catalytic converter 21 that contains an oxidation catalyst or a three-way catalyst 20 and via an exhaust pipe 22. The exhaust manifold 19 and the surge tank 14 are interconnected via a recirculated exhaust gas (hereinafter, referred to as "EGR gas") conduit 26. An EGR gas control valve 27 is disposed in the EGR gas conduit 26.

An electronic control unit 30 is formed by a digital computer that includes a RAM (random access memory) 32, a ROM (read-only memory) 33, a CPU (microprocessor) 34, an input port 35, and an output port 36 that are connected to one another via a bidirectional bus 31. The air flow meter 16 generates an output voltage proportional to the amount of intake air. The output voltage is inputted to the input port 35 via a corresponding A/D converter 37. The exhaust manifold 19 is provided with an air-fuel ratio sensor 28 for detecting the air-fuel ratio. The output signal of the air-fuel ratio sensor 28 is inputted to the input port 35 via a corresponding A/D converter 37. A NOx ammonia sensor 29 capable of detecting the NOx concentration and the ammonia concentration in exhaust gas is disposed in an exhaust pipe 25 that is connected to an outlet of the casing 24 containing the NOx occluding member 23. The output signal of the NOx ammonia sensor 29 is inputted to the input port 35 via a corresponding A/D converter 37.

An accelerator pedal 40 is connected to a load sensor 41 that generates an output voltage proportional to the amount of depression of the accelerator pedal 40. The output voltage of the load sensor 41 is inputted to the input port 35 via a corresponding A/D converter 37. A crank angle sensor 42 generates an output pulse, for example, at every 300 rotation of a crankshaft. The output pulse of the crank angle sensor 42 is inputted to the input port 35. From the output pulse of the crank angle sensor 42, the CPU 34 calculates an engine revolution speed. The output port 36 is connected to the ignition plugs 10, the fuel injection valves 11, the stepping motor 17, the EGR gas control valve 27 via corresponding drive circuits 38.

Next, the structure of a sensor portion of the NOx ammonia sensor 29 shown in FIG. 1 will be briefly described with reference to FIG. 2.

Figure 2:
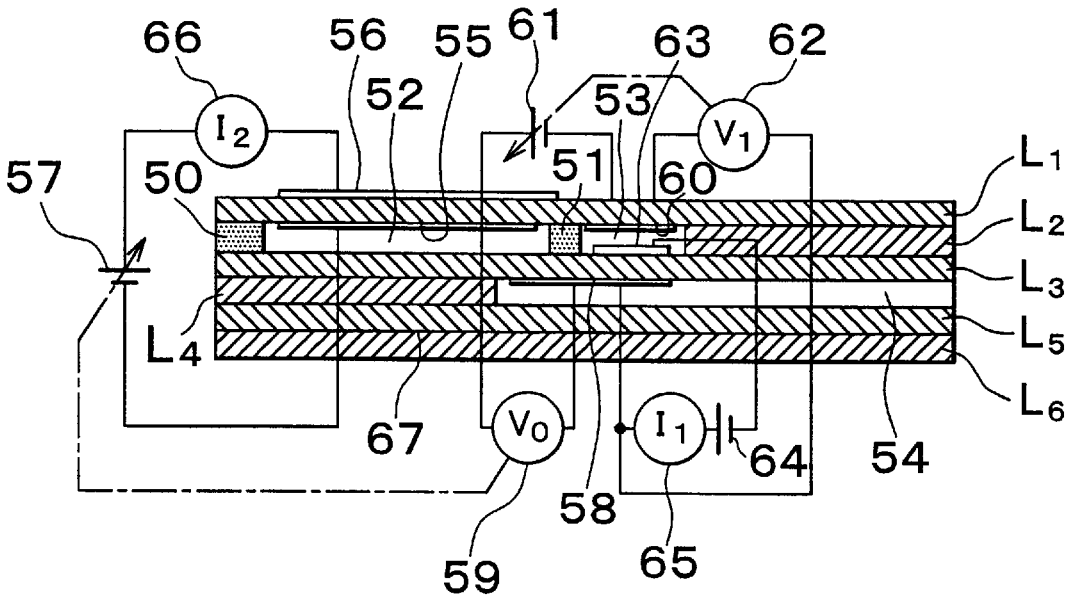
FIG. 2 is a diagram illustrating a structure of a sensor portion of a NOx ammonia sensor.

Referring to FIG. 2, the sensor portion of the NOx ammonia sensor 29 is six oxygen ion-conductive solid electrolyte layers of, for example, zirconia oxide or the like, which are stacked on one another. Hereinafter, the six solid electrolyte layers will be referred to as "first layer $L_1$", "second layer $L_2$", "third layer $L_3$", "fourth layer $L_4$", "fifth layer $L_5$" and "sixth layer $L_6$" in that order from the top to the bottom.

Further referred to FIG. 2, a first diffusion-controlling member 50 and a second diffusion-controlling member 51, for example, which are porous members or have small pores, are disposed between the first layer $L_1$ and the third layer $L_3$. A first chamber 52 is defined between the diffusion-controlling members 50, 51, and a second chamber 53 is defined between the second diffusion-controlling member 51 and the second layer $L_2$. An atmospheric chamber 54 connected in communication with an external air is defined between the third layer $L_3$ and the fifth layer $L_5$. An outside end surface of the first diffusion-controlling member 50 contacts exhaust gas. Therefore, exhaust gas flows into the first chamber 52 via the first diffusion-controlling member 50, so that the first chamber 52 is filled with exhaust gas.

A negative electrode-side first pump electrode 55 is formed on an inner peripheral surface of the first layer $L_1$ that faces the first chamber 52. A positive electrode-side first pump electrode 56 is formed on an outer peripheral surface of the first layer $L_1$. A voltage is applied between the first pump electrodes 55, 56 by a first pump voltage source 57. When voltage is applied between the first pump electrodes 55, 56, oxygen contained in exhaust gas within the first chamber 52 contacts the negative electrode-side first pump electrode 55, and becomes oxygen ions. The oxygen ions flow through the first layer $L_1$ toward the positive electrode-side first pump electrode 56. Thus, oxygen in exhaust gas within the first chamber 52 migrates through the first layer $L_1$, and is pumped out to the outside. The amount of oxygen pumped out increases with increases in the voltage of the first pump voltage source 57.

A reference electrode 58 is formed on an inner peripheral surface of the third layer $L_3$ that faces the atmospheric chamber 54. If there is an oxygen concentration difference across an oxygen ion-conductive solid electrolyte layer, oxygen ions migrate through the solid electrolyte layer from the higher-oxygen concentration side toward the lower-oxygen concentration side. In the example shown in FIG. 2, the oxygen concentration in the atmospheric chamber 54 is higher than the oxygen concentration in the first chamber 52. Therefore, oxygen in the atmospheric chamber 54 receives charges to become oxygen ions upon contact with the reference electrode 58. Thus-formed oxygen ions migrate through the third layer $L_3$, the second layer $L_2$ and the first layer $L_1$, and release charges at the negative electrode-side first pump electrode 55. As a result, a voltage $V_o$ indicated by reference numeral 59 is generated between the reference electrode 58 and the negative electrode-side first pump electrode 55. The voltage $V_o$ is proportional to the oxygen concentration difference between the atmospheric chamber 54 and the first chamber 52.

In the example shown in FIG. 2, the voltage of the first pump voltage source 57 is feedback-controlled so that the voltage $V_o$ becomes equal to the voltage that occurs when the oxygen concentration in the first chamber 52 is 1 ppm. That is, oxygen in the first chamber 52 is pumped up via the first layer $L_1$ in such a manner that the oxygen concentration in the first chamber 52 becomes 1 ppm. As a result, the oxygen concentration in the first chamber 52 is kept at 1 ppm.

The negative electrode-side first pump electrode 55 is formed from a material that has a low reducing characteristic with respect to NOx, for example, an alloy of gold Au and platinum Pt. Therefore, NOx contained in exhaust gas is scarcely reduced in the first chamber 52. Hence, NOx flows into the second chamber 53 through the second diffusion-controlling member 51.

A negative electrode-side second pump electrode 60 is formed on an inner peripheral surface of the first layer $L_1$ that faces the second chamber 53. Voltage is applied between the negative electrode-side second pump electrode 60 and the positive electrode-side first pump electrode 56 by a second pump voltage source 61. When voltage is applied between the pump electrodes 60, 56, oxygen contained in exhaust gas in the second chamber 53 becomes oxygen ions upon contact with the negative electrode-side second pump electrode 60. The oxygen ions migrate through the first layer $L_1$ toward the positive electrode-side first pump electrode 56. Thus, oxygen in exhaust gas within the second chamber 53 migrates through the first layer $L_1$, and is pumped out to the outside. The amount of oxygen pumped out increases with increases in the voltage of the second pump voltage source 61.

If there is an oxygen concentration difference across an oxygen ion-conductive solid electrolyte layer, oxygen ions migrate through the solid electrolyte layer from the higher-oxygen concentration side toward the lower-oxygen concentration side as mentioned above. In the example shown in FIG. 2, the oxygen concentration in the atmospheric chamber 54 is higher than the oxygen concentration in the second chamber 53. Therefore, oxygen in the atmospheric chamber 54 receives charges to become oxygen ions upon contact with the reference electrode 58. Thus-formed oxygen ions migrate through the third layer $L_3$, the second layer $L_2$ and the first layer $L_1$, and release charges at the negative electrode-side second pump electrode 60. As a result, a voltage $V_1$ indicated by reference numeral 62 is generated between the reference electrode 58 and the negative electrode-side second pump electrode 60. The voltage $V_1$ is proportional to the difference between the oxygen concentration in the atmospheric chamber 54 and that in the second chamber 53.

In the example shown in FIG. 2, the voltage of the second pump voltage source 61 is feedback-controlled so that the voltage $V_1$ becomes equal to the voltage that occurs when the oxygen concentration in the second chamber 53 is 0.01 ppm. That is, oxygen in the second chamber 53 is pumped up via the first layer $L_1$ in such a manner that the oxygen concentration in the second chamber 53 becomes 0.01 ppm. As a result, the oxygen concentration in the second chamber 53 is kept at 0.01 ppm.

The negative electrode-side second pump electrode 60 is formed from a material that has a low reducing characteristic with respect to NOx, for example, an alloy of gold Au and platinum Pt. Therefore, NOx contained in exhaust gas is scarcely reduced despite contact with the negative electrode-side second pump electrode 60.

A negative electrode-side pump electrode 63 for detecting NOx is formed on an inner peripheral surface of the third layer $L_3$ that faces the second chamber 53. The negative electrode-side pump electrode 63 is formed from a material that has a strong reducing characteristic with respect to NOx, for example, rhodium Rh or platinum Pt. Therefore, NOx in the second chamber 53, most of which is normally No, is decomposed into $N_2$ and $O_2$ on the negative electrode-side pump electrode 63. As indicated in FIG. 2, a constant voltage 64 is applied between the negative electrode-side pump electrode 63 and the reference electrode 58. Therefore, $O_2$ produced through decomposition on the negative electrode-side pump electrode 63 become oxygen ions, which migrate through the third layer $L_3$ toward the reference electrode 58. At this moment, an electric current $I_1$ indicated by reference numeral 65 which is proportional to the amount of oxygen ions flows between the negative electrode-side pump electrode 63 and the reference electrode 58.

As mentioned above, NOx is scarcely reduced in the first chamber 52, and oxygen scarcely exists in the second chamber 53. Therefore, the current $I_1$ is proportional to the concentration of NOx in exhaust gas. Hence, the NOx concentration in exhaust gas can be detected based on the current Ammonia $NH_3$ contained in exhaust gas is decomposed into NO and $H_2O$ ($4NH_3+5O_2 \rightarrow 4NO+6H_2O$). The decomposed NO flows into the second chamber 53 through the second diffusion-controlling member 51. The NO is decomposed into $N_2$ and $O_2$ on the negative electrode-side pump electrode 63. The decomposed product $O_2$ becomes oxygen ions, which migrate through the third layer $L_3$ toward the reference electrode 58. In this case, too, the current $I_1$ is proportional to the concentration of $NH_3$ in exhaust gas. Hence, the $NH_3$ concentration can be detected based on the current $I_1$.

Figure 3:
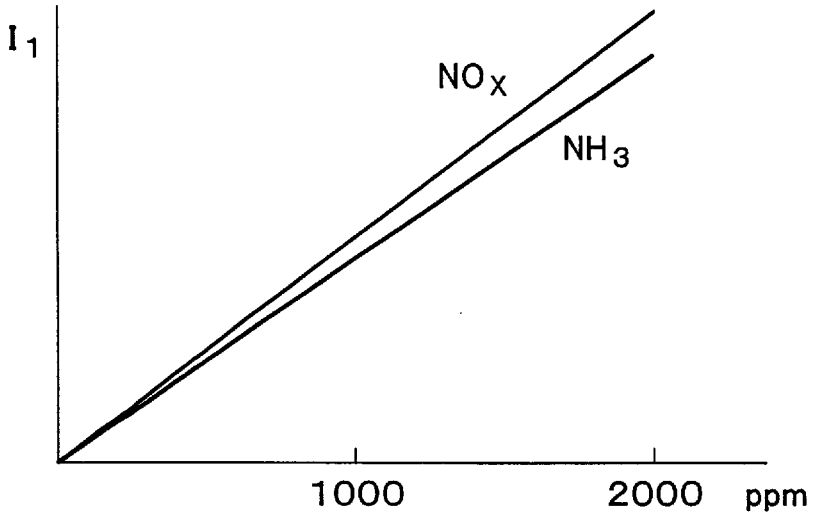
FIG. 3 is a diagram indicating electric currents detected by the NOx ammonia sensor.

FIG. 3 indicates relationships between the current $I_1$ and the concentrations of NOx and $NH_3$ in exhaust gas. It should be apparent from FIG. 3 that the current $I_1$ is proportional to the NOx concentration and the $NH_3$ concentration in exhaust gas.

As in the oxygen concentration in exhaust gas increases, that is, as the air-fuel ratio shifts to the lean side, the amount of oxygen pumped from the first chamber 52 to the outside increases and a current $I_2$ indicated by reference numeral 66 increases. Therefore, the air-fuel ratio of exhaust gas can be detected from the current $I_2$.

An electric heater 67 for heating the sensor portion of the NOx ammonia sensor 29 is disposed between the fifth layer $L_5$ and the sixth layer $L_6$. Due to the electric heater 67, the sensor portion of the NOx ammonia sensor 29 is heated to 700–800° C.

Figure 4A:
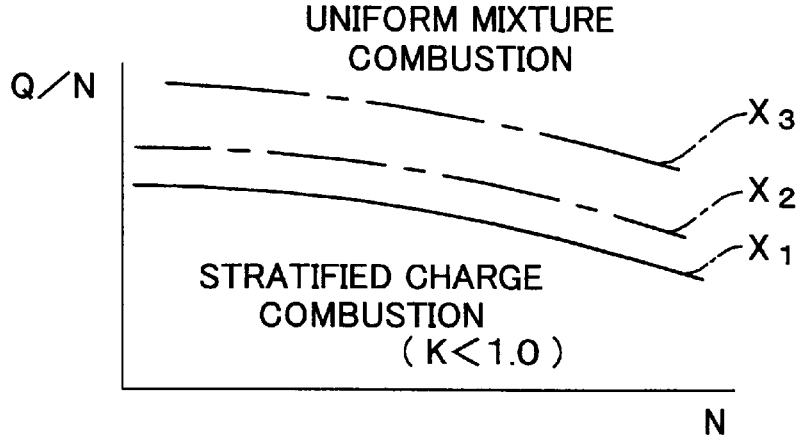
FIGS. 4A to 4C are diagrams indicating a basic amount of injected fuel, a correction factor, etc.

Next, a fuel injection control of the internal combustion engine shown in FIG. 1 will be described with reference to FIG. 4A. In FIG. 4A, the vertical axis indicates engine load Q/N (amount of intake air Q/engine revolution speed N), and the horizontal axis indicates the engine revolution speed N.

In an operation region to the lower load side of a solid line $X_1$ in FIG. 4A, a stratified charge combustion is performed. That is, in this case, a fuel F is injected from each fuel injection valve 11 into the cavity 12 during a late stage of the compression stroke as illustrated in FIG. 1. The injected fuel is guided by the inner peripheral surface of the cavity 12 to form a mixture gas around the ignition plug 10. Then, the mixture gas is ignited and burned by the ignition plug 10. In this case, the average air-fuel ratio in the combustion chamber 5 is on the lean side.

In a region on the higher load side of the solid line $X_1$ in FIG. 4A, fuel is injected from the fuel injection valve 11 during the intake stroke, so that a uniform mixture combustion is performed. In a region between the solid line $X_1$ and a chain line $X_2$, the uniform mixture combustion is performed at a lean air-fuel ratio. In a region between the chain line $X_2$ and a chain line $X_3$, the uniform mixture combustion is performed at a stoichiometric air-fuel ratio. In a region on the higher load side of the chain line $X_3$, the uniform mixture combustion is performed at a rich air-fuel ratio.

Figure 4B:
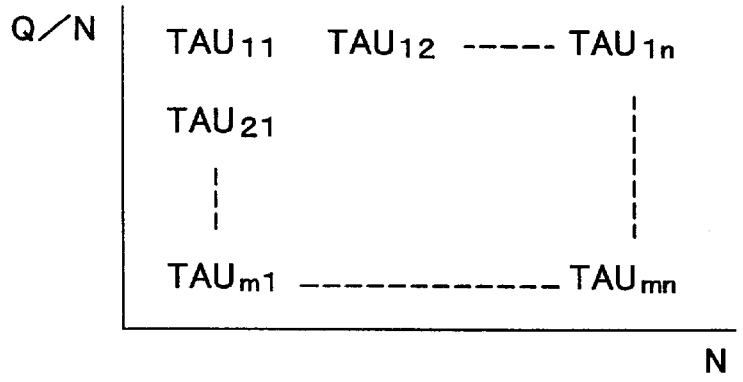
Figure 4C:
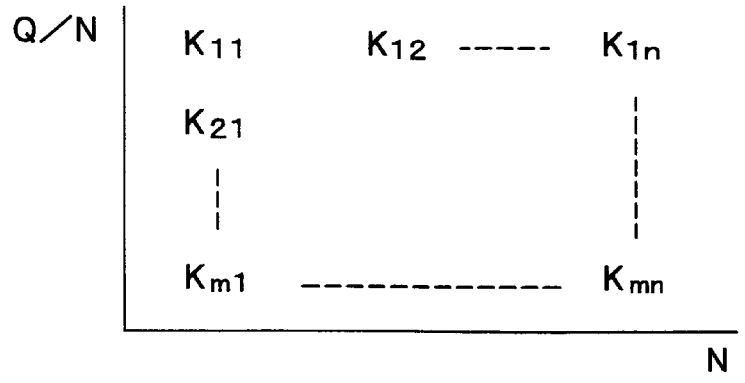

In the invention, a basic amount TAU of injected fuel needed to achieve the stoichiometric air-fuel ratio is pre-stored in the ROM 33 in the form of a map as a function of the engine load Q/N and the engine revolution speed N as indicated in FIG. 4B. Basically, the basic amount TAU of injected fuel is multiplied by a correction factor K to determine a final amount TAUO of injected fuel (=K·TAU). The correction factor K is pre-stored in the ROM 33 in the form of a map as a function of the engine load Q/N and the engine revolution speed N as indicated in FIG. 4C.

The value of the correction factor K is smaller than 1.0 in the operation region on the lower load side of the chain line $X_2$ in FIG. 4A where the combustion is performed at a lean air-fuel ratio. The value of the correction factor K is greater than 1.0 in the operation region on the higher load side of the chain line $X_3$ in FIG. 4A where the combustion is performed at a rich air-fuel ratio. The value of the correction factor K is 1.0 in the operation region between the chain line $X_2$ and the chain line $X_3$. In this case, the air-fuel ratio is feedback-controlled based on the output signal of the air-fuel ratio sensor 28 so that the air-fuel ratio becomes equal to the stoichiometric air-fuel ratio.

The NOx occluding member 23 disposed in the engine exhaust passage is formed by, for example, loading an alumina support with at least one species selected from the group consisting of alkali metals such as potassium K, sodium Na, lithium Li, cesium Cs, etc., alkaline earths such as barium Ba, calcium Ca, etc., and rare earths such as lanthanum La, yttrium Y, etc., and also with a precious metal such as platinum Pt. In this case, it is also possible to dispose a particulate filter formed from, for example, cordierite, within the casing 24, and to load the particulate filter with an alumina-supported NOx occluding member 23.

In any case, the NOx occluding member 23 performs NOx occlusion-release operation as follows. That is, the NOx occluding member 23 occludes NOx selectively when the air-fuel ratio of exhaust gas flowing into the NOx occluding member 23, that is, the ratio between air and fuel (hydrocarbon) supplied into the engine intake passage, the combustion chamber 5 and the exhaust passage upstream of the NOx occluding member 23, is on the fuel-lean side of the stoichiometric air-fuel ratio. If the inflow exhaust gas air-fuel ratio is equal to the stoichiometric air-fuel ratio or on the fuel-rich side thereof, the NOx occluding member 23 releases occluded NOx. It is to be understood that "occlusion" used herein (in this specification) means retention of a substance (solid, liquid, gas molecules) in the form of at least one of adsorption, adhesion, absorption, trapping, storage, and others.

If the NOx occluding member 23 is disposed in the engine exhaust passage, the NOx occluding member 23 actually performs the NOx occlusion-release operation. However, the detailed mechanism of the occlusion-release operation has not been thoroughly clarified. However, the occlusion-release operation is considered to occur by a mechanism illustrated in FIG. 5. This mechanism will now be described in conjunction with a case where a support is loaded with platinum Pt and barium Ba. Substantially the same mechanism applies for cases in which precious metals, other alkali metals, alkaline earths or rare earths other than Platinum and Barium are used.

Figure 5A:
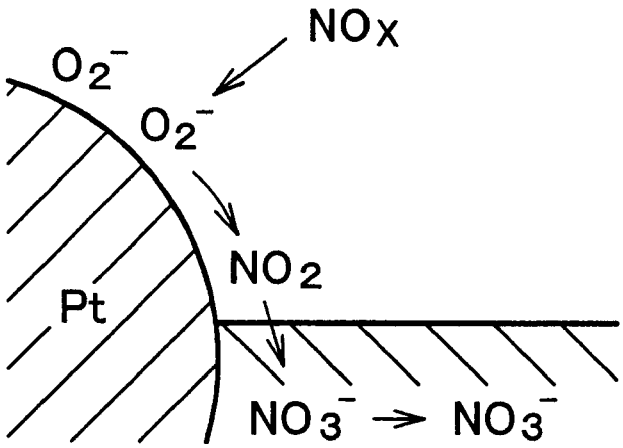
FIGS. 5A and 5B diagrams illustrating the NOx occluding-releasing operation of a NOx occluding member.

In the internal combustion engine shown in FIG. 1, combustion is conducted in a state of a lean air-fuel ratio during an operation region where the engine is highly frequently operated. When combustion is conducted at a lean air-fuel ratio, the oxygen concentration in exhaust gas is high, and oxygen $O_2$ deposits on surfaces of platinum Pt in the form of $O_2^-$ or $O^{2-}$ as indicated in FIG. 5A.

Nitrogen monoxide NO in exhaust gas reacts with $O_2^-$ or $O^{2-}$ on surfaces of platinum Pt to produce nitrogen dioxide $NO_2$ ($2NO+2O_2 \rightarrow 2NO_2$). A portion of the thus-produced nitrogen dioxide ($NO_2$) is further oxidized on surfaces of platinum Pt and, at the same time, is occluded into the occluding member, and diffuses in the occluding member in the form of nitrate ions $NO_3^-$ while binding to barium oxide (BaO). In this manner, NOx is occluded into the NOx occluding member 23. As long as the oxygen concentration in exhaust gas is high, $NO_2$ is produced on surfaces of platinum Pt. As long as the NOx occluding capability of the occluding member remains unsaturated, $NO_2$ is occluded into the occluding member, and forms nitrate ions $NO_3^-$.

Figure 5B:
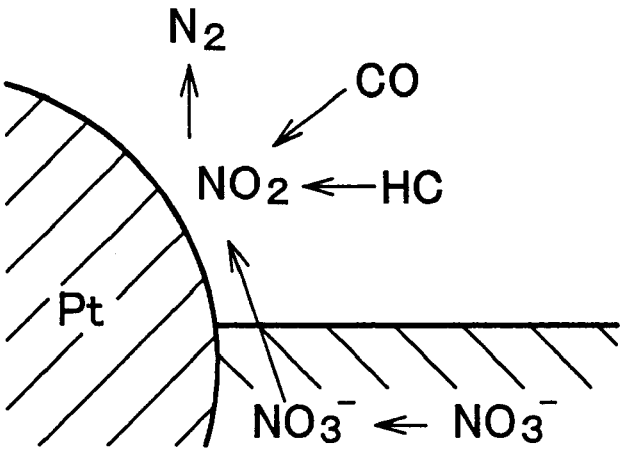

If the inflow exhaust gas air-fuel ratio is shifted to the fuel-rich side, the oxygen concentration in inflow exhaust gas decreases, so that the amount of $NO_2$ produced on surfaces of platinum Pt decreases. As the production of $NO_2$ becomes lower, the reaction reverses ($NO_3^- \rightarrow NO_2$). As a result, nitrate ions $NO_3^-$ is released from the occluding member in the form of $NO_2$. NOx released from the NOx occluding member 23 is reduced through reactions with unburned HC, CO present in large amounts in inflow exhaust gas as indicated in FIG. 5B. In this manner, as $NO_2$ disappears from surfaces of platinum Pt, $NO_2$ is continually released from the occluding member. Therefore, NOx is released from the NOx occluding member 23 within a short time after the inflow exhaust gas air-fuel ratio is shifted to the rich side. The released NOx is reduced. Therefore, NOx is not discharged into the atmosphere.

In this case, even if the inflow exhaust gas air-fuel ratio is set to the stoichiometric air-fuel ratio, NOx is released from the NOx occluding member 23. However, if the inflow exhaust gas air-fuel ratio is equal to the stoichiometric air-fuel ratio, NOx is merely gradually released from the NOx occluding member 23, so that it takes a relatively long time to release the entire amount of NOx occluded in the NOx occluding member 23.

The NOx occluding capability of the NOx occluding member 23 has a limit. Therefore, it is necessary to release NOx from the NOx occluding member 23 before the NOx occluding capability of the NOx occluding member 23 becomes saturated. The NOx occluding member 23 occludes substantially the entire amount of NOx present in exhaust gas while the NOx occluding capability of the NOx occluding member 23 is sufficiently high. However, as the NOx occluding capability approaches the limit, a portion of the NOx is left unoccluded. Therefore, as the NOx occluding capability of the NOx occluding member 23 approaches the limit, the amount of NOx let out from the NOx occluding member 23 starts increasing.

In the first embodiment as well as other embodiments of the invention, therefore, the air-fuel ratio of exhaust gas flowing into the NOx occluding member 23 is temporarily shifted to the fuel-rich side so as to release NOx from the NOx occluding member 23 when the amount of NOx let out from the NOx occluding member 23. There are various methods for shifting the air-fuel ratio of exhaust gas flowing into the NOx occluding member 23 to the fuel-rich side. For example, the exhaust gas air-fuel ratio can be shifted to the rich side by shifting the average air-fuel ratio of mixture in the combustion chamber 5. Furthermore, the exhaust gas air-fuel ratio can be shifted to the rich side by injecting an additional amount of fuel during a late stage of the expansion stroke or during the exhaust stroke. The exhaust gas air-fuel ratio can also be shifted to the fuel-rich side by injecting an additional amount of fuel in the exhaust passage upstream of the NOx occluding member 23. The embodiment of the invention employs the first-mentioned method, that is, the method in which the exhaust gas air-fuel ratio is shifted to the fuel-rich side by conducting uniform mixture combustion at a rich air-fuel ratio.

It should be noted herein that SOx is contained in exhaust gas and is occluded into the NOx occluding member 23 as well as NOx. The mechanism of occlusion of SOx into the NOx occluding member 23 is considered substantially the same as the mechanism of NOx occlusion.

Similarly to the description of the mechanism of NOx occlusion, the mechanism of SOx occlusion will be described in conjunction with an example in which a support is loaded with platinum Pt and barium Ba. When the inflow exhaust gas air-fuel ratio is on the lean side of the stoichiometric air-fuel ratio, oxygen $O_2$ deposits on surfaces of platinum Pt in the form of $O^{2-}$ or $O_2^-$, and $SO_2$ in exhaust gas reacts with $O_2^-$ or $O^{2-}$ on the platinum Pt to produce $SO_3$. A portion of the produced $SO_3$ is further oxidized on surfaces of platinum Pt and, at the same time, is occluded into the occluding member, and diffuses in the occluding member in the form of sulfate ions $SO_4^{2-}$ while binding to barium oxide BaO. Thus, a stable sulfate $BaSO_4$ is produced.

The sulfate $BaSO_4$ is stable and less readily decomposes. Therefore, if the air-fuel ratio of inflow exhaust gas flowing into the three-way catalyst 20 is shifted to the stoichiometric air-fuel ratio or to the rich side thereof, the sulfate $BaSO_4$ tends to remain without being decomposed. Therefore, the sulfate $BaSO_4$ increases in the NOx occluding member 23 as time elapses. Hence, the amount NOx that can be occluded by the NOx occluding member 23 decreases as time elapses. That is, the NOx occluding member 23 deteriorates as time elapses.

However, if the temperature of the NOx occluding member 23 reaches or exceeds a certain value, for example, 600° C., the sulfate $BaSO_4$ decomposes in the NOx occluding member 23. If, in this occasion, the air-fuel ratio of exhaust gas that flows into the NOx occluding member 23 is shifted to the fuel-rich side, SOx can be released from the NOx occluding member 23. In the embodiment of the invention, therefore, SOx is released from the NOx occluding member 23 by shifting the air-fuel ratio of exhaust gas that flows into the NOx occluding member 23 to the fuel-rich side if the temperature of the NOx occluding member 23 is high when SOx needs to be released from the NOx occluding member 23. If the temperature of the NOx occluding member 23 is low when SOx needs to be released, the temperature of the NOx occluding member 23 is raised and the air-fuel ratio of exhaust gas that flows into the NOx occluding member 23 is shifted to the fuel-rich side.

Next described will be a relationship between the concentration of ammonia $NH_3$ in exhaust gas let out of the NOx occluding member 23 and the amount of a reducing agent when the air-fuel ratio of exhaust gas that flows into the NOx occluding member 23 is shifted to the fuel-rich side so as to release NOx from the NOx occluding member 23.

First, the amount of the reducing agent will be described. As fuel in excess of the amount of fuel needed to set the air-fuel ratio of exhaust gas that flows into the NOx occluding member 23 at the stoichiometric air-fuel ratio is used to release and reduce NOx, the excess amount of fuel equals the amount of the reducing agent used to release and reduce NOx. This applies to a case where the air-fuel ratio of mixture in the combustion chamber 5 is shifted to the fuel-rich side when NOx needs to be released from the NOx occluding member 23, and a case where an additional amount of fuel is injected during a late stage of the compression stroke or during the exhaust stroke in that occasion, and a case where an additional amount of fuel is injected into the exhaust passage upstream of the NOx occluding member 23 in that occasion.

In a construction as in the embodiment of the invention wherein the air-fuel ratio of exhaust gas that flows into the NOx occluding member 23 is shifted to the fuel-rich side when NOx needs to be released from the NOx occluding member 23, the amount of the reducing agent ΔQR supplied to the NOx occluding member 23 per fuel injection can be expressed as in the following equation:

$$\Delta QR = TAU \cdot (K_R - 1.0)$$

where TAU is the basic amount of injected fuel indicated in FIG. 4(B), and $K_R$ is a value of a correction factor K with respect to the basic amount TAU of injected fuel and indicates the degree of richness (stoichiometric air-fuel ratio/rich air-fuel ratio) when the air-fuel ratio is set to a rich air-fuel ratio. Accumulation of the amounts of the reducing agent ΔQR per fuel injection provides the total amount of the reducing agent QR supplied to the NOx occluding member 23.

Next, the concentration of ammonia will be described. If the air-fuel ratio is on the lean side, that is, if an oxidative atmosphere is achieved, substantially no ammonia $NH_3$ is produced. However, if the air-fuel ratio shifts to the fuel-rich side, that is, if a reducing atmosphere is achieved, nitrogen $N_2$ in intake air or exhaust gas is reduced by hydrocarbon HC on the oxidation catalyst or three-way catalyst 20 so as to produce ammonia $NH_3$. If the air-fuel ratio is on the fuel-rich side, NOx is released from the NOx occluding member 23, and the produced ammonia $NH_3$ is used to reduce NOx. Therefore, while NOx is released from the NOx occluding member 23, more precisely, while the supplied reducing agent is used to release and reduce NOx, no ammonia $NH_3$ is let out of the NOx occluding member 23. In contrast, if the air-fuel ratio continues to be on the fuel-rich side after completion of release of NOx from the NOx occluding member 23, more precisely, if an excess amount of the reducing agent that is not used to release NOx from the NOx occluding member 23 and reduce NOx is supplied, ammonia $NH_3$ is no longer consumed to reduce NOx, so that ammonia $NH_3$ is not let out of the NOx occluding member 23.

This also occurs when the oxidative catalyst or three-way catalyst 20 is not provided upstream of the NOx occluding member 23. That is, since the NOx occluding member 23 is provided with a catalyst having a reducing function, such as platinum Pt or the like, there is a possibility that ammonia $NH_3$ may be produced in the NOx occluding member 23 if the air-fuel ratio shifts to the fuel-rich side. However, even if ammonia $NH_3$ is produced, ammonia $NH_3$ is used to reduce NOx released from the NOx occluding member 23, so that ammonia $NH_3$ is not let out of the NOx occluding member 23. However, if an excess amount of the reducing agent that is not used to release NOx from the NOx occluding member 23 and reduce NOx is supplied, ammonia $NH_3$ is let out of the NOx occluding member 23 as mentioned above.

If an excess amount of the reducing agent that is not used to release NOx from the NOx occluding member 23 and reduce NOx is supplied when the air-fuel ratio of exhaust gas that flows into the NOx occluding member 23 is shifted to the fuel-rich side, the excess amount of the reducing agent is let out of the NOx occluding member 23 in the form of ammonia $NH_3$. The amount of ammonia $NH_3$ let out is proportional to the excess amount of the reducing agent. Therefore, the excess amount of the reducing agent can be determined from the amount of ammonia let out.

In the invention, therefore, the NOx ammonia sensor 29 capable of detecting the ammonia concentration is disposed in the exhaust passage downstream of the NOx occluding member 23. On the basis of changes in the ammonia concentration detected by the NOx ammonia sensor 29, the surplus amount of the reducing agent is determined. In this case, the integrated value of ammonia concentration is considered to represent the surplus amount of the reducing agent. Therefore, the integrated ammonia concentration value can be said to be a representative value that indicates the surplus amount of the reducing agent. Furthermore, a maximum value of ammonia concentration may also be considered to represent the surplus amount of the reducing agent. Therefore, the maximum value of ammonia concentration can be said to be a representative value that indicates the surplus amount of the reducing agent. In the invention, the surplus amount of the reducing agent is determined from changes in the ammonia concentration as mentioned above. More specifically, a representative value that indicates the surplus amount of the reducing agent as mentioned above is determined based on changes in the ammonia concentration. This is a fundamental idea of the invention.

With such a representative value determined, it becomes possible to perform various controls. First, a basic control of supplying the reducing agent will be described with reference to FIG. 6.

Figure 6:
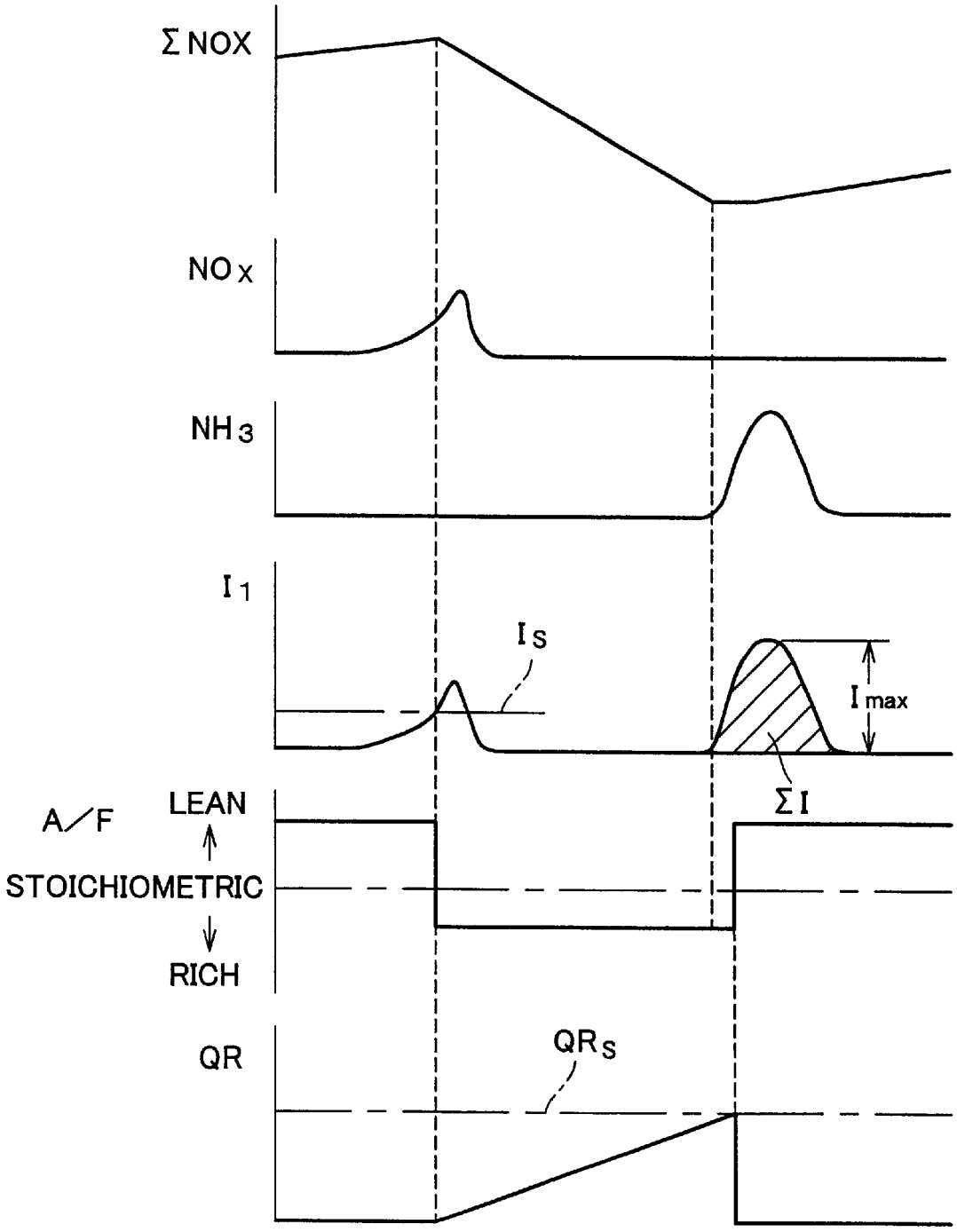
FIG. 6 is a time chart indicating the current detected by the NOx ammonia sensor and the like, in the first embodiment.

Referring to FIG. 6, ΣNOX indicates the amount of NOx occluded in the NOx occluding member 23, and $I_1$ indicates the electric current detected by the NOx ammonia sensor 29. In FIG. 6, NOx and $NH_3$ indicate changes in the NOx ammonia sensor 29-detected current caused by changes in the NOx concentration in exhaust gas and changes in the $NH_3$ concentration in exhaust gas, respectively. These detected currents both appear in the detected current $I_1$ of the NOx ammonia sensor 29. Furthermore, A/F indicates the average air-fuel ratio of mixture in the combustion chamber 5, and QR indicates the total amount of the reducing agent supplied.

As indicated in FIG. 6, as the amount ΣNOX of NOx occluded in the NOx occluding member 23 increases and approaches a limit of the occluding capability of the NOx occluding member 23, the NOx occluding member 23 starts to let out NOx, so that the detected current $I_1$ of the NOx ammonia sensor 29 starts to rise. In the embodiment indicated in FIG. 6, when the NOx concentration exceeds a predetermined set value after the NOx occluding member 23 starts to let out the NOx, that is, when the detected current $I_1$ of the NOx ammonia sensor 29 exceeds a predetermined set value Is, the air-fuel ratio A/F is changed from the fuel-lean side to the fuel-rich side so as to release NOx from the NOx occluding member 23. After the change of the air-fuel ratio from the lean side to the rich side, a time is needed before a fuel-rich air-fuel ratio exhaust gas reaches the NOx occluding member 23. Therefore, the amount of NOx discharged from the NOx occluding member 23 continues to increase immediately after the change of the air-fuel ratio A/F to the rich side. Then, the reducing agent present in the fuel-rich air-fuel ratio exhaust gas starts to reduce NOx, so that the discharge of NOx from the NOx occluding member 23 discontinues. Therefore, following the change of the air-fuel ratio from the lean side to the rich side, the detected current of the NOx ammonia sensor 29 rises for a short time, and then drops to zero.

The total amount QR of the reducing agent supplied to the NOx occluding member 23 gradually increases after the change of the air-fuel ratio from the lean side to the rich side. Correspondingly, the amount ΣNOX of NOx occluded in the NOx occluding member 23 gradually decreases. In the embodiment indicated in FIG. 6, the air-fuel ratio is changed from the fuel-rich side to the fuel-lean side when the total amount QR of the reducing agent reaches a target value QRs. In the case indicated in FIG. 6, the air-fuel ratio is changed from the rich side to the lean side after amount ΣNOX of NOx occluded in the NOx occluding member 23 has reached zero.

In this case, a surplus amount of the reducing agent that is not used to release NOx from the NOx occluding member 23 and reduce NOx is supplied. Therefore, ammonia $NH_3$ is discharged from the NOx occluding member 23, so that the detected current $I_1$ of the NOx ammonia sensor 29 rises as indicated in FIG. 6. The surplus amount of the reducing agent is indicated by An integrated value ΣI of the detected current $I_1$ indicated by hatching in FIG. 6 and the maximum value Imax of the first layer $L_1$ in this case. In this embodiment, therefore, the amount of the reducing agent to be supplied at the next time of release of NOx is reduced by the surplus amount of the reducing agent calculated based on the integrated value ΣI or the maximum value Imax. Hence, at the next time of release of NOx, an amount of the reducing agent needed to release and reduce NOx occluded in the NOx occluding member 23 will be supplied.

If the amount of SOx occluded in the NOx occluding member 23 increases, the NOx occluding capability of the NOx occluding member 23 decreases. Therefore, if in this situation, the air-fuel ratio is changed from the lean side to the rich side, ammonia is discharged from the NOx occluding member 23. In this case, the amount of the reducing agent to be supplied at the next time of releasing NOx is reduced by the surplus amount of the reducing agent calculated based on the integrated value ΣI or the maximum value Imax of detected current $I_1$. Thus, in this embodiment, at the time of completion of release of NOx from the NOx occluding member 23, the air-fuel ratio can be changed from the fuel-rich side to the fuel-lean side to stop supplying the reducing agent to the NOx occluding member 23.

The target value QRs of the amount of the reducing agent to be supplied indicates the amount of NOx that the NOx occluding member 23 can occlude. In this embodiment, therefore, SOx is discharged from the NOx occluding member 23 when the target value QRs becomes smaller than a predetermined set value SS.

Figure 7:
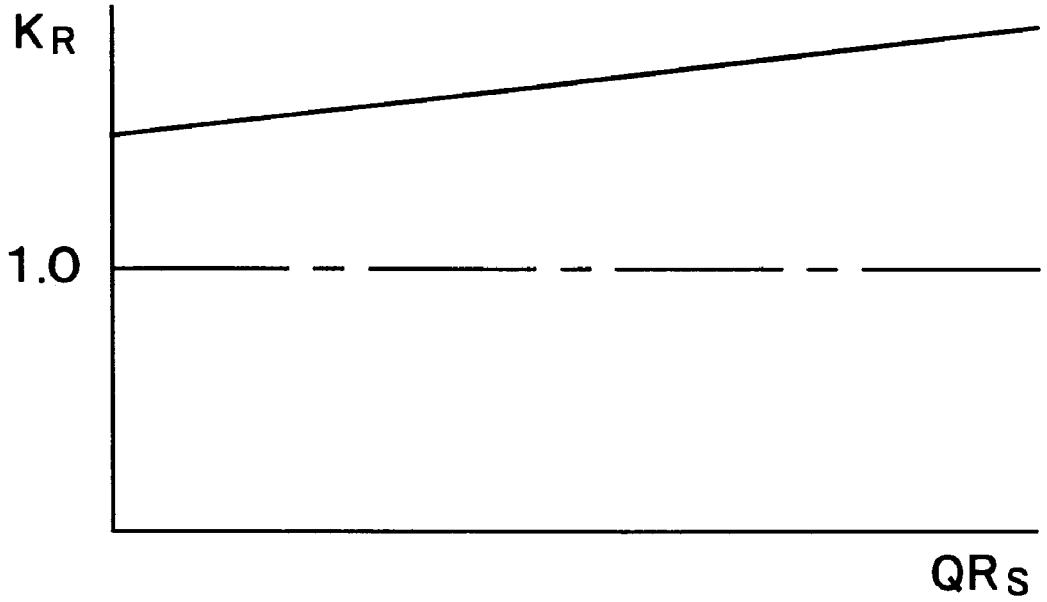
FIG. 7 is a diagram indicating a correction factor for shifting the air-fuel ratio to the fuel-rich side.

Furthermore, as the NOx occluding member 23 deteriorates due to aging, the target value QRs also decreases. Therefore, from the target value QRs, the degree of deterioration of the NOx occluding member 23 can be determined. While the NOx occluding member 23 has not deteriorated, NOx diffuses deep inside the NOx occluding member 23, so that nitrate salts are formed deep inside the NOx occluding member 23. In this case, in order to release NOx from the NOx occluding member 23, it is preferable to increase the degree of fuel-richness of the air-fuel ratio, that is, the value of the correction factor $K_R$. In contrast, as the NOx occluding member 23 deteriorates, the depth of diffusion of NOx in the form of nitrate ions into the NOx occluding member 23 decreases. Therefore, NOx can be released from the NOx occluding member 23 without a need to increase the richness of the air-fuel ratio, that is, the value of the correction factor $K_R$. In this embodiment of the invention, therefore, the value of the correction factor $K_R$ at the time of changing the air-fuel ratio to the rich side is made higher as the target value QRs is higher as indicated in FIG. 7.

Figure 8:
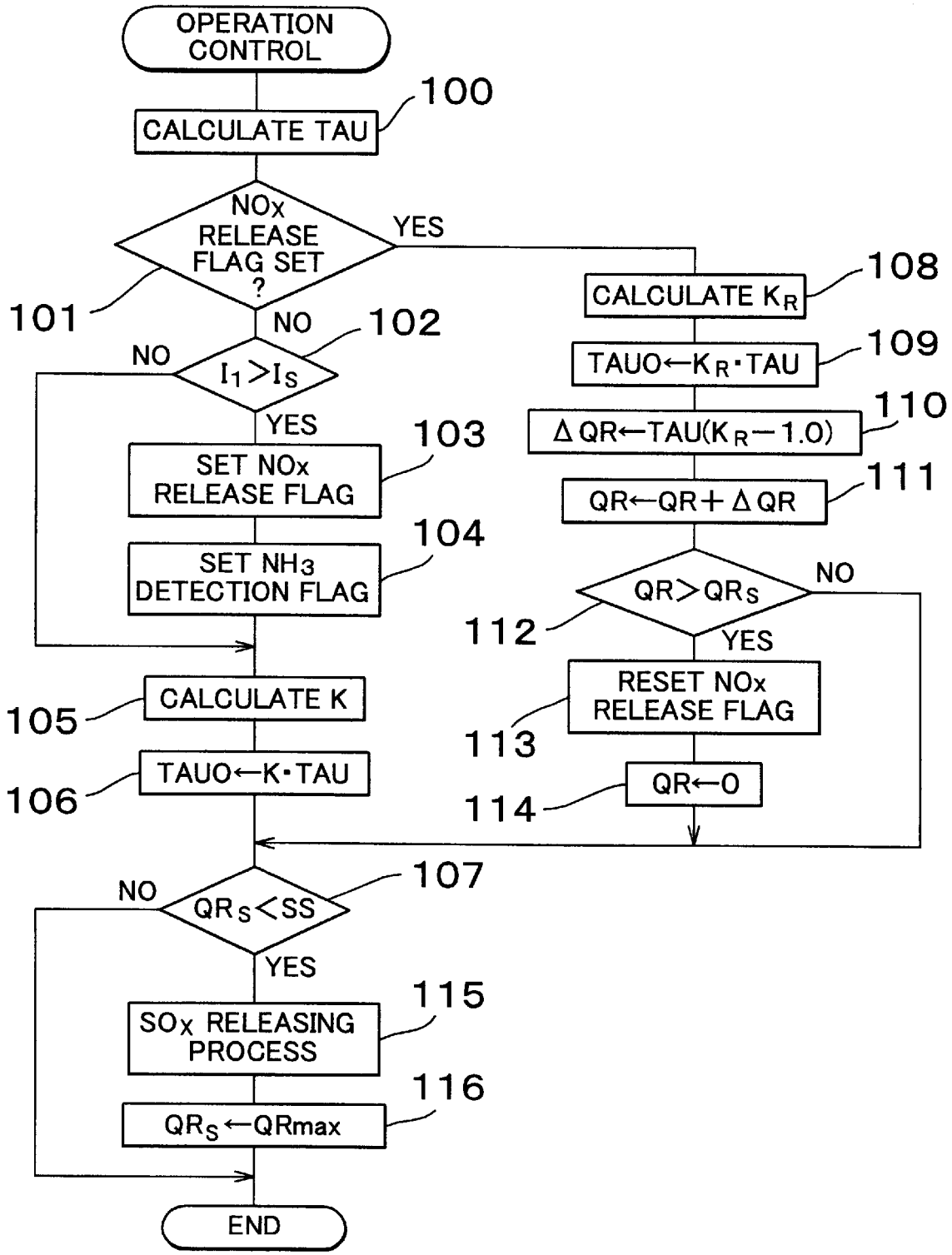
FIG. 8 is a flowchart illustrating a process for controlling the operation of the engine in accordance with the first embodiment.

FIG. 8 illustrates a routine for carrying out the first embodiment described with reference to FIG. 6.

Referring to FIG. 8, a basic amount TAU of injected fuel is determined from the map indicated in FIG. 4(B) in step 100. Subsequently in step 101, it is determined whether a NOx release flag for indicating that NOx should be released from the NOx occluding member 23 has been set. If the NOx release flag has not been set, the process proceeds to step 102, in which it is determined whether the detected current $I_1$ of the NOx ammonia sensor 29 has exceeded the set value Is. If $I_1 \leqq Is$, that is, if the NOx occluding capability of the NOx occluding member 23 still has a margin, the process jumps to step 105.

In step 105, a correction factor K is determined from the map indicated in FIG. 4C. Subsequently in step 106, a final amount TAUO of injected fuel (=K·TAU) is calculated by multiplying the basic amount TAU of injected fuel by the correction factor K. Then, fuel injection is performed based on the final amount TAUO of injected fuel. Subsequently in step 107, it is determined whether the target value QRs of the amount of the reducing agent has become smaller than the set value SS for SOx release. If QRs≧SS, the processing cycle is ended.

Conversely, if it is determined in step 102 that $I_1$>Is holds, that is, if the NOx occluding member 23 starts to let out NOx, the process proceeds to step 103, in which the NOx release flag is set. Subsequently in step 104, an $NH_3$ detection flag is set. Then, the process proceeds to step 105.

In the processing cycle following the setting of the NOx release flag, the process goes from step 101 to step 108, in which a correction factor $K_R$ is calculated based on the relationship indicated in FIG. 7. Subsequently in step 109, a final amount TAUO of injected fuel (=KR·TAU) is calculated by multiplying the basic amount TAU of injected fuel by the correction factor $K_R$. Then, fuel injection is performed based on the final amount TAUO of injected fuel. At this moment, the combustion mode is changed from the stratified charge combustion under a fuel-lean air-fuel ratio condition or the uniform mixture combustion under a fuel-lean air-fuel ratio condition to the uniform mixture combustion under a fuel-rich air-fuel ratio condition. As a result, release of NOx from the NOx occluding member 23 starts.

Subsequently in step 110, an amount ΔQR of the reducing agent supplied to the NOx occluding member 23 per fuel injecting action is calculated as in the following equation:

$$\Delta QR = TAU \cdot (K_R - 1.0)$$

Subsequently in step 111, the total amount QR of the reducing agent supplied to the NOx occluding member 23 is determined by adding the amount ΔQR of the reducing agent to the present total amount QR. Subsequently in step 112, it is determined whether the total amount QR of the reducing agent has exceeded a target value QRs. If QR≦QRs, process jumps to step 107. Conversely, if QR>QRs, the process proceeds to step 113, in which the NOx release flag is reset. Subsequently in step 114, the total amount QR of the reducing agent is cleared. Then, the process proceeds to step 107.

If the NOx release flag is reset, the air-fuel ratio is changed from the fuel-rich side to the fuel-lean side.

If it is determined in step 107 that QRs<SS holds, the process proceeds to step 115, in which a process of releasing SOx from the NOx occluding member 23 is executed. Specifically, the air-fuel ratio is shifted to the fuel-rich side while the temperature of the NOx occluding member 23 is kept approximately at or above 600° C. After the operation of releasing SOx from the NOx occluding member 23 is completed, the process proceeds to step 116, in which a predetermined maximum total amount QRmax of the reducing agent is set as a target value QRs.

Figure 9:
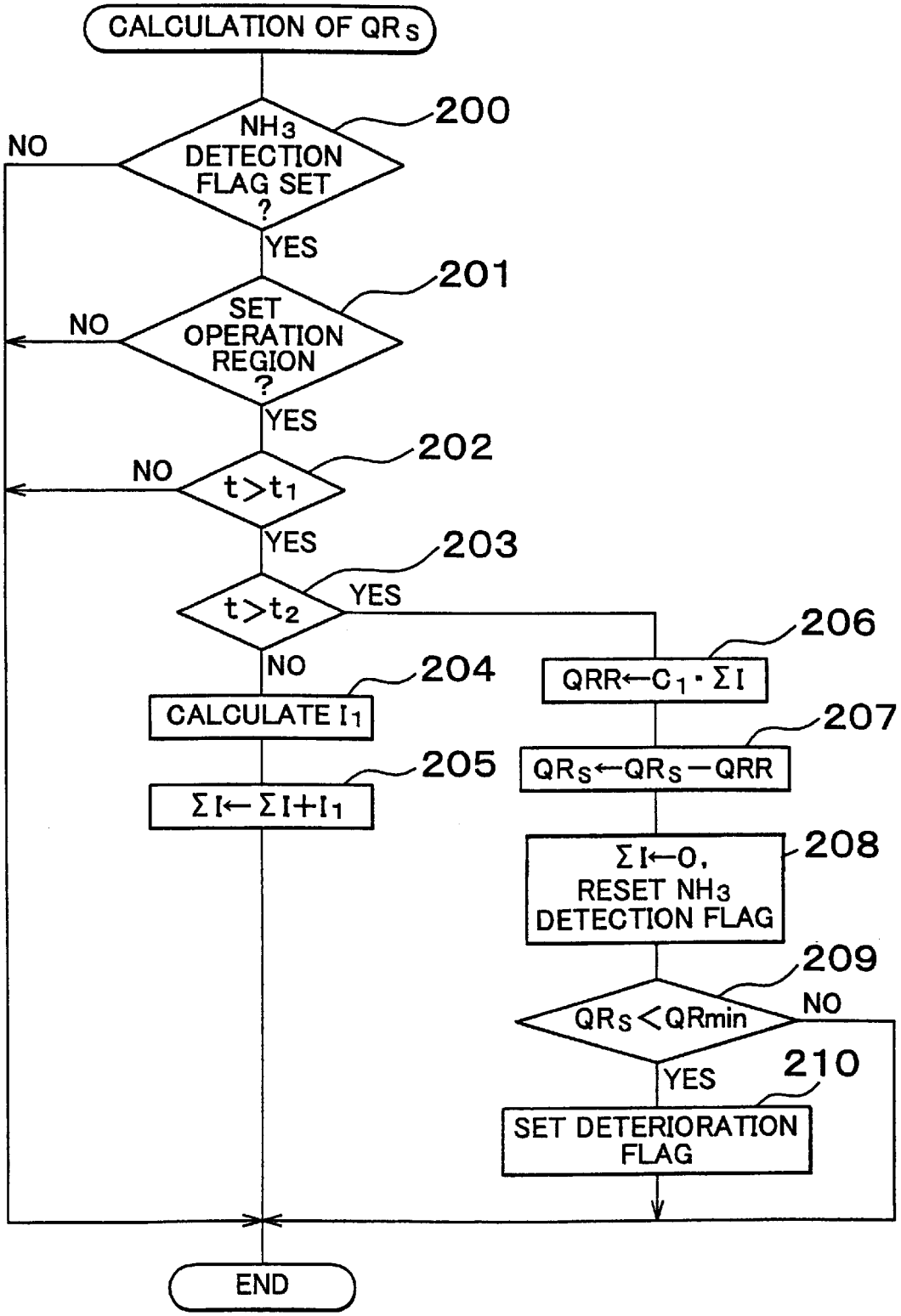
FIG. 9 is a flowchart illustrating a process for calculating a target value QRs.

FIG. 9 illustrates a routine for calculating a target value QRs.

Referring to FIG. 9, it is determined in step 200 whether the $NH_3$ detection flag has been set. The $NH_3$ detection flag is set when it is determined that $I_1$>Is in step 102 in FIG. 8. If the $NH_3$ detection flag has been set, the process proceeds to step 201, in which it is determined whether the operation region of the engine is a predetermined set operation region. The set operation region is a narrow operation region determined by the engine load Q/N and the engine revolution speed N. If the operation region of the engine is within the set operation region, the process proceeds to step 202.

In step 202, it is determined whether the elapsed time t following the setting of the $NH_3$ detection flag has exceeded a constant time $t_1$. The constant time $t_1$ is a time that elapses from the change of the air-fuel ratio from the fuel-lean side to the fuel-rich side until the detected current $I_1$ of the NOx ammonia sensor 29 decreases to zero. If $t>t_1$ holds, the process proceeds to step 203, in which it is determined whether the elapsed time t following the setting of the $NH_3$ detection flag has exceeded a constant time $t_2$. The constant time $t_2$ sufficiently allows the NOx ammonia sensor 29 to detect an ammonia concentration when ammonia is discharged from the NOx occluding member 23 regardless of the amount of ammonia discharged. If $t \leqq t_2$, the process proceeds to step 204.

In step 204, the detected current $I_1$ of the NOx ammonia sensor 29 is calculated. Subsequently in step 205, an integrated value ΣI of detected current is calculated by adding the detected current $I_1$ to the existing ΣI. If it is determined in step 203 that $t>t_2$ comes to hold, the process proceeds to step 206, in which the multiplication product of the integrated value ΣI of detected current and a proportional constant $C_1$ is set as a surplus amount QRR of the reducing agent ($=C_1 \cdot \Sigma I$). Subsequently in step 207, the target value QRs is updated by subtracting the surplus amount QRR of the reducing agent from the present target value QRs.

Subsequently in step 208, ΣI is cleared, and the $NH_3$ detection flag is simultaneously reset. Subsequently in step 209, it is determined whether the updated target value QRs is less than a predetermined limit value QRmin. If QRs<QRmin, the process proceeds to step 210, in which a deterioration flag is set to indicate that the NOx occluding member 23 has deteriorated. If the deterioration flag is set, an alarm lamp is turned on, as for example.

Figure 10:
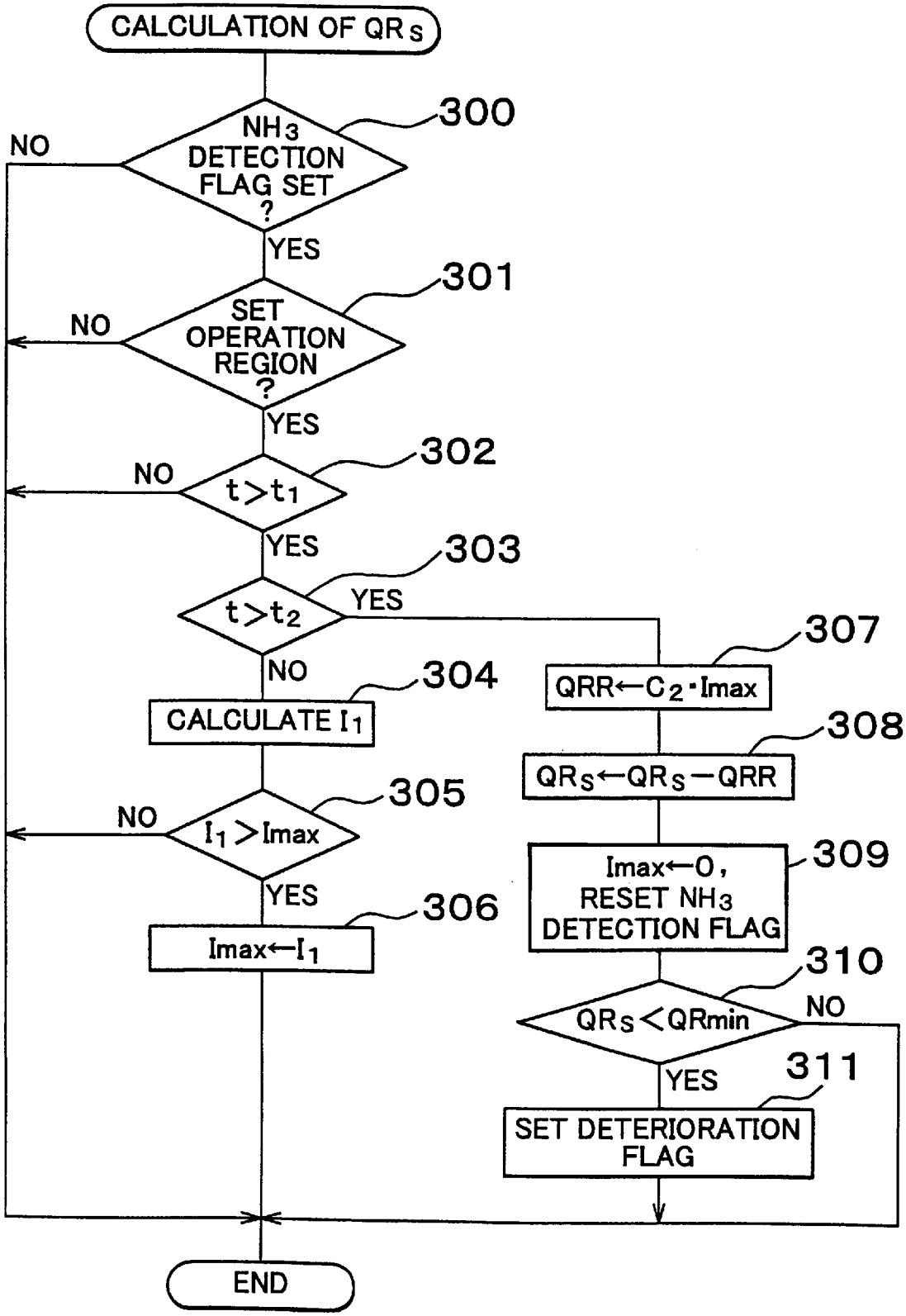
FIG. 10 is a flowchart illustrating a process for calculating a target value QRs which is different from the process illustrated in FIG. 9.

FIG. 10 illustrates another embodiment of the routine for calculating the target value QRs.

Referring to FIG. 10, it is determined in step 300 whether the $NH_3$ detection flag has been set. The $NH_3$ detection flag is set when it is determined that $I_1$>Is holds in step 102 in FIG. 8. If the $NH_3$ detection flag has been set, the process proceeds to step 301, in which it is determined whether the operation region of the engine is a predetermined set operation region. The set operation region is a narrow operation region determined by the engine load Q/N and the engine revolution speed N. If the operation region of the engine is within the set operation region, the process proceeds to step 302.

In step 302, it is determined whether the elapsed time t following the setting of the $NH_3$ detection flag has exceeded a constant time $t_1$. The constant time $t_1$, as mentioned above, is a time that elapses from the change of the air-fuel ratio from the fuel-lean side to the fuel-rich side until the detected current $I_1$ of the NOx ammonia sensor 29 decreases to zero. If $t>t_1$, the process proceeds to step 303, in which it is determined whether the elapsed time t following the setting of the $NH_3$ detection flag has exceeded a constant time $t_2$. The constant time $t_2$, as mentioned above, sufficiently allows the NOx ammonia sensor 29 to detect an ammonia concentration when ammonia is discharged from the NOx occluding member 23 regardless of the amount of ammonia discharged. If $t \leqq t_2$, the process proceeds to step 304.

In step 304, the detected current $I_1$ of the NOx ammonia sensor 29 is calculated. Subsequently in step 305, it is determined whether the detected current $I_1$ is greater than Imax. If $I_1$>Imax, the process proceeds to step 306, in which the detected current $I_1$ is set as a maximum value Imax of detected current. If it is determined in step 303 that $t>t_2$ has come to hold, the process proceeds to step 307, in which a multiplication product of the maximum value Imax of detected current and a proportional constant $C_2$ is set as a surplus amount QRR of the reducing agent ($=C_2 \cdot$Imax). Subsequently in step 308, the target value QRs is updated by subtracting the surplus amount QRR of the reducing agent from the present target value QRs.

Subsequently in step 309, Imax is cleared, and the $NH_3$ detection flag is simultaneously reset. Subsequently in step 310, it is determined whether the updated target value QRs is less than a predetermined limit value QRmin. If QRs<QRmin, the process proceeds to step 311, in which a deterioration flag is set to indicate that the NOx occluding member 23 has deteriorated. If the deterioration flag is set, an alarm lamp is turned on, as for example.

Next, a second embodiment of the invention will be described with reference to FIGS. 11A to 11C.

In this embodiment, a reference value regarding a representative value that indicates the surplus amount of the reducing agent is pre-set as indicated in FIG. 11A. Specifically, in a first example, a reference value Sr is pre-set regarding the integrated value ΣI of detected current of the NOx ammonia sensor 29. If the representative value, that is, the integrated value ΣI of detected current, is greater than the reference value Sr as indicated in FIG. 11B, the total amount of the reducing agent supplied to the NOx occluding member 23 when the air-fuel ratio is shifted to the fuel-rich side is reduced. If the representative value, that is, the integrated value ΣI of detected current, is less than the reference value Sr as indicated in FIG. 11C, the total amount of the reducing agent supplied to the NOx occluding member 23 when the air-fuel ratio is shifted to the fuel-rich side is increased. That is, the amount of the reducing agent supplied is controlled so that the integrated value ΣI of detected current becomes equal to the reference value Sr.

In a second example, a reference value Imax is pre-set regarding the maximum value Imax of detected current of the NOx ammonia sensor 29. If the representative value, that is, the maximum value Imax of detected current, is greater than the reference value Imax as indicated in FIG. 11B, the total amount of the reducing agent supplied to the NOx occluding member 23 when the air-fuel ratio is shifted to the fuel-rich side is reduced. If the representative value, that is, the maximum value Imax of detected current, is less than the reference value Imax as indicated in FIG. 11C, the total amount of the reducing agent supplied to the NOx occluding member 23 when the air-fuel ratio is shifted to the fuel-rich side is increased. That is, the amount of the reducing agent supplied is controlled so that the maximum value Imax of detected current becomes equal to the reference value Imax.

The second embodiment has an advantage of being capable of increasing the amount of the reducing agent supplied if the amount is excessively reduced, unlike the first embodiment.

Figure 12:
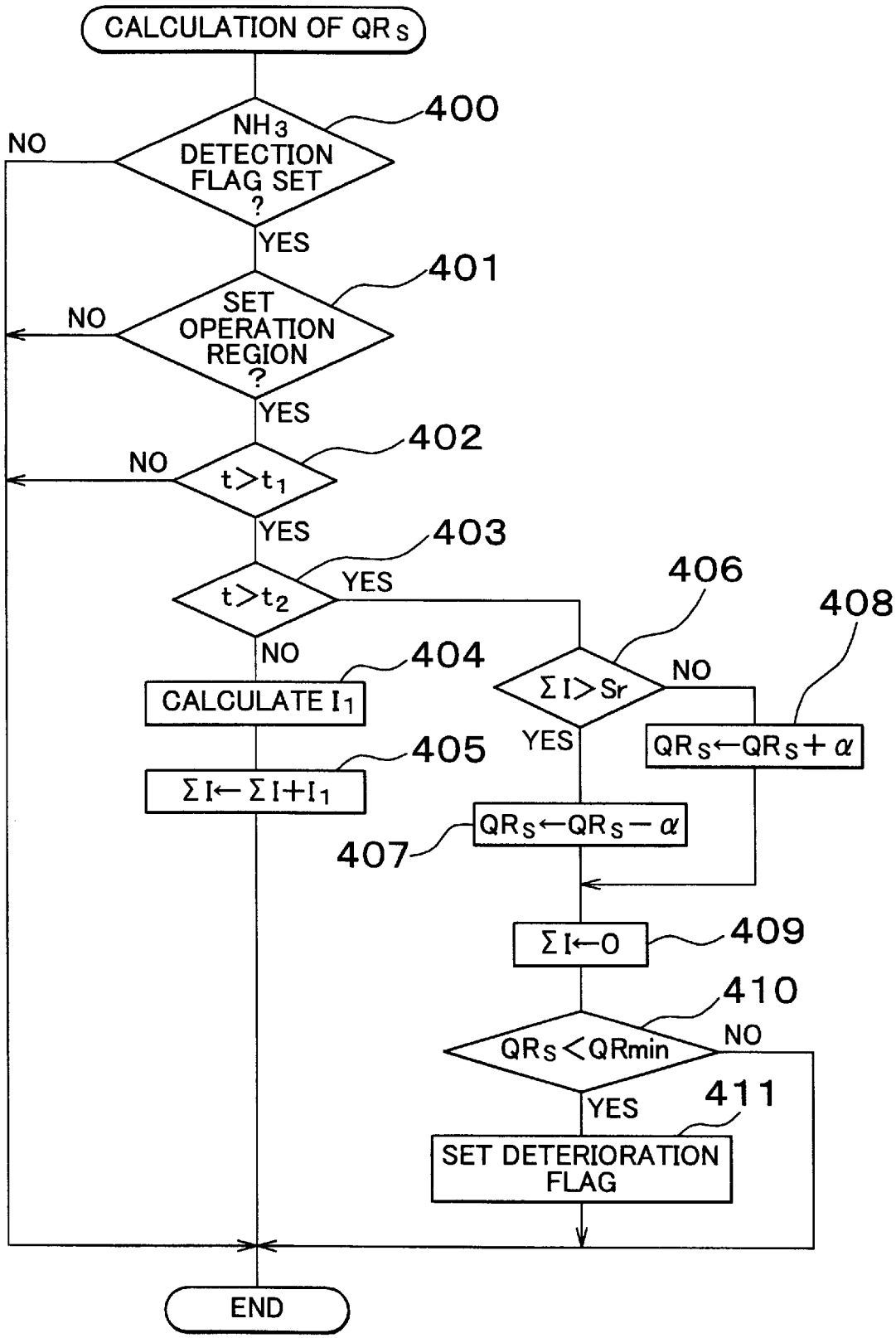
FIG. 12 is a flowchart illustrating a process for calculating a target value QRs.

FIG. 12 illustrates a target value QRs calculating routine for carrying out the first example of the second embodiment. In the second embodiment, too, the operation control routine illustrated in FIG. 8 is adopted as an operation control routine.

Referring to FIG. 12, it is determined in step 400 whether the $NH_3$ detection flag has been set. The $NH_3$ detection flag is set when it is determined that $I_1$>Is holds in step 102 in FIG. 8. If the $NH_3$ detection flag has been set, the process proceeds to step 401, in which it is determined whether the operation region of the engine is a predetermined set operation region. The set operation region is a narrow operation region determined by the engine load Q/N and the engine revolution speed N. If the operation region of the engine is within the set operation region, the process proceeds to step 402.

In step 402, it is determined whether the elapsed time t following the setting of the $NH_3$ detection flag has exceeded a constant time $t_1$. The constant time $t_1$, as mentioned above, is a time that elapses from the change of the air-fuel ratio from the fuel-lean side to the fuel-rich side until the detected current $I_1$ of the NOx ammonia sensor 29 decreases to zero. If $t>t_1$, the process proceeds to step 403, in which it is determined whether the elapsed time t following the setting of the $NH_3$ detection flag has exceeded a constant time $t_2$. The constant time $t_2$, as mentioned above, sufficiently allows the NOx ammonia sensor 29 to detect an ammonia concentration when ammonia is discharged from the NOx occluding member 23 regardless of the amount of ammonia discharged. If $t \leqq t_2$, the process proceeds to step 404.

In step 404, the detected current $I_1$ of the NOx ammonia sensor 29 is calculated. Subsequently in step 405, an integrated value ΣI of detected current is calculated by adding the detected current $I_1$ to the existing ΣI. If it is determined in step 403 that $t>t_2$ has come to hold, the process proceeds to step 406, in which it is determined whether the integrated value ΣI of detected current is greater than the reference value Sr. If ΣI>Sr, the process proceeds to step 407, in which the target value QRs is reduced by a predetermined set value α. After that, the process proceeds to step 409. Conversely, if ΣI≦Sr, the process proceeds to step 408, in which the target value QRs is increased by the predetermined set value α. After that, the process proceeds to step 409.

In step 409, ΣI is cleared, and the $NH_3$ detection flag is simultaneously reset. Subsequently in step 410, it is determined whether the updated target value QRs is less than a predetermined limit value QRmin. If QRs<QRmin, the process proceeds to step 411, in which a deterioration flag is set to indicate that the NOx occluding member 23 has deteriorated. If the deterioration flag is set, an alarm lamp is turned on, as for example.

Figure 13:
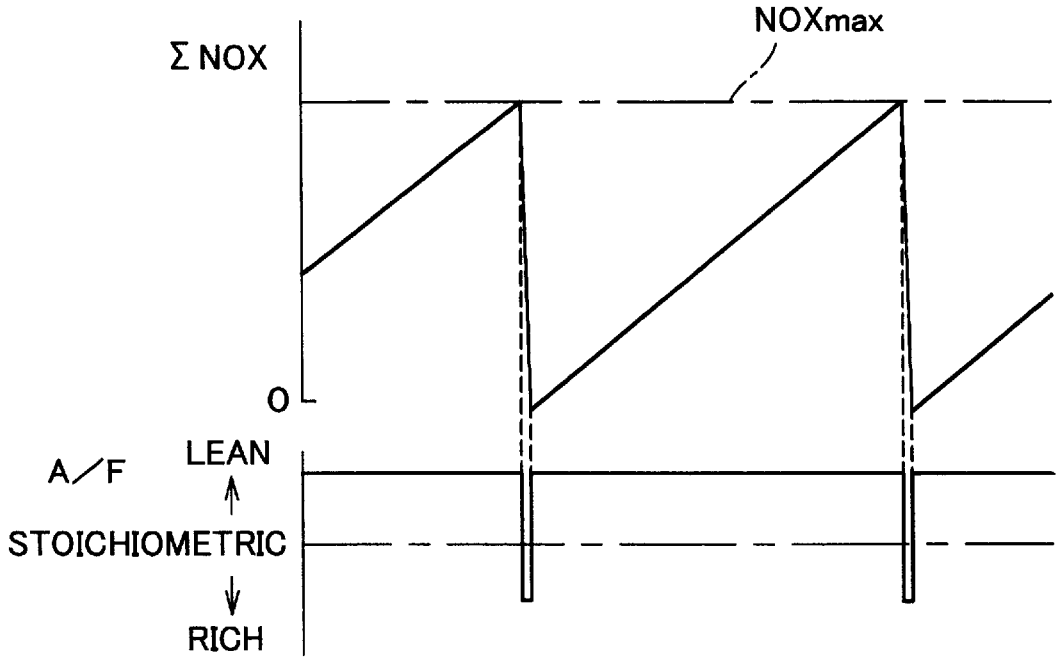
FIG. 13 is a time chart indicating changes in the amount of occluded NOx and the air-fuel ratio in accordance with the third embodiments of the invention.

A third embodiment of the invention will be described with reference to FIGS. 13 to 15.

In this embodiment, the amount of NOx occluded into the NOx occluding member 23 is estimated, and a fuel-rich time interval between a fuel-rich shift of the air-fuel ratio of exhaust gas flowing into the NOx occluding member 23 and the next fuel-rich shift of the air-fuel ratio is controlled based on the estimated amount of NOx occluded. Furthermore, the fuel-rich time interval is corrected based on the detected current $I_1$, and the fuel-rich time is controlled based on a representative value such as the integrated value ΣI of detected current, the maximum value Imax of detected current, or the like.

Specifically, the third embodiment includes an amount-of-occluded-NOx estimating device that estimates the amount of NOx occluded in the NOx occluding member 23. When the amount ΣNOX of occluded NOx estimated by the amount-of occluded-NOx estimating device exceeds an allowable value NOXmax as indicated in FIG. 13, the air-fuel ratio is temporarily changed from the fuel-lean side to the fuel-rich side.

The amount of NOx discharged from the engine is substantially determined if the state of operation of the engine is determined. Therefore, the amount of NOx occluded in the NOx occluding member 23 is substantially determined if the state of operation of the engine is determined. Therefore, in the third embodiment, the amounts NA of NOx occluded into the NOx occluding member 23 per unit time in accordance with the states of operation of the engine are empirically determined beforehand. The amount NA of occluded NOx is pre-stored in the ROM 33 as a function of the engine load Q/N and the engine revolution speed N in the form of a map as indicated in FIG. 14.

Figure 14:
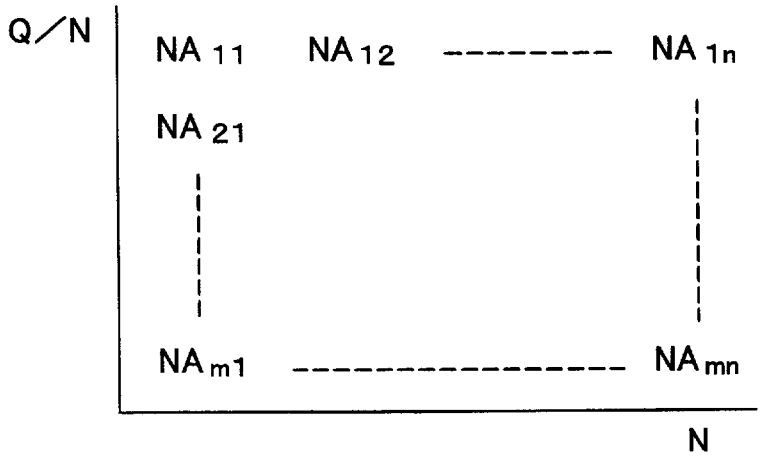
FIG. 14 is a diagram indicating a map regarding the amount of occluded NOx.

In this embodiment, amounts NA of occluded NOx corresponding to states of operation of the engine as indicated in FIG. 14 are integrated during operation of the engine, thereby calculating an estimated amount ΣNOX of NOx that is considered to be occluded in the NOx occluding member 23. It should be noted herein that the value of NA becomes negative in an operation region where the air-fuel ratio equals the stoichiometric air-fuel ratio or is on the fuel-rich side thereof, because in such an operation region, NOx is released from the NOx occluding member 23.

The aforementioned allowable value NOXmax is reduced with increases in the amount SOx occluded in the NOx occluding member 23, that is, with decreases in the occluding capability of the NOx occluding member 23. The injected fuel contains sulfur at a certain proportion that is substantially determined in accordance with individual fuels. Therefore, the amount of SOx occluded in the NOx occluding member 23 is proportional to the integrated value ΣTAU of basic amounts of injected fuel TAU. Therefore, in the third embodiment, the allowable value NOXmax is gradually decreased with increases in the integrated value ΣTAU of the amount of injected fuel as indicated in FIG. 15.

Basically in the third embodiment, the air-fuel ratio is temporarily changed from the fuel-lean side to the fuel-rich side when the amount ΣNOX of occluded NOx exceeds the allowable value NOXmax as stated above. In this case, the allowable value NOXmax is gradually decreased as indicated in FIG. 15 during operation of the engine. Therefore, it can be understood that the fuel-rich time interval gradually decreases if a substantially constant operation state continues. In the third embodiment, the allowable value NOXmax is set to a value that is less than the amount of occluded NOx occurring when the NOx occluding member 23 starts to let out NOx during a fuel-lean operation. Therefore, in the third embodiment, the air-fuel ratio is changed from the fuel-lean side to the fuel-rich side before the NOx occluding member 23 starts to let out NOx during the fuel-lean operation.

However, if the calculated amount ΣNOX of occluded NOx deviates from the actual amount of occluded NOx, the NOx occluding member 23 may start to let out NOx despite ΣNOX<NOXmax. Therefore, in the third embodiment, if despite ΣNOX<NOXmax, the NOx occluding member 23 starts to let out NOx, that is, the detected current $I_1$ of the NOx ammonia sensor 29 exceeds the set value Is, then the air-fuel ratio is temporarily changed from the fuel-lean side to the fuel-rich side so as to reduce the allowable value NOXmax by a predetermined value B. That is, in the third embodiment, the allowable value NOXmax is corrected based on the detected current $I_1$.

Figure 16:
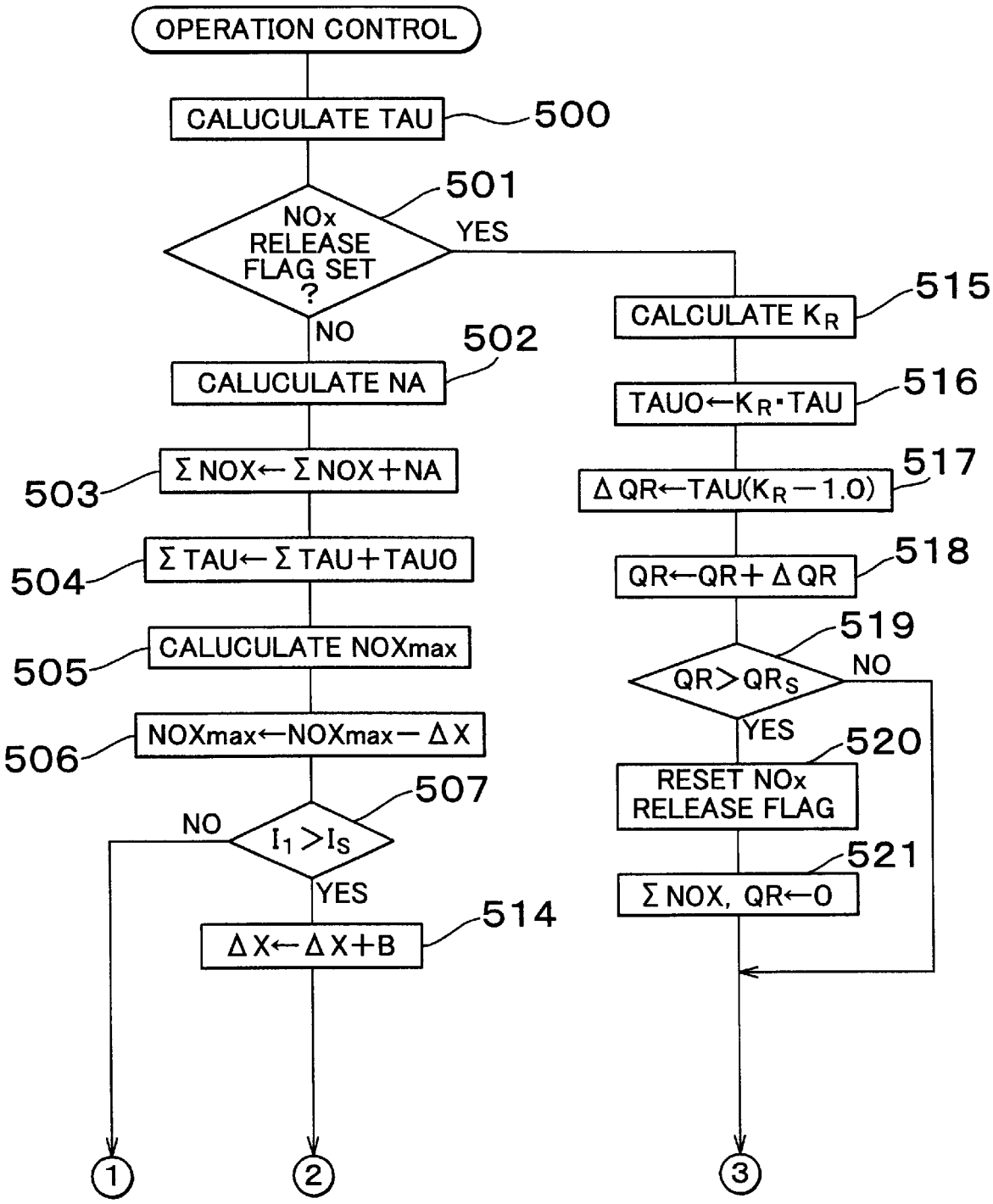
FIG. 16 is a flowchart illustrating a process for controlling the operation of the engine in accordance with the third embodiments of the invention.
Figure 17:
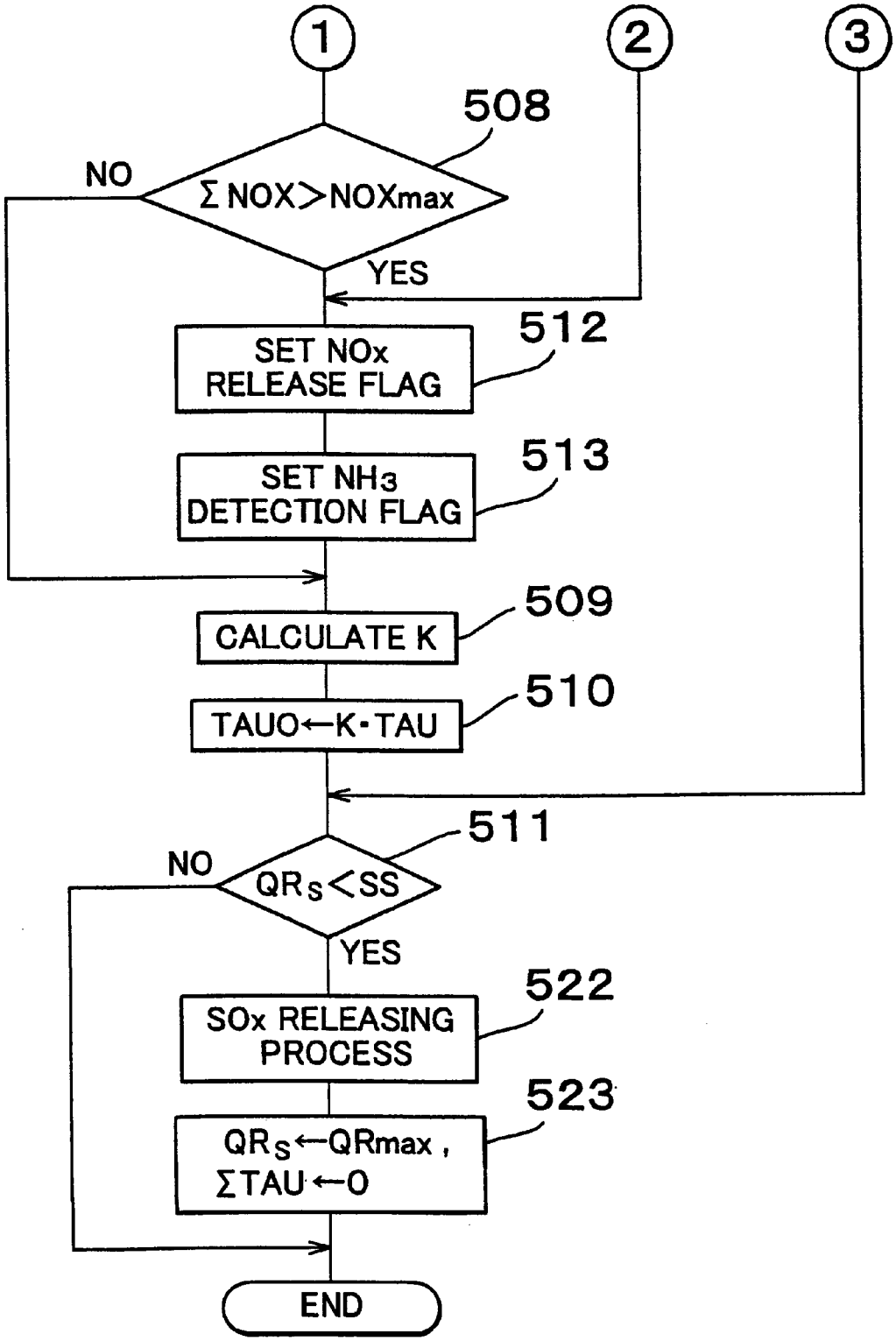
FIG. 17 is a flowchart illustrating a process for controlling the operation of the engine which continues from FIG. 16.

FIGS. 16 and 17 illustrate a routine for carrying out the third embodiment.

Referring to FIGS. 16 and 17, first in step 500, an amount TAU of injected fuel is calculated from the map indicated in FIG. 4B. Subsequently in step 501, it is determined whether a NOx release flag for indicating that NOx should be released from the NOx occluding member 23 has been set. If the NOx release flag has not been set, the process proceeds to step 502, in which an amount NA of NOx occluded per unit time is calculated from the map indicated in FIG. 14. Subsequently in step 503, an estimated amount ΣNOX of NOx that is considered to be occluded in the NOx occluding member 23 is calculated by adding the amount NA of occluded NOx to the existing value of ΣNOX.

Subsequently in step 504, an integrated value ΣTAU of injected fuel is calculated by adding a final amount TAUO of injected fuel to the existing value of ΣTAU. Subsequently in step 505, an allowable value NOXmax is calculated from the integrated value ΣTAU based on the relationship indicated in FIG. 15. Subsequently in step 506, the allowable value NOXmax is reduced by a correction amount ΔX. Subsequently in step 507, it is determined whether the detected current $I_1$ of the NOx ammonia sensor 29 has exceeded the set value Is. If $I_1 \leqq Is$, the process proceeds to step 508, in which it is determined whether the amount ΣNOX of occluded NOx has exceeded the allowable value NOXmax. If ΣNOX≦NOXmax, that is, if the NOx occluding capability of the NOx occluding member 23 still has a margin, the process jumps to step 509.

In step 509, a correction factor K is calculated from the map indicated in FIG. 4C. Subsequently in step 510, a final amount TAUO of injected fuel (=K·TAU) is calculated by multiplying the basic amount TAU of injected fuel by the correction factor K. Then, fuel injection is performed based on the final amount TAUO of injected fuel. Subsequently in step 511, it is determined whether the target value QRs of the amount of the reducing agent has become smaller than the set value SS for SOx release. If QRs≧SS, the processing cycle is ended.

Conversely, if it is determined in step 508 that ΣNOX>NOXmax has come to hold, the process proceeds to step 512, in which the NOx release flag is set. Subsequently in step 513, in which the $NH_3$ detection flag is set. After that, the process proceeds to step 509. If it is determined in step 507 that $I_1$>Is has come to hold, that is, the NOx occluding member 23 starts to discharge NOx, before it is determined in step 508 whether ΣNOx>NOXmax holds, then the process proceeds to step 514, in which the a predetermined value B is added to the correction amount ΔX. Subsequently in step 512, the NOx release flag is set. In this case, therefore, the allowable value NOXmax is reduced by the set value B.

In the processing cycle following the setting of the NOx release flag, the process goes from step 501 to step 515, in which a correction factor $K_R$ is calculated based on the relationship indicated in FIG. 7. Subsequently in step 516, a final amount TAUO of injected fuel (=$K_R$·TAU) is calculated by multiplying the basic amount TAU of injected fuel by the correction factor $K_R$. Then, fuel injection is performed based on the final amount TAUO of injected fuel. At this moment, the combustion mode is changed from the stratified charge combustion under a fuel-lean air-fuel ratio condition or the uniform mixture combustion under a fuel-lean air-fuel ratio condition to the uniform mixture combustion under a fuel-rich air-fuel ratio condition. As a result, release of NOx from the NOx occluding member 23 starts.

Subsequently in step 517, an amount ΔQR of the reducing agent supplied to the NOx occluding member 23 per fuel injecting action is calculated as in the following equation:

$$\Delta QR = TAU \cdot (K_R - 1.0)$$

Subsequently in step 518, the total amount QR of the reducing agent supplied to the NOx occluding member 23 is determined by adding the amount ΔQR of the reducing agent to the present total amount QR. Subsequently in step 519, it is determined whether the total amount QR of the reducing agent has exceeded a target value QRs. If QR≦QRs, the process jumps to step 511. Conversely, if QR>QRs, the process proceeds to step 520, in which the NOx release flag is reset. Subsequently in step 521, the total amount QR of the reducing agent is cleared. Then, the process proceeds to step 511. If the NOx release flag is reset, the air-fuel ratio is changed from the fuel-rich side to the fuel-lean side.

If it is determined in step 511 that QRs<SS holds, the process proceeds to step 522, in which a process of releasing SOx from the NOx occluding member 23 is executed. Specifically, the air-fuel ratio is shifted to the fuel-rich side while the temperature of the NOx occluding member 23 is kept approximately at or above 600° C. After the operation of releasing SOx from the NOx occluding member 23 is completed, the process proceeds to step 523, in which a predetermined maximum total amount QRmax of the reducing agent is set as a target value QRs, and ΣTAU is set to zero.

In the third embodiment, the target value QRs is calculated by a routine as illustrated in FIG. 9, 10 or 12.

Next, a fourth embodiment of the invention will be described with reference to FIGS. 18 and 19. The fourth embodiment of the invention is applicable to an internal combustion engine as in the first to third embodiments. If in such an internal combustion engine, the air-fuel ratio is kept on the fuel-rich side even after completion of the release of NOx from the NOx occluding member 23, ammonia $NH_3$ is discharged from the NOx occluding member 23 because ammonia $NH_3$ is no longer consumed to reduce NOx.

Thus, if the air-fuel ratio of exhaust gas flowing into the NOx occluding member 23 is kept to be on the fuel-rich side even after completion of the release of NOx from the NOx occluding member 23 based on the fuel-rich air-fuel ratio of exhaust gas, ammonia is let out of the NOx occluding member 23. Therefore, by monitoring discharge of ammonia from the NOx occluding member 23, it is possible to determine whether the release of NOx from the NOx occluding member 23 has been completed.

In this embodiment, therefore, it is determined whether the release of NOx from the NOx occluding member 23 has been completed based on a change in the ammonia concentration detected by the NOx ammonia sensor 29.

Figure 18:
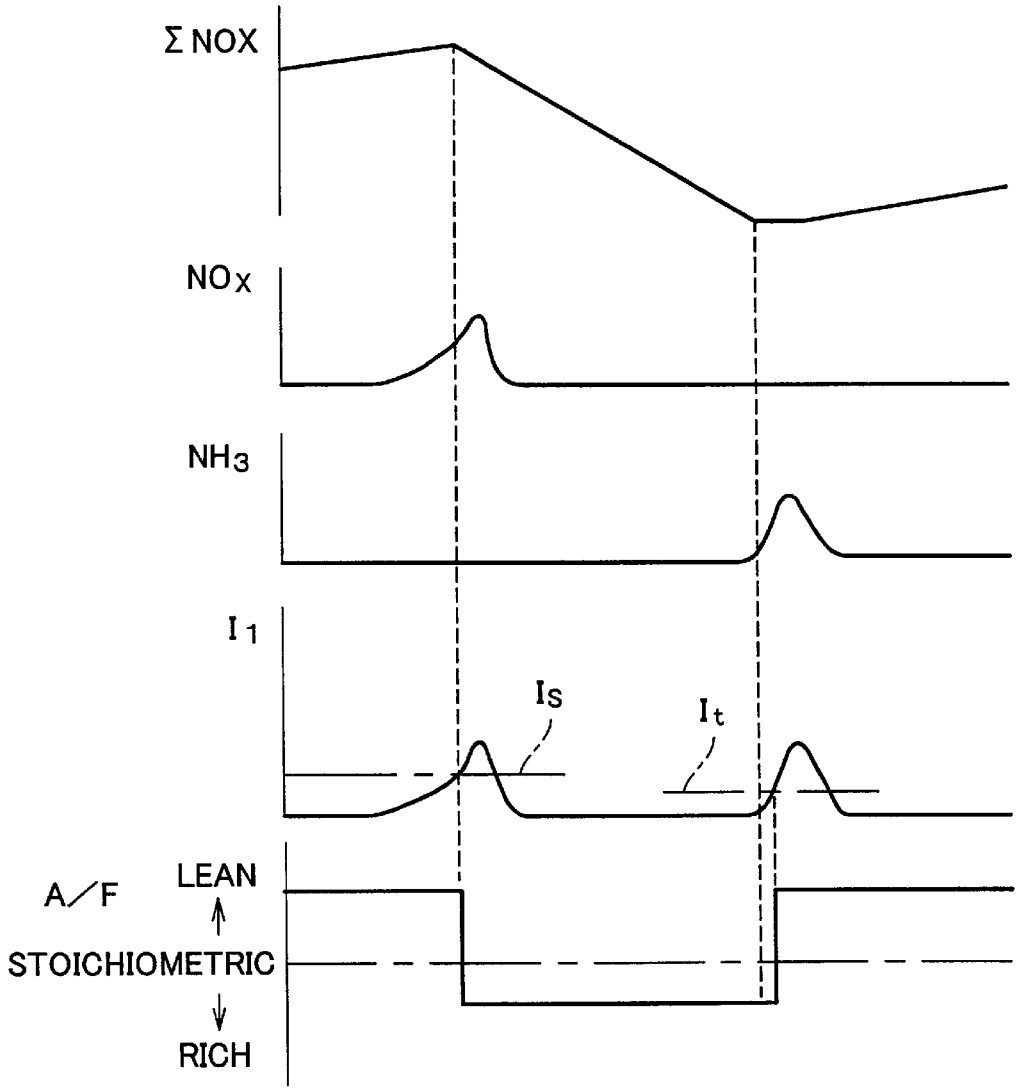
FIG. 18 is a time chart indicating electric currents detected by a NOx ammonia sensor 29 in a fourth embodiment of the invention.

Referring to FIG. 18, ΣNOX indicates the amount of NOx occluded in the NOx occluding member 23, and $I_1$ indicates the electric current detected by the NOx ammonia sensor 29. In FIG. 18, NOx and $NH_3$ indicate changes in the NOx ammonia sensor 29-detected current caused by changes in the NOx concentration in exhaust gas and changes in the $NH_3$ concentration in exhaust gas, respectively. These detected currents both appear in the detected current $I_1$ of the NOx ammonia sensor 29. Furthermore, A/F indicates the average air-fuel ratio of mixture in the combustion chamber 5.

As indicated in FIG. 18, as the amount ΣNOX of NOx occluded in the NOx occluding member 23 increases and approaches a limit of the occluding capability of the NOx occluding member 23, the NOx occluding member 23 starts to let out NOx, so that the detected current $I_1$ of the NOx ammonia sensor 29 starts to rise. In the embodiment indicated in FIG. 18, when the NOx concentration exceeds a predetermined set value after the NOx occluding member 23 starts to let out the NOx, that is, when the detected current $I_1$ of the NOx ammonia sensor 29 exceeds a predetermined set value Is, the air-fuel ratio A/F is changed from the fuel-lean side to the fuel-rich side so as to release NOx from the NOx occluding member 23. After the change of the air-fuel ratio from the lean side to the rich side, a time is needed before a fuel-rich air-fuel ratio exhaust gas reaches the NOx occluding member 23. Therefore, the amount of NOx discharged from the NOx occluding member 23 continues to increase immediately after the change of the air-fuel ratio A/F to the rich side. Then, the reducing agent present in the fuel-rich air-fuel ratio exhaust gas starts to reduce NOx, so that the discharge of NOx from the NOx occluding member 23 discontinues. Therefore, following the change of the air-fuel ratio from the fuel-lean side to the fuel-rich side, the detected current $I_1$ of the NOx ammonia sensor 29 rises for a short time, and then drops to zero.

The amount ΣNOX of the reducing agent occluded in the NOx occluding member 23 gradually decreases after the change of the air-fuel ratio from the lean side to the rich side. Then, when the amount ΣNOX of NOx substantially becomes zero, that is, when the release of NOx from the NOx occluding member 23 is completed, the NOx occluding member 23 starts to let out ammonia, so that the ammonia concentration in exhaust gas let of the NOx occluding member 23 starts to rise. In the invention, it is determined that the release of NOx from the NOx occluding member 23 has been completed when the ammonia concentration in exhaust gas starts to rise. At this moment, the air-fuel ratio of exhaust gas flowing into the NOx occluding member 23 is changed from the fuel-rich side to the fuel-lean side.

In the embodiment indicated in FIG. 18, when the ammonia concentration in exhaust gas starts to rise and the detected current $I_1$ of the NOx ammonia sensor 29 exceeds a set value It, it is determined that that the release of NOx from the NOx occluding member 23 has been completed. At this moment, the air-fuel ratio of exhaust gas flowing into the NOx occluding member 23 is changed from the fuel-rich side to the fuel-lean side.

Figure 19:
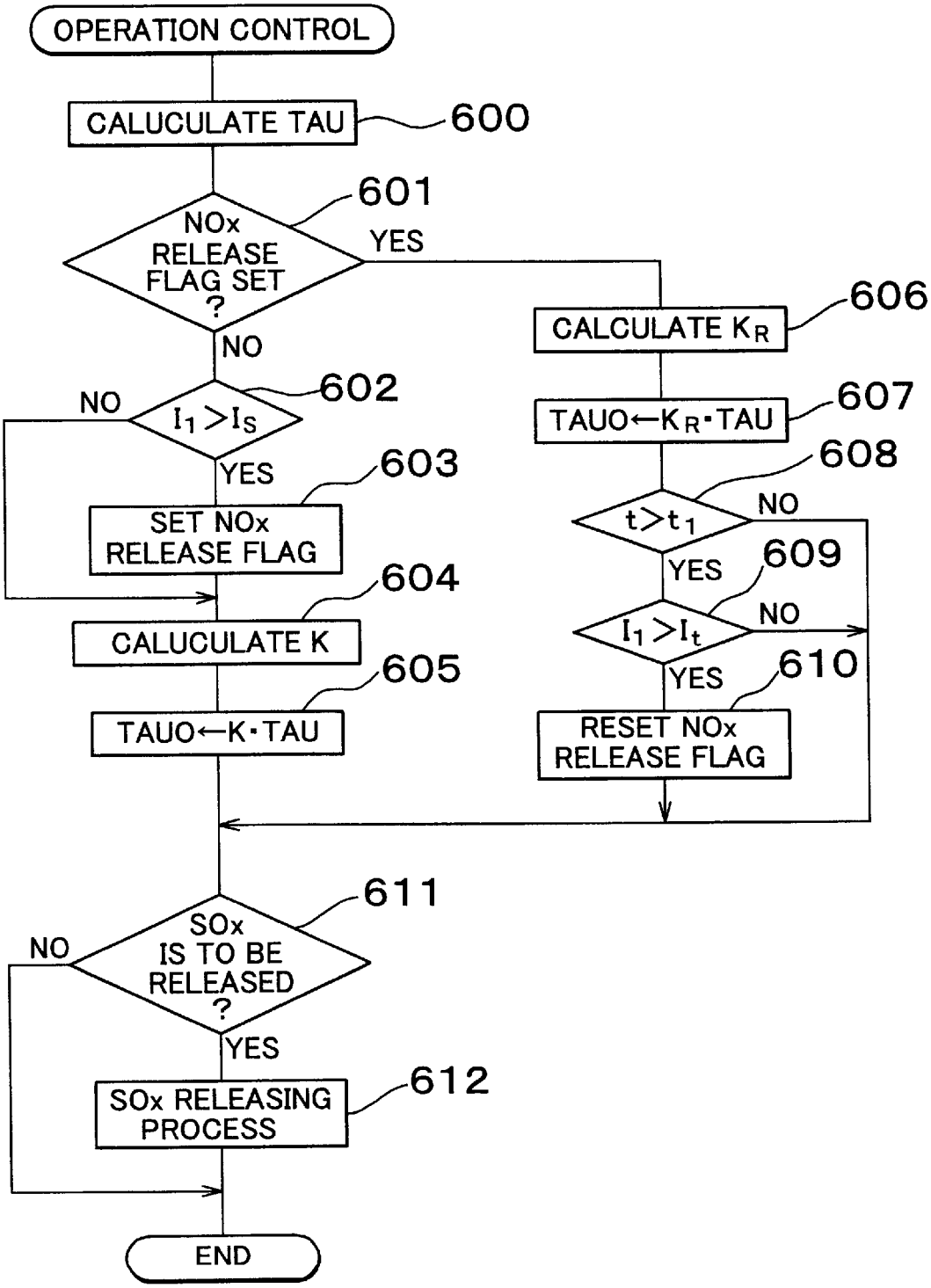
FIG. 19 is a flowchart illustrating a process for controlling the operation of the engine in the fourth embodiments of the invention.

FIG. 19 illustrates a routine for carrying out the fourth embodiment.

Referring to FIG. 19, first in step 600, a basic amount TAU of injected fuel is determined from the map indicated in FIG. 4(B). Subsequently in step 601, it is determined whether a NOx release flag for indicating that NOx should be released from the NOx occluding member 23 has been set. If the NOx release flag has not been set, the process proceeds to step 602, in which it is determined whether the detected current $I_1$ of the NOx ammonia sensor 29 has exceeded the set value Is. If $I_1 \leqq Is$, that is, if the NOx occluding capability of the NOx occluding member 23 still has a margin, the process jumps to step 604.

In step 604, a correction factor K is determined from the map indicated in FIG. 4C. Subsequently in step 605, a final amount TAUO of injected fuel (=K·TAU) is calculated by multiplying the basic amount TAU of injected fuel by the correction factor K. Then, fuel injection is performed based on the final amount TAUO of injected fuel. Subsequently in step 611, it is determined whether to release SOx. If it is not appropriate to release SOx, the processing cycle is ended.

Conversely, if it is determined in step 602 that $I_1$>Is has come to hold, that is, if the NOx occluding member 23 starts to let out NOx, the process proceeds to step 603, in which the NOx release flag is set. After that, the process proceeds to step 604.

In the processing cycle following the setting of the NOx release flag, the process goes from step 601 to step 606, in which a fuel-rich correction factor $K_R$ (≧1.0) is calculated. Subsequently in step 607, a final amount TAUO of injected fuel (=KR·TAU) is calculated by multiplying the basic amount TAU of injected fuel by the fuel-rich correction factor $K_R$. Then, fuel injection is performed based on the final amount TAUO of injected fuel. At this moment, the combustion mode is changed from the stratified charge combustion under a fuel-lean air-fuel ratio condition or the uniform mixture combustion under a fuel-lean air-fuel ratio condition to the uniform mixture combustion under a fuel-rich air-fuel ratio condition. As a result, release of NOx from the NOx occluding member 23 starts.

Subsequently in step 608, it is determined whether the elapse time t following the setting of the NOx release flag has exceeded a constant time $t_1$. The constant time $t_1$ is a time that elapses from the change of the air-fuel ratio from the fuel-lean side to the fuel-rich side until the detected current $I_1$ of the NOx ammonia sensor 29 decreases to zero. If $t>t_1$ holds, the process proceeds to step 609, in which the detected current $I_1$ of the NOx ammonia sensor 29 has exceeded a predetermined set value It. If $I_1$>It holds, the process proceeds to step 610, in which the NOx release flag is reset. Then, the process proceeds to step 611. If the NOx release flag is reset, the air-fuel ratio is changed from the fuel-rich side to the fuel-lean side.

If it is determined in step 611 that SOx should be released, the process proceeds to step 612, in which a process of releasing SOx from the NOx occluding member 23 is executed. That is, the air-fuel ratio is changed to the rich side while the temperature of the NOx occluding member 23 is kept substantially at or above 600° C.

Next, a fifth embodiment of the invention will be described with reference to FIGS. 20 and 21.

In this embodiment, the amount of NOx occluded into the NOx occluding member 23 is estimated, and a fuel-rich time interval between a fuel-rich shift of the air-fuel ratio of exhaust gas flowing into the NOx occluding member 23 and the next fuel-rich shift of the air-fuel ratio is controlled based on the estimated amount of NOx occluded. Furthermore, the fuel-rich time interval is corrected based on the detected current $I_1$, as in the third embodiment.

Specifically, the fifth embodiment includes an amount-of-occluded-NOx estimating device that estimates the amount of NOx occluded in the NOx occluding member 23. When the amount ΣNOX of occluded NOx estimated by the amount-of-occluded-NOx estimating device exceeds an allowable value NOXmax as indicated in FIG. 13, the air-fuel ratio is temporarily changed from the fuel-lean side to the fuel-rich side.

In this embodiment, amounts NA of occluded NOx corresponding to states of operation of the engine as indicated in FIG. 14 are integrated during operation of the engine, thereby calculating an estimated amount ΣNOX of NOx that is considered to be occluded in the NOx occluding member 23. It should be noted herein that the value of NA becomes negative in an operation region where the air-fuel ratio equals the stoichiometric air-fuel ratio or is on the fuel-rich side thereof, because in such an operation region, NOx is released from the NOx occluding member 23.

Figure 15:
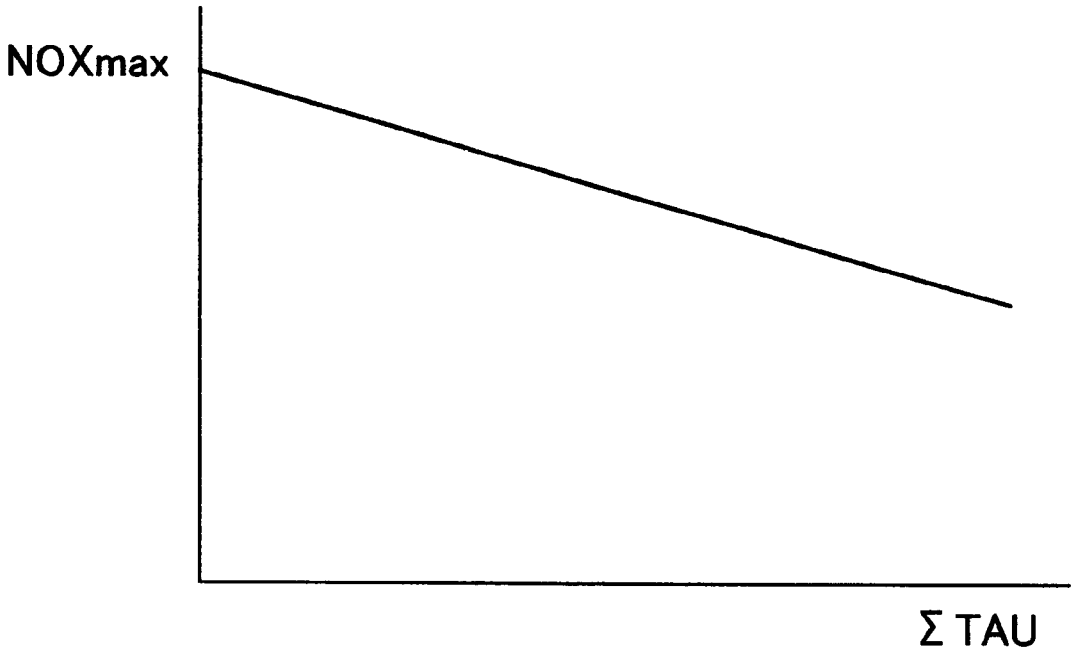
FIG. 15 is a diagram indicating an allowable value.

In the fifth embodiment, the allowable value NOXmax is gradually decreased with increases in the integrated value ΣTAU of the amount of injected fuel as indicated in FIG. 15.

Basically in the fifth embodiment, the air-fuel ratio is temporarily changed from the fuel-lean side to the fuel-rich side when the amount ΣNOX of occluded NOx exceeds the allowable value NOXmax, as mentioned above.

Furthermore in the fifth embodiment, the allowable value NOXmax is set to a value that is less than the amount of occluded NOx occurring when the NOx occluding member 23 starts to let out NOx during a fuel-lean operation. Therefore, in the fifth embodiment, the air-fuel ratio is changed from the fuel-lean side to the fuel-rich side before the NOx occluding member 23 starts to let out NOx during the fuel-lean operation.

In the fifth embodiment, the allowable value NOXmax is corrected based on the detected current $I_1$.

Figure 20:
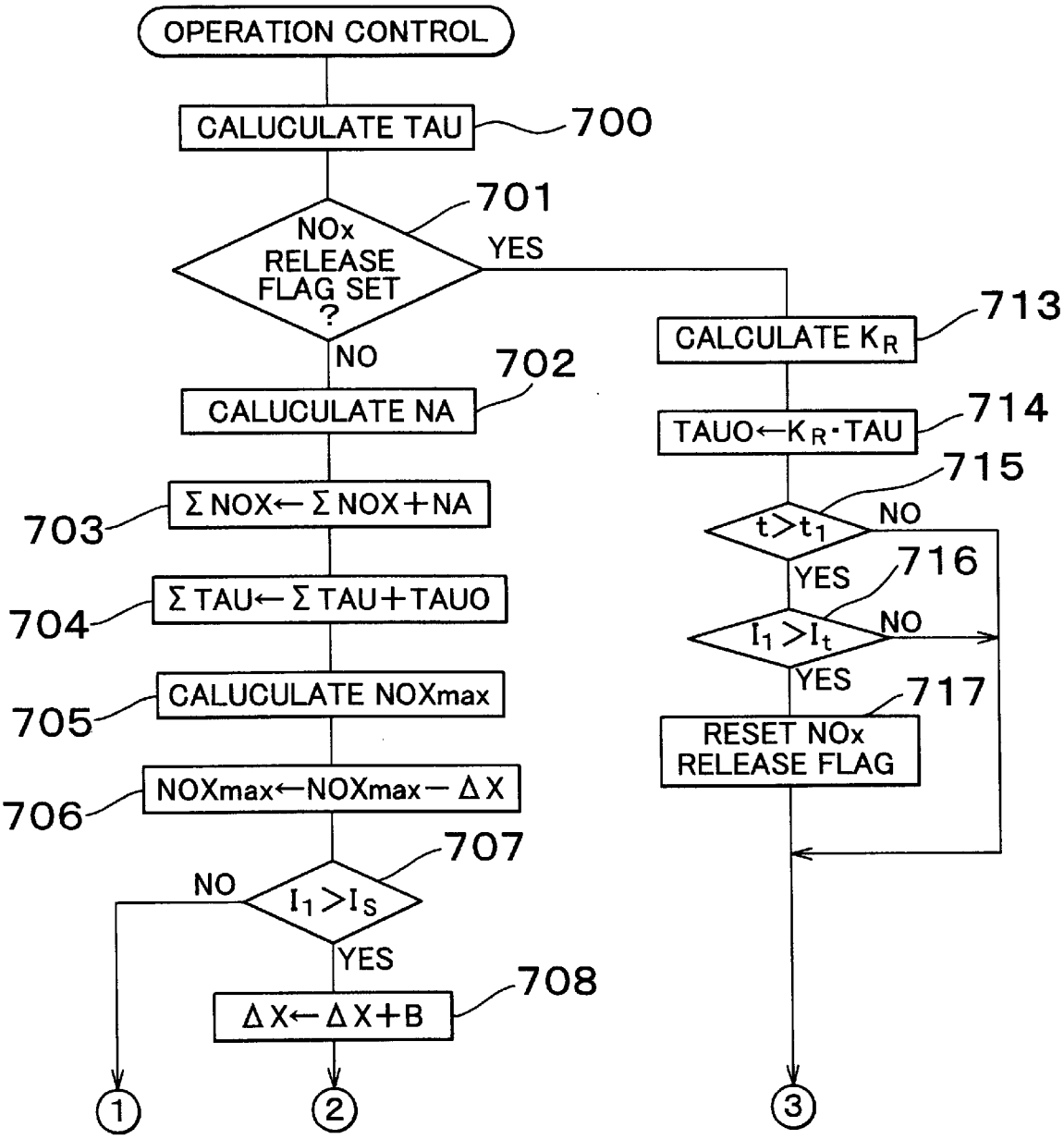
FIG. 20 is a flowchart illustrating a process for controlling the operation of the engine in the fifth embodiments of the invention.
Figure 21:
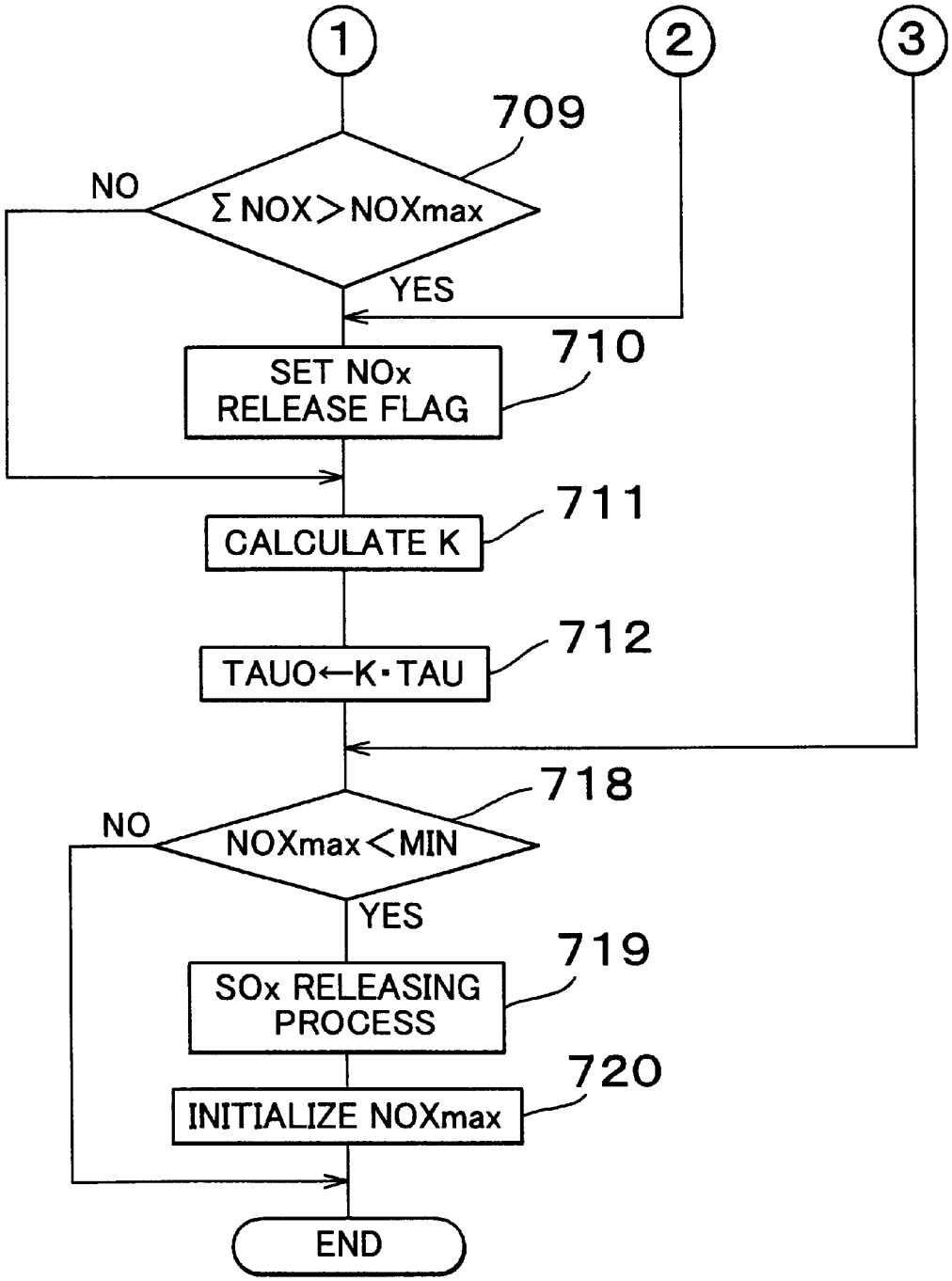
FIG. 21 is a flowchart illustrating a process for controlling the operation of the engine which continues from FIG. 20.

FIGS. 20 and 21 illustrate a routine for carrying out the fifth embodiment.

Referring to FIGS. 20 and 21, first in step 700, an amount TAU of injected fuel is calculated from the map indicated in FIG. 4B. Subsequently in step 701, it is determined whether a NOx release flag for indicating that NOx should be released from the NOx occluding member 23 has been set. If the NOx release flag has not been set, the process proceeds to step 702, in which an amount NA of NOx occluded per unit time is calculated from the map indicated in FIG. 14. Subsequently in step 703, an estimated amount ΣNOX of NOx that is considered to be occluded in the NOx occluding member 23 is calculated by adding the amount NA of occluded NOx to the existing value of ΣNOX.

Subsequently in step 704, an integrated value ΣTAU of injected fuel is calculated by adding a final amount TAUO of injected fuel to the existing value of ΣTAU. Subsequently in step 705, an allowable value NOXmax is calculated from the integrated value ΣTAU based on the relationship indicated in FIG. 15. Subsequently in step 706, the allowable value NOXmax is reduced by a correction amount ΔX. Subsequently in step 707, it is determined whether the detected current $I_1$ of the NOx ammonia sensor 29 has exceeded the set value Is. If $I_1$≦Is, the process proceeds to step 709, in which it is determined whether the amount ΣNOX of occluded NOx has exceeded the allowable value NOXmax. If ΣNOX≦NOXmax, that is, if the NOx occluding capability of the NOx occluding member 23 still has a margin, the process jumps to step 711.

In step 711, a correction factor K is calculated from the map indicated in FIG. 4C. Subsequently in step 712, a final amount TAUO of injected fuel (=K·TAU) is calculated by multiplying the basic amount TAU of injected fuel by the correction factor K. Then, fuel injection is performed based on the final amount TAUO of injected fuel. Subsequently in step 718, it is determined whether the allowable value NOXmax has become less than a lower limit value MIN for release of SOx. If NOXmax≧MIN, the processing cycle is ended.

Conversely, if it is determined in step 709 that ΣNOX>NOXmax holds, the process proceeds to step 710, in which the NOx release flag is set. After that, the process proceeds to step 711. If it is determined in step 707 that $I_1$>Is has come to hold, that is, the NOx occluding member 23 starts to discharge NOx, before it is determined in step 709 whether ΣNOx>NOXmax holds, then the process proceeds to step 708, in which the a predetermined value B is added to the correction amount Δx. Subsequently in step 710, the NOx release flag is set. In this case, therefore, the allowable value NOXmax is reduced by the set value B.

In the processing cycle following the setting of the NOx release flag, the process goes from step 701 to step 713, in which a fuel-rich correction factor $K_R$ (≧1.0) is calculated. Subsequently in step 714, a final amount TAUO of injected fuel (=$K_R$·TAU) is calculated by multiplying the basic amount TAU of injected fuel by the fuel-rich correction factor $K_R$. Then, fuel injection is performed based on the final amount TAUO of injected fuel. At this moment, the combustion mode is changed from the stratified charge combustion under a fuel-lean air-fuel ratio condition or the uniform mixture combustion under a fuel-lean air-fuel ratio condition to the uniform mixture combustion under a fuel-rich air-fuel ratio condition. As a result, release of NOx from the NOx occluding member 23 starts.

Subsequently in step 715, it is determined whether the elapse time t following the setting of the NOx release flag has exceeded a constant time $t_1$. The constant time $t_1$ is a time that elapses from the change of the air-fuel ratio from the fuel-lean side to the fuel-rich side caused in response to $I_1$>Is until the detected current $I_1$ of the NOx ammonia sensor 29 decreases to zero. If $t>t_1$ holds, the process proceeds to step 716, in which the detected current $I_1$ of the NOx ammonia sensor 29 has exceeded a predetermined set value It. If $I_1$>It holds, the process proceeds to step 717, in which the NOx release flag is reset. Then, the process proceeds to step 718. If the NOx release flag is reset, the air-fuel ratio is changed from the fuel-rich side to the fuel-lean side.

Conversely, if it is determined in step 718 that NOXmax<MIN holds, the process proceeds to step 719, in which a process of releasing SOx from the NOx occluding member 23 is executed. That is, the air-fuel ratio is changed to the rich side while the temperature of the NOx occluding member 23 is kept substantially at or above 600° C. After the operation of releasing SOx from the NOx occluding member 23 is completed, the process proceeds to step 720, in which NOXmax is set to an initial value, and ΣTAU is set to zero.

A sixth embodiment of the invention will be described with reference to FIGS. 22 to 26.

Figure 22:
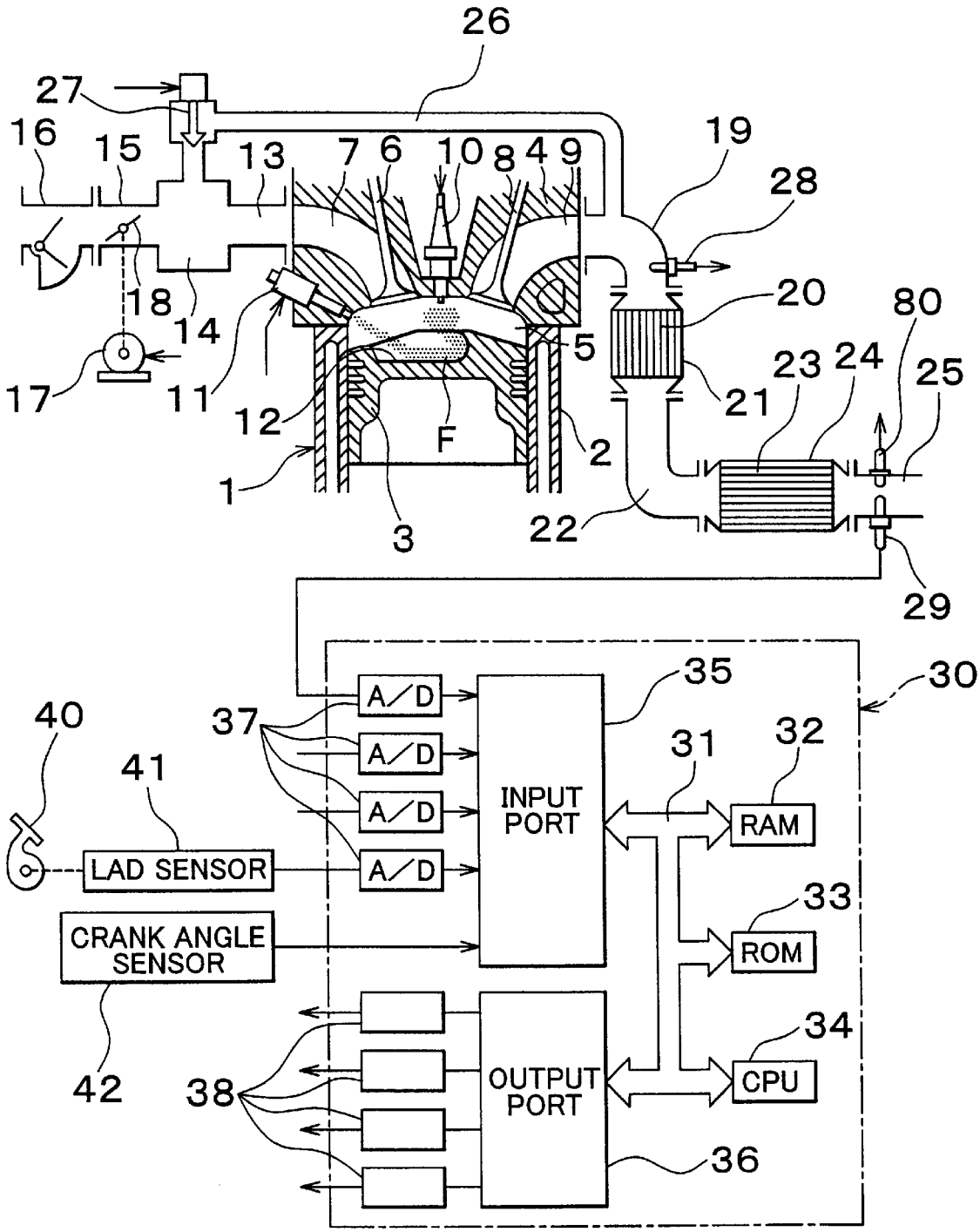
FIG. 22 is a diagram illustrating an overall construction of an internal combustion engine in accordance with a sixth embodiment of the invention.

FIG. 22 illustrates a direct injection-type spark injection engine to which the sixth and seventh embodiments of the invention are applied. The invention is also applicable to a compression ignition-type internal combustion engine.

The internal combustion engine illustrated in FIG. 22 has substantially the same construction as the internal combustion engine shown in FIG. 1, except that in addition to a NOx ammonia sensor 29, an air-fuel ratio sensor 80 is disposed in an exhaust pipe 25. Portions and arrangements of the engine comparable to those of the engine illustrated in FIG. 1 are represented by comparable reference numerals, and will not be described again. An output signal of the air-fuel ratio sensor 80 is inputted to an input port 35 via an A/D converter 37.

Figure 23:
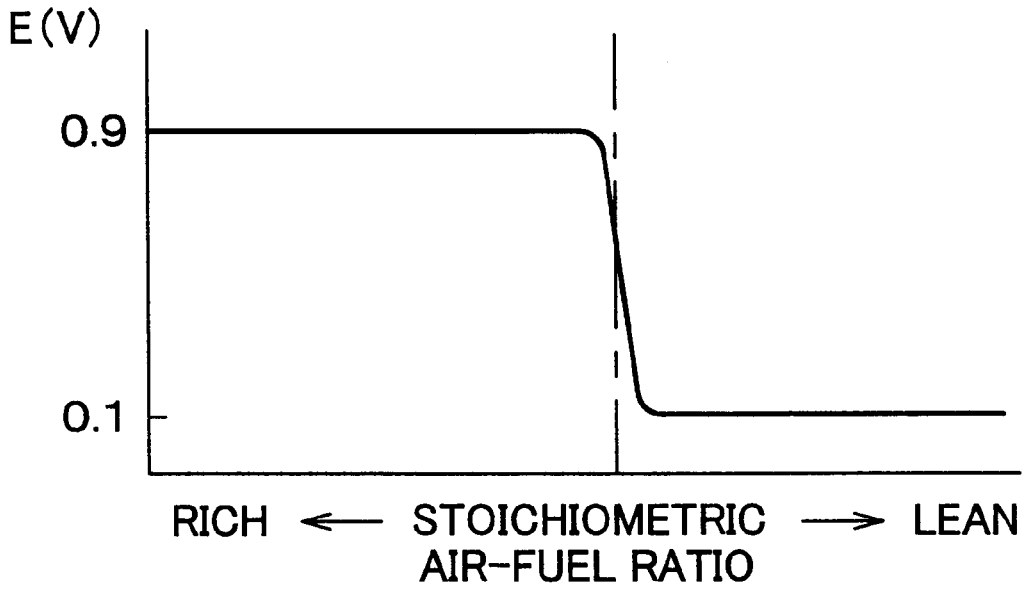
FIG. 23 is a diagram indicating the output voltage of an air-fuel ratio sensor in the sixth embodiment of the invention.

FIG. 23 indicates the output voltage E (V) of the air-fuel ratio sensor 80 disposed in the exhaust pipe 25 downstream of a NOx occluding member 23, that is, the output signal level of an air-fuel ratio detector in a broader expression. As is apparent from FIG. 23, the air-fuel ratio sensor 80 generates an output voltage of about 0.9 (V) when the air-fuel ratio of exhaust gas is on the fuel-rich side of the stoichiometric air-fuel ratio, and generates an output voltage of about 0.1 (V) when the air-fuel ratio of exhaust gas is on the fuel-lean side. That is, in the example indicated in FIG. 23, the output signal level indicating that the air-fuel ratio is on the fuel-rich side is 0.9 (V), and the output signal level indicating that the air-fuel ratio is on the fuel-lean side is 0.1 (V).

The exhaust gas air-fuel ratio can be detected from the electric current $I_2$ Of the NOx ammonia sensor 29 as described above. Therefore, the NOx ammonia sensor 29 may be used as an air-fuel ratio detector. In that case, it becomes unnecessary to provide the air-fuel ratio sensor 80.

The sixth embodiment of the reducing agent supplying control will be described with reference to FIG. 24.

Figure 24:
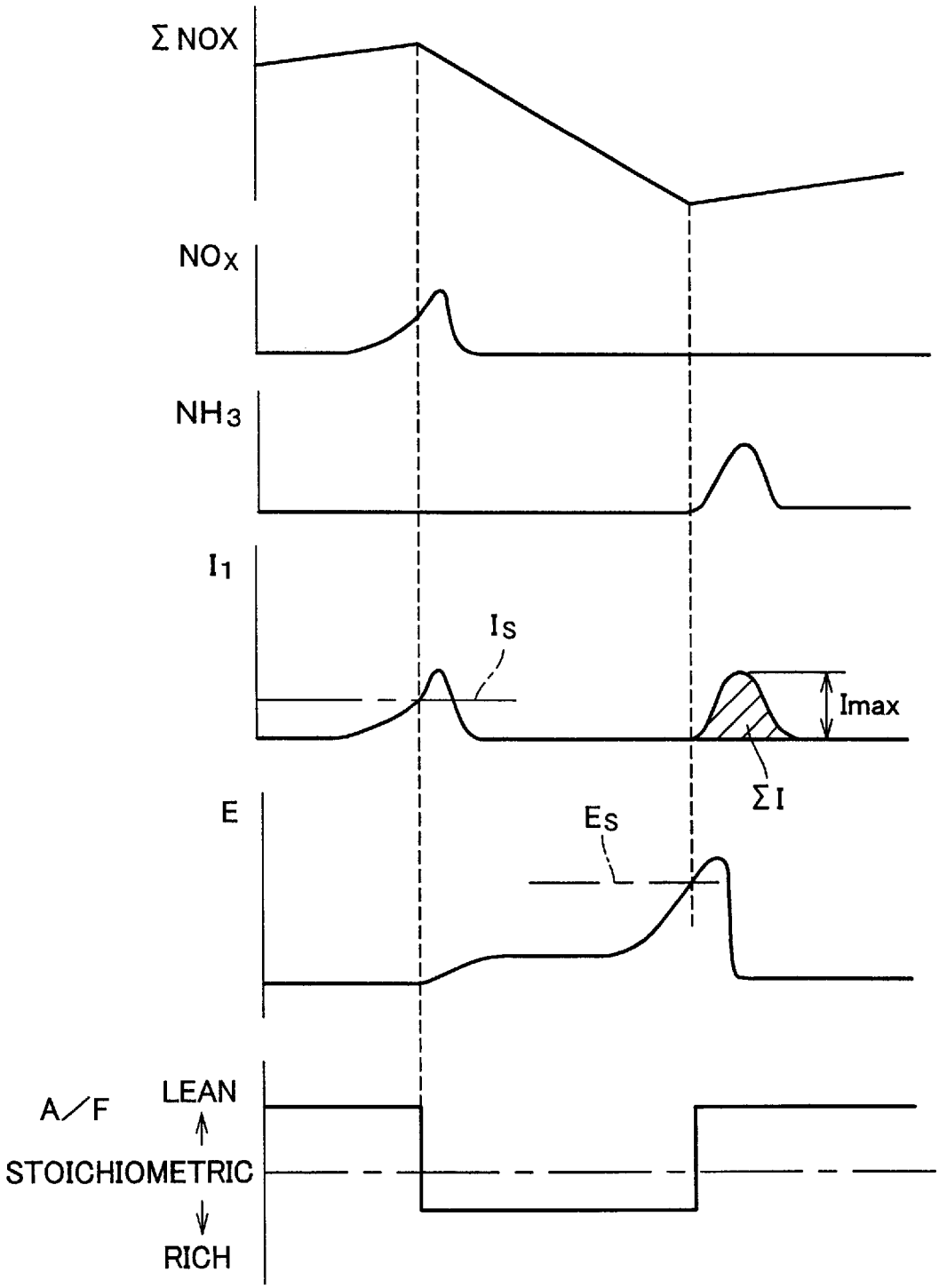
FIG. 24 is a time chart indicating the output voltage of an air-fuel ratio sensor, the electric current detected by the NOx ammonia sensor, etc.

Referring to FIG. 24, ΣNOX indicates the amount of NOx occluded in the NOx occluding member 23, and $I_1$ indicates the electric current detected by the NOx ammonia sensor 29. In FIG. 24, NOx and $NH_3$ indicate changes in the NOx ammonia sensor 29-detected current caused by changes in the NOx concentration in exhaust gas and changes in the $NH_3$ concentration in exhaust gas, respectively. These detected currents both appear in the detected current $I_1$ of the NOx ammonia sensor 29. Furthermore, E indicates the output voltage of the air-fuel ratio sensor 80, and A/F indicates the average air-fuel ratio of mixture in the combustion chamber.

As indicated in FIG. 24, as the amount ΣNOX of NOx occluded in the NOx occluding member 23 increases and approaches a limit of the occluding capability of the NOx occluding member 23, the NOx occluding member 23 starts to let out NOx, so that the detected current $I_1$ of the NOx ammonia sensor 29 starts to rise. In the embodiment indicated in FIG. 24, when the NOx concentration exceeds a predetermined set value after the NOx occluding member 23 starts to let out the NOx, that is, when the detected current $I_1$ of the NOx ammonia sensor 29 exceeds a predetermined set value Is, the air-fuel ratio A/F is changed from the fuel-lean side to the fuel-rich side so as to release NOx from the NOx occluding member 23. After the change of the air-fuel ratio from the lean side to the rich side, a time is needed before a fuel-rich air-fuel ratio exhaust gas reaches the NOx occluding member 23. Therefore, the amount of NOx discharged from the NOx occluding member 23 continues to increase immediately after the change of the air-fuel ratio A/F to the rich side. Then, the reducing agent present in the fuel-rich air-fuel ratio exhaust gas starts to reduce NOx, so that the discharge of NOx from the NOx occluding member 23 discontinues. Therefore, following the change of the air-fuel ratio from the fuel-lean side to the fuel-rich side, the detected current $I_1$ of the NOx ammonia sensor 29 rises for a short time, and then drops to zero.

After the air-fuel ratio is changed from the fuel-lean side to the fuel-rich side, release of NOx from the NOx occluding member 23 starts, so that the amount ΣNOX of NOx occluded in the NOx occluding member 23 gradually decreases.

After the change of the air-fuel ratio from the fuel-lean side to the fuel-rich side, an excess amount of fuel, that is, the reducing agent, is consumed to reduce NOx, so that the air-fuel ratio of exhaust gas discharged from the NOx occluding member 23 becomes substantially equal to the stoichiometric air-fuel ratio. Although the reason is altogether clear, the air-fuel ratio of exhaust gas discharged from the NOx occluding member 23 tends to slightly shift to the fuel-lean side when the NOx occluding member 23 has not deteriorated. If the NOx occluding member 23 deteriorates, the air-fuel ratio of exhaust gas discharged from the NOx occluding member 23 tends to slightly shift to the fuel-rich side. However, in either case, the air-fuel ratio of exhaust gas discharged from the NOx occluding member 23 becomes smaller near the completion of the release of NOx from the NOx occluding member 23.

FIG. 24 indicates a case where at the time of changing the air-fuel ratio from the fuel-lean side to the fuel-rich side, the air-fuel ratio of exhaust gas discharged from the NOx occluding member 23 is slightly to the lean side. When the release of NOx from the NOx occluding member 23 approaches the completion, that is, when the amount ΣNOX of occluded NOx approaches zero, the output voltage E of the air-fuel ratio sensor 80 changes, that is, rises, toward an output signal level indicating that the air-fuel ratio is on the rich side. The output signal level E changes with good responsiveness. Therefore, by changing the air-fuel ratio from the fuel-rich side to the fuel-lean side based on a change in the output signal level E, it becomes possible to change the air-fuel ratio from the fuel-rich side to the fuel-lean side upon completion of the release of NOx from the NOx occluding member 23.

Therefore, in the embodiment indicated in FIG. 24, a reference voltage Es is set beforehand with respect to the output voltage E of the air-fuel ratio sensor 80; in a general expression, a reference level Es is pre-set with respect to the output signal level E of an air-fuel ratio detector. If the output signal level E exceeds the reference level Es, the air-fuel ratio is changed from the fuel-rich side to the fuel-lean side.

Although the output voltage E of the air-fuel ratio sensor 80 changes with good responsiveness, the manner of change in the output voltage E varies due to performance variations of air-fuel ratio sensors 80 and NOx occluding members 29 or aging. Therefore, if the reference level Es is fixed to a constant value, there may be a case where the air-fuel ratio cannot be changed from the fuel-rich side to the fuel-lean side at the time of completion of the release of NOx.

If after the change of the air-fuel ratio from the fuel-lean side to the fuel-rich side, a surplus amount of the reducing agent that is not used to release and reduce NOx occluded in the NOx occluding member 23, ammonia $NH_3$ is discharged from the NOx occluding member 23, so that the detected current $I_1$ of the NOx ammonia sensor 29 rises as indicated in FIG. 24. In this case, the integrated value ΣI of detected current $I_1$ indicated by hatching in FIG. 24 and the maximum value Imax of detected current $I_1$ indicate the surplus amount of the reducing agent.

Although the detected current $I_1$ of the NOx ammonia sensor 29 delays in response to completion of the release of NOx, the surplus amount of the reducing agent can be accurately determined from the detected current $I_1$. In this embodiment, therefore, the reference voltage Es is changed so that the air-fuel ratio of exhaust gas is changed from the fuel-rich side to the fuel-lean side at the time of completion of the release of NOx from the NOx occluding member 23 based on changes in the detected current $I_1$ of the NOx ammonia sensor 29, that is, based on changes in the ammonia concentration.

Specifically, a small target value is pre-set regarding the integrated value ΣI of detected current $I_1$ or the maximum value Imax of detected current $I_1$. If ΣI or Imax becomes greater than the target value, that is, if the surplus amount of the reducing agent is relatively great, the reference level Es is reduced, that is, the reference level Es is changed toward the side of an output signal level that indicates a fuel-lean air-fuel ratio, by advancing the timing of changing the air-fuel ratio from the fuel-rich side to the fuel-lean side so as to reduce the surplus amount of the reducing agent. If ΣI or Imax becomes smaller than the target value, that is, if the surplus amount of the reducing agent is zero or nearly zero, the reference level Es is raised, that is, the reference level Es is changed toward the side of an output signal level that indicates a fuel-rich air-fuel ratio, by retarding the timing of changing the air-fuel ratio from the fuel-rich side to the fuel-lean side so as to increase the surplus amount of the reducing agent.

Figure 25:
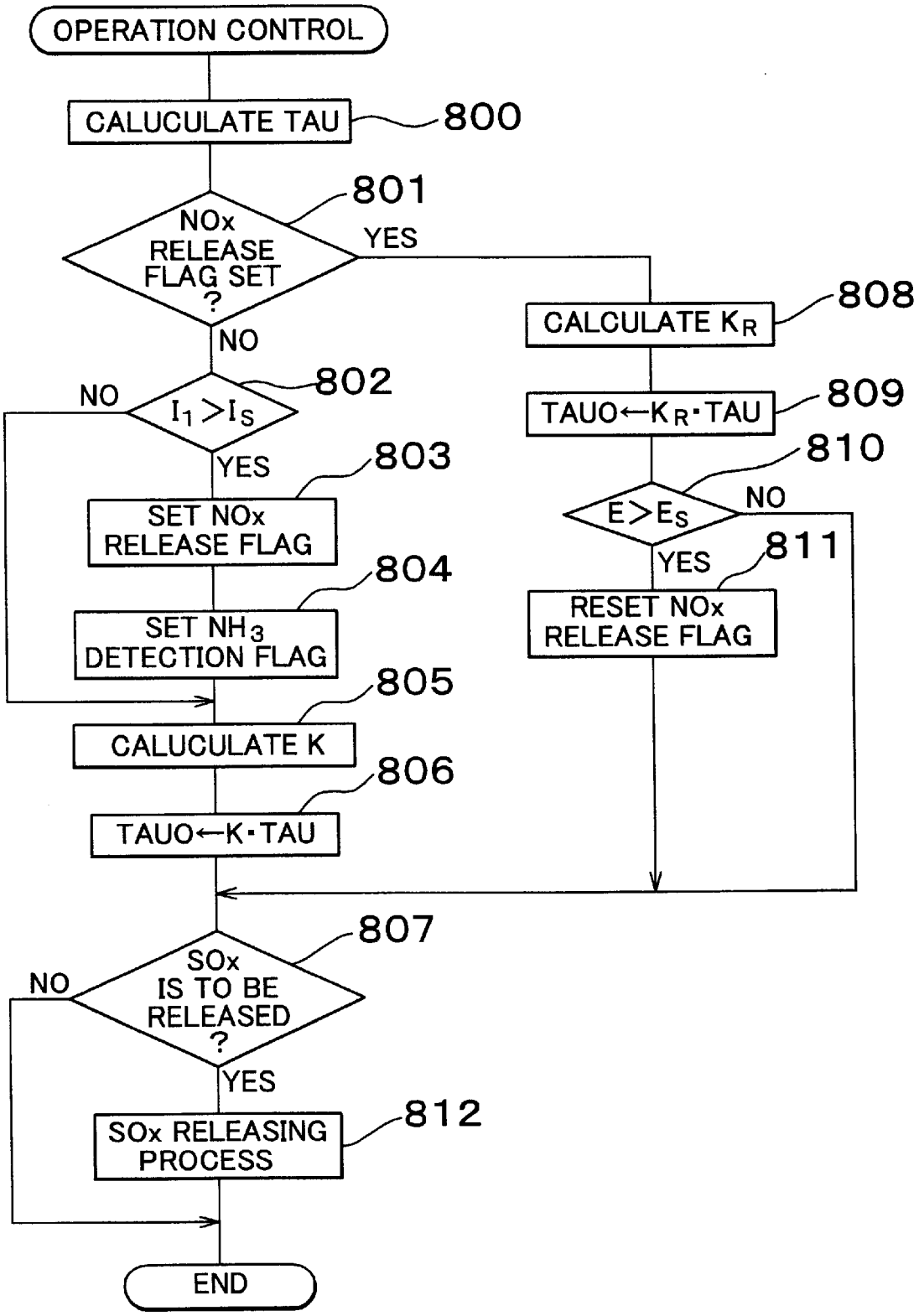
FIG. 25 is a flowchart illustrating a process for controlling the operation of the engine in the sixth embodiments of the invention.

FIG. 25 illustrates a routine for carrying out the sixth embodiment.

Referring to FIG. 25, first in step 800, a basic amount TAU of injected fuel is determined from the map indicated in FIG. 4(B). Subsequently in step 801, it is determined whether a NOx release flag for indicating that NOx should be released from the NOx occluding member 23 has been set. If the NOx release flag has not been set, the process proceeds to step 802, in which it is determined whether the detected current $I_1$ of the NOx ammonia sensor 29 has exceeded the set value Is. If $I_1$<Is, that is, if the NOx occluding capability of the NOx occluding member 23 still has a margin, the process jumps to step 805.

In step 804, a correction factor K is determined from the map indicated in FIG. 4C. Subsequently in step 805, a final amount TAUO of injected fuel (=K·TAU) is calculated by multiplying the basic amount TAU of injected fuel by the correction factor K. Then, fuel injection is performed based on the final amount TAUO of injected fuel. Subsequently in step 807, it is determined whether to execute a SOx releasing process for releasing SOx from the NOx occluding member 23. If it is not necessary to execute the SOx releasing process, the processing cycle is ended.

Conversely, if it is determined in step 802 that $I_1$>Is has come to hold, that is, if the NOx occluding member 23 starts to let out NOx, the process proceeds to step 803, in which the NOx release flag is set. Subsequently in step 804, the $NH_3$ detection flag is set. After that, the process proceeds to step 805.

In the processing cycle following the setting of the NOx release flag, the process goes from step 801 to step 808, in which a fuel-rich correction factor $K_R$ (>1.0) is calculated. Subsequently in step 809, a final amount TAUO of injected fuel (=$K_R$·TAU) is calculated by multiplying the basic amount TAU of injected fuel by the fuel-rich correction factor $K_R$. Then, fuel injection is performed based on the final amount TAUO of injected fuel. At this moment, the combustion mode is changed from the stratified charge combustion under a fuel-lean air-fuel ratio condition or the uniform mixture combustion under a fuel-lean air-fuel ratio condition to the uniform mixture combustion under a fuel-rich air-fuel ratio condition. As a result, release of NOx from the NOx occluding member 23 starts.

Subsequently in step 810, it is determined whether the output voltage E of the air-fuel ratio sensor 80 has exceeded the reference voltage Es. If E≦Es, the process proceeds to step 807. Conversely, if E>Es holds, the process proceeds to step 811, in which the $NH_3$ detection flag is reset. If the NOx release flag is reset, the air-fuel ratio is changed from the fuel-rich side to the fuel-lean side.

If it is determined in step 807 that the SOx releasing process should be executed, the process proceeds to step 812, in which the process of releasing SOx from the NOx occluding member 23 is executed. That is, the air-fuel ratio is changed to the rich side while the temperature of the NOx occluding member 23 is kept substantially at or above 600° C.

Figure 26:
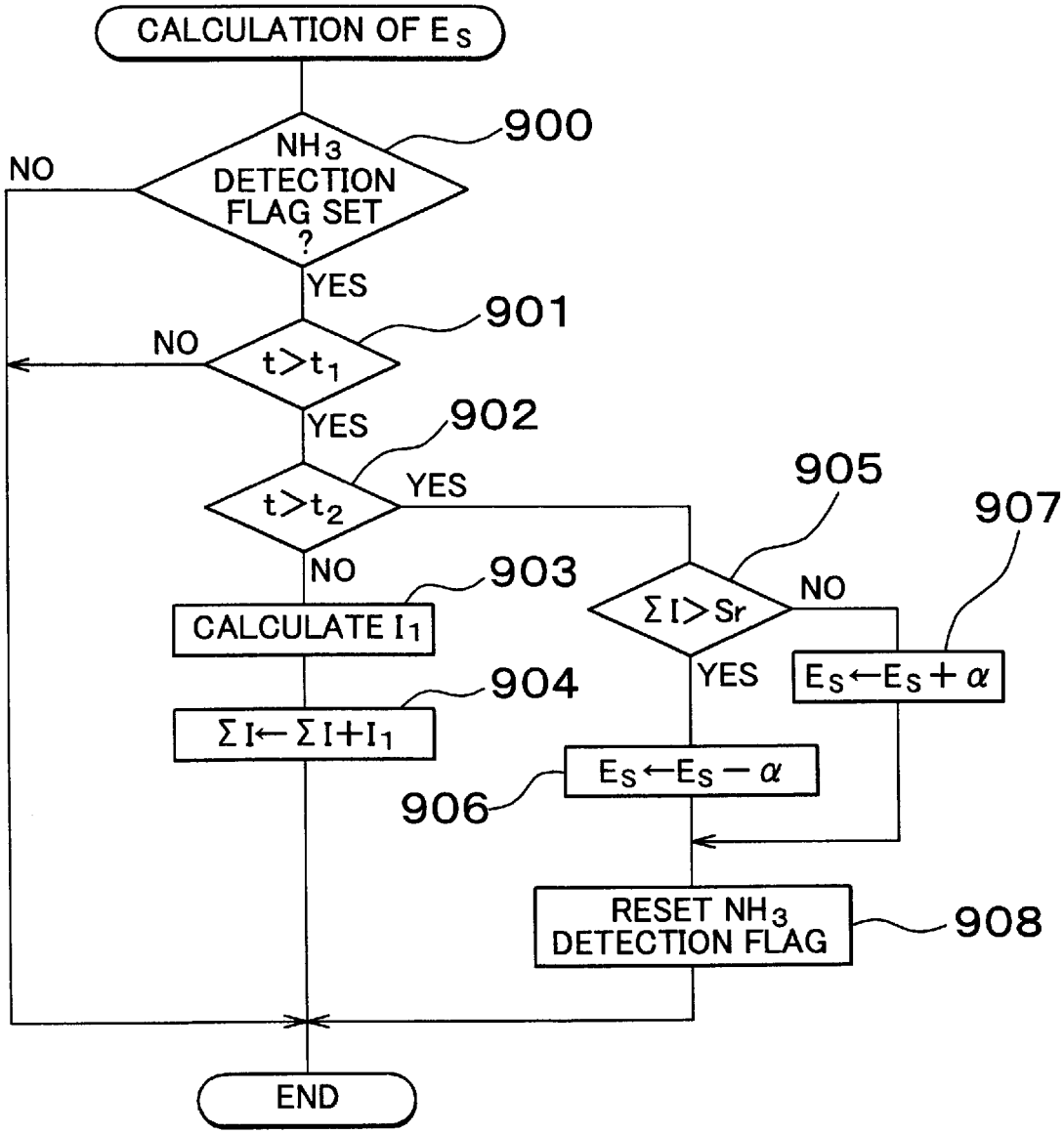
FIG. 26 is a flowchart for calculating a reference voltage Es.

FIG. 26 illustrates a routine for calculating a target voltage Es.

Referring to FIG. 26, it is first determined in step 900 whether the $NH_3$ detection flag has been set. The $NH_3$ detection flag is set when it is determined that $I_1$>Is holds in step 802 in FIG. 25. If the $NH_3$ detection flag has been set, the process proceeds to step 901, in which it is determined whether the elapsed time t following the setting of the $NH_3$ detection flag has exceeded a constant time $t_1$. The constant time $t_1$ is a time that elapses from the change of the air-fuel ratio from the fuel-lean side to the fuel-rich side until the detected current $I_1$ of the NOx ammonia sensor 29 decreases to zero. If $t>t_1$ holds, the process proceeds to step 902, in which it is determined whether the elapsed time t following the setting of the $NH_3$ detection flag has exceeded a constant time $t_2$. The constant time $t_2$ sufficiently allows the NOx ammonia sensor 29 to detect an ammonia concentration when ammonia is discharged from the NOx occluding member 23 regardless of the amount of ammonia discharged. If $t \leqq t_2$, the process proceeds to step 903.

In step 903, the detected current $I_1$ of the NOx ammonia sensor 29 is calculated. Subsequently in step 904, an integrated value ΣI of detected current is calculated by adding the detected current $I_1$ to the existing value of ΣI. If it is determined in step 902 that $t>t_2$ has come to hold, the process proceeds to step 905, in which it is determined whether the integrated value ΣI of detected current is greater than the target value Sr. If ΣI>Sr, the process proceeds to step 906, in which the reference voltage Es is reduced by a predetermined set value α. After that, the process proceeds to step 908. Conversely, if ΣI≦Sr, the process proceeds to step 907, in which the reference voltage Es is increased by the predetermined set value α. After that, the process proceeds to step 908. In step 908, ΣI is cleared, and the $NH_3$ detection flag is reset.

Figure 27:
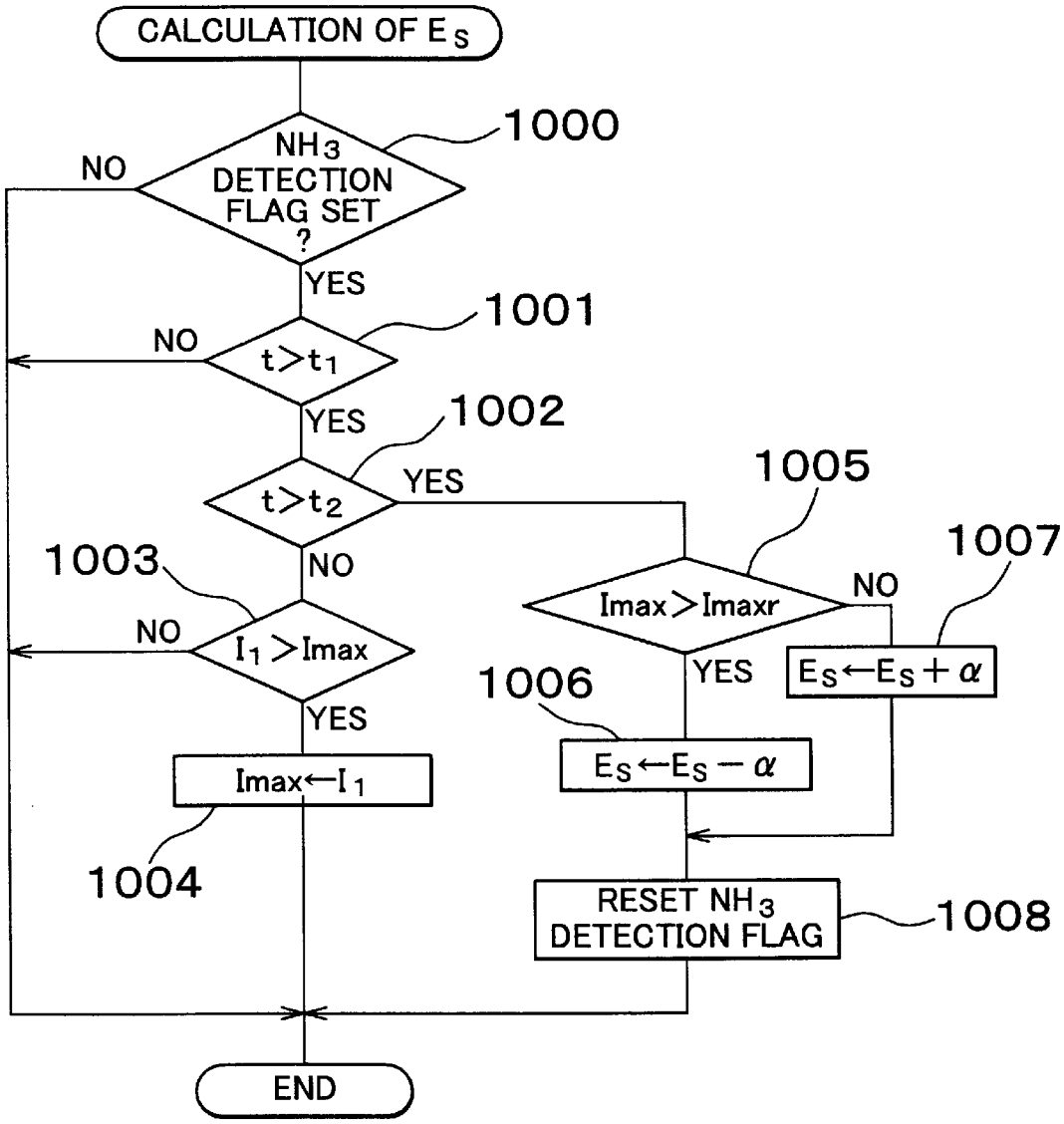
FIG. 27 is a flowchart for calculating a reference voltage Es which is different from the process illustrated in FIG. 26.

FIG. 27 illustrates another routine for calculating a target voltage Es.

Referring to FIG. 27, it is first determined in step 1000 whether the $NH_3$ detection flag has been set. The $NH_3$ detection flag is set when it is determined that $I_1$>Is holds in step 802 in FIG. 25. If the $NH_3$ detection flag is not set, the process proceeds to step 1001, in which it is determined whether the elapsed time t following the setting of the $NH_3$ detection flag has exceeded a constant time $t_1$. The constant time $t_1$, as mentioned above, is a time that elapses from the change of the air-fuel ratio from the fuel-lean side to the fuel-rich side until the detected current $I_1$ of the NOx ammonia sensor 29 decreases to zero. If $t>t_1$ holds, the process proceeds to step 1002, in which it is determined whether the elapsed time t following the setting of the $NH_3$ detection flag has exceeded a constant time $t_2$. The constant time $t_2$, as mentioned above, sufficiently allows the NOx ammonia sensor 29 to detect an ammonia concentration when ammonia is discharged from the NOx occluding member 23 regardless of the amount of ammonia discharged. If $t<t_2$, the process proceeds to step 1003.

In step 1003, it is determined whether the detected current $I_1$ is greater than Imax.

If $I_1$>Imax, the process proceeds to step 1004, in which the detected current $I_1$ is set as a maximum value Imax of detected current. If it is determined in step 1002 that $t>t_2$ has come to hold, the process proceeds to step 1005, in which it is determined whether the maximum value Imax of detected current is greater than a target maximum value Imaxr. If Imax>Imaxr, the process proceeds to step 1006, in which the reference voltage Es is reduced by a predetermined set value α. After that, the process proceeds to step 1008. Conversely, if Imax≦Imaxr, the process proceeds to step 1007, in which the reference voltage Es is increased by the predetermined set value α. After that, the process proceeds to step 1008. In step 1008, ΣI is cleared, and the $NH_3$ detection flag is reset.

Next described will be a seventh embodiment of the invention.

The seventh embodiment is applied to the internal combustion engine illustrated in FIG. 22.

In the seventh embodiment, the amount of NOx occluded into the NOx occluding member 23 is estimated, and a fuel-rich time interval between a fuel-rich shift of the air-fuel ratio of exhaust gas flowing into the NOx occluding member 23 and the next fuel-rich shift of the air-fuel ratio is controlled based on the estimated amount of NOx occluded. Furthermore, the fuel-rich time interval is corrected based on the detected current $I_1$, as in the third embodiment.

Specifically, the seventh embodiment includes an amount-of-occluded-NOx estimating device that estimates the amount of NOx occluded in the NOx occluding member 23. When the amount ΣNOX of occluded NOx estimated by the amount-of-occluded-NOx estimating device exceeds an allowable value NOXmax as indicated in FIG. 13, the air-fuel ratio is temporarily changed from the fuel-lean side to the fuel-rich side.

In this embodiment, amounts NA of occluded NOx corresponding to states of operation of the engine as indicated in FIG. 14 are integrated during operation of the engine, thereby calculating an estimated amount ΣNOX of NOx that is considered to be occluded in the NOx occluding member 23. It should be noted herein that the value of NA becomes negative in an operation region where the air-fuel ratio equals the stoichiometric air-fuel ratio or is on the fuel-rich side thereof, because in such an operation region, NOx is released from the NOx occluding member 23.

In the seventh embodiment, the allowable value NOXmax is gradually decreased with increases in the integrated value ΣTAU of the amount of injected fuel as indicated in FIG. 15.

Basically in the seventh embodiment, the air-fuel ratio is temporarily changed from the fuel-lean side to the fuel-rich side when the amount ΣNOX of occluded NOx exceeds the allowable value NOXmax, as mentioned above. Furthermore in the seventh embodiment, the allowable value NOXmax is set to a value that is less than the amount of occluded NOx occurring when the NOx occluding member 23 starts to let out NOx during a fuel-lean operation. Therefore, in the seventh embodiment, the air-fuel ratio is changed from the fuel-lean side to the fuel-rich side before the NOx occluding member 23 starts to let out NOx during the fuel-lean operation.

In the seventh embodiment, the allowable value NOXmax is corrected based on the detected current II.

Figure 28:
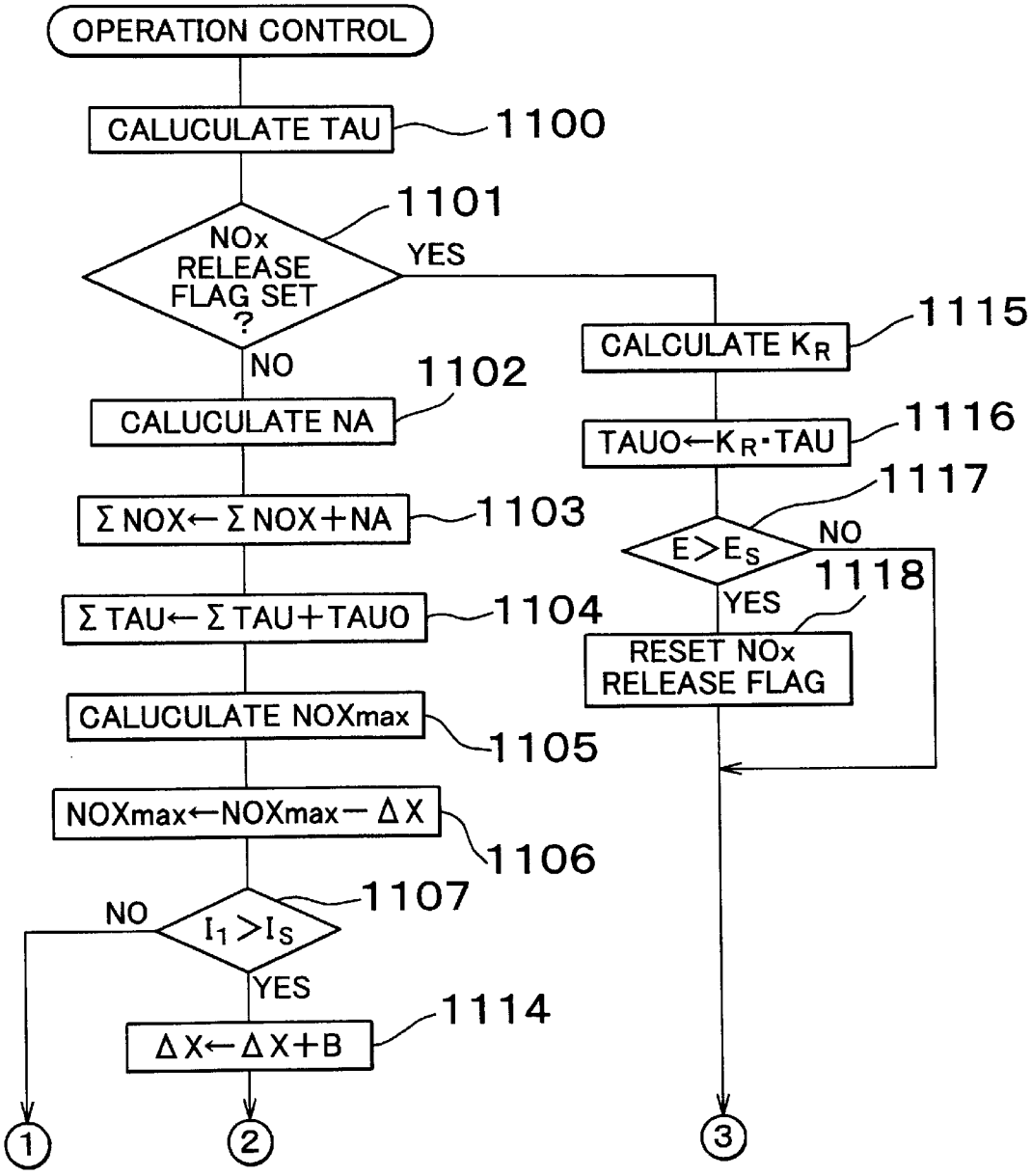
FIG. 28 is a flowchart illustrating a process for controlling the operation of the engine in the seventh embodiments of the invention.
Figure 29:
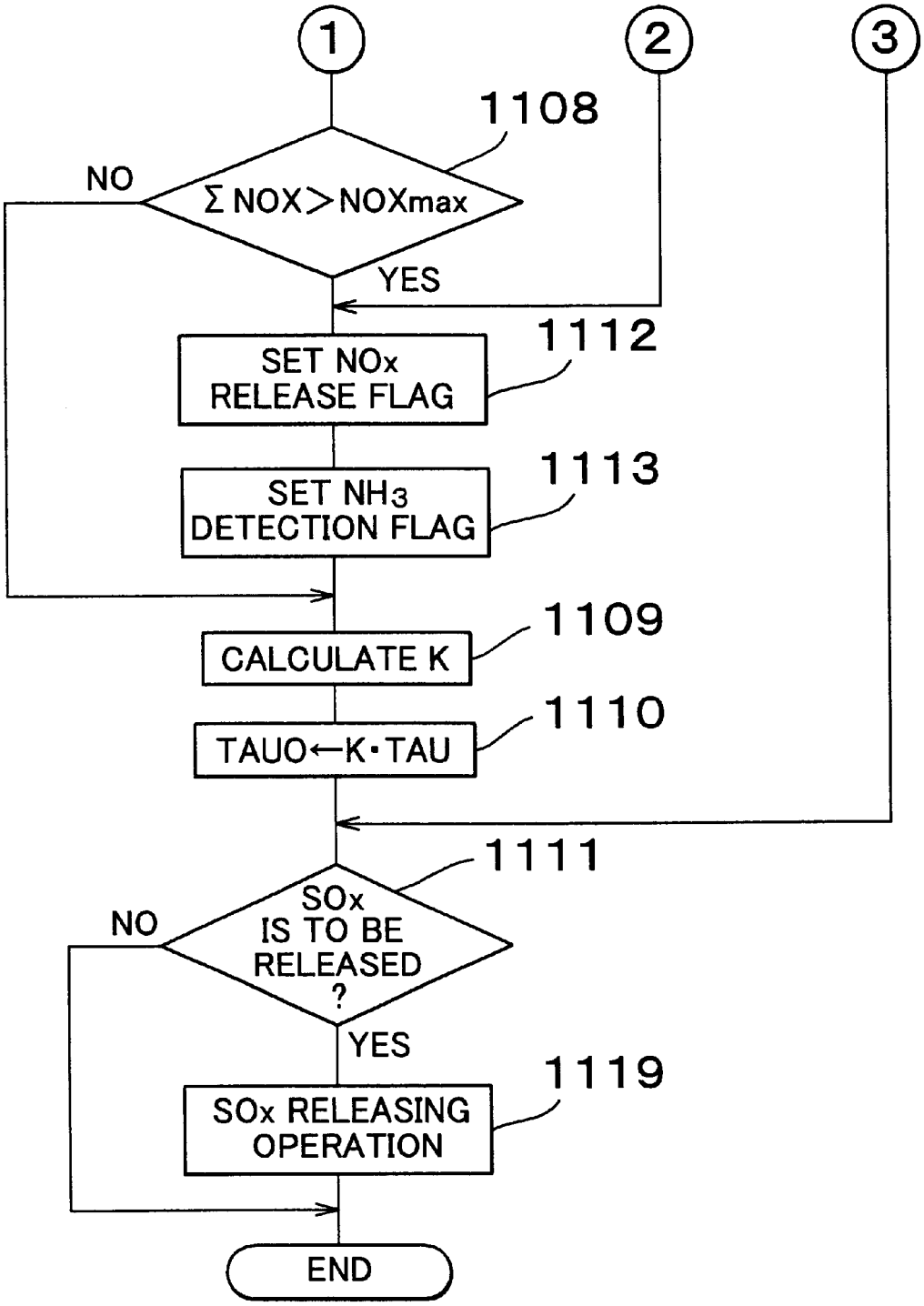
FIG. 29 is a flowchart illustrating a process for controlling the operation of the engine which continues from FIG. 28.

FIGS. 28 and 29 illustrate a routine for carrying out the seventh embodiment.

Referring to FIGS. 28 and 29, first in step 1100, an amount TAU of injected fuel is calculated from the map indicated in FIG. 4B. Subsequently in step 1101, it is determined whether a NOx release flag for indicating that NOx should be released from the NOx occluding member 23 has been set. If the NOx release flag has not been set, the process proceeds to step 1102, in which an amount NA of NOx occluded per unit time is calculated from the map indicated in FIG. 14. Subsequently in step 1103, an estimated amount ΣNOX of NOx that is considered to be occluded in the NOx occluding member 23 is calculated by adding the amount NA of occluded NOx to the existing value of ΣNOX.

Subsequently in step 1104, an integrated value ΣTAU of injected fuel is calculated by adding a final amount TAUO of injected fuel to the existing value of ΣTAU. Subsequently in step 1105, an allowable value NOXmax is calculated from the integrated value ΣTAU based on the relationship indicated in FIG. 15. Subsequently in step 1106, the allowable value NOXmax is reduced by a correction amount ΔX. Subsequently in step 1107, it is determined whether the detected current $I_1$ of the NOx ammonia sensor 29 has exceeded the set value Is. If $I_1 \leqq Is$, the process proceeds to step 1108, in which it is determined whether the amount ΣNOX of occluded NOx has exceeded the allowable value NOXmax. If ΣNOX≦NOXmax, that is, if the NOx occluding capability of the NOx occluding member 23 still has a margin, the process jumps to step 1109.

In step 1109, a correction factor K is calculated from the map indicated in FIG. 4C. Subsequently in step 1110, a final amount TAUO of injected fuel (=K·TAU) is calculated by multiplying the basic amount TAU of injected fuel by the correction factor K. Then, fuel injection is performed based on the final amount TAUO of injected fuel. Subsequently in step 1111, it is determined whether a SOx releasing process for releasing SOx from the NOx occluding member 23 should be executed. If it is not necessary to perform the SOx releasing process, the processing cycle is ended.

Conversely, if it is determined in step 1108 that ΣNOX>NOXmax has come to hold, the process proceeds to step 1112, in which the NOx release flag is set. Subsequently in step 1113, in which the $NH_3$ detection flag is set. After that, the process proceeds to step 1109. If it is determined in step 1107 that $I_1$>Is has come to hold, that is, the NOx occluding member 23 starts to discharge NOx, before it is determined in step 1108 whether ΣNOx>NOXmax holds, then the process proceeds to step 1114, in which the a predetermined value B is added to the correction amount ΔX. Subsequently in step 1112, the NOx release flag is set. In this case, therefore, the allowable value NOXmax is reduced by the set value B.

In the processing cycle following the setting of the NOx release flag, the process goes from step 801 to step 808, in which a fuel-rich correction factor $K_R$ is calculated. Subsequently in step 1116, a final amount TAUO of injected fuel (=$K_R$·TAU) is calculated by multiplying the basic amount TAU of injected fuel by the fuel-rich correction factor $K_R$. Then, fuel injection is performed based on the final amount TAUO of injected fuel. At this moment, the combustion mode is changed from the stratified charge combustion under a fuel-lean air-fuel ratio condition or the uniform mixture combustion under a fuel-lean air-fuel ratio condition to the uniform mixture combustion under a fuel-rich air-fuel ratio condition. As a result, release of NOx from the NOx occluding member 23 starts.

Subsequently in step 1117, it is determined whether the output voltage E of the air-fuel ratio sensor 80 has exceeded the reference voltage Es. If E≦Es, the process proceeds to step 1111. Conversely, if E>Es holds, the process proceeds to step 1118, in which ΣNOX is set to zero, and the $NH_3$ detection flag is reset. If the NOx release flag is reset, the air-fuel ratio is changed from the fuel-rich side to the fuel-lean side.

If it is determined in step 1111 that the SOx releasing process should be executed, the process proceeds to step 1119, in which the process of releasing SOx from the NOx occluding member 23 is executed. That is, the air-fuel ratio is changed to the rich side while the temperature of the NOx occluding member 23 is kept substantially at or above 600° C. After the process of releasing SOx from the NOx occluding member 23 is completed, ΣTAU is set to zero.

In the seventh embodiment, the reference voltage Es is calculated by the routine illustrated in FIGS. 26 and 27.

While the invention has been described with reference to what are presently considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the invention.

What is claimed is:

1. An emission control apparatus of an internal combustion engine, comprising:

a NOx occluding member that is disposed in an exhaust passage of the internal combustion engine, and that occludes a NOx when an air-fuel ratio of an inflow exhaust gas is on a fuel-lean side, and that, when the air-fuel ratio of the inflow exhaust gas changes to a fuel-rich side, allows the NOx occluded to be released and reduced by a reducing agent contained in the exhaust gas;

a controller that performs such a control that the NOx in the exhaust gas is occluded into the NOx occluding member when a combustion is conducted under a fuel-lean air-fuel ratio condition, and changes the air-fuel ratio of the exhaust gas flowing into the NOx occluding member to the fuel-rich side when the NOx is to be released from the NOx occluding member; and a sensor that is disposed in the exhaust passage downstream of the NOx occluding member, and that is capable of detecting an ammonia concentration, wherein when the air-fuel ratio of the exhaust gas flowing into the NOx occluding member is changed to the fuel-rich side, a surplus amount of a reducing agent that is not used to release and reduce the NOx occluded in the NOx occluding member is let out in a form of ammonia from the NOx occluding member, and the controller determines a representative value that indicates the surplus amount of the reducing agent from a change in the ammonia concentration detected by the sensor, and the representative value is an integrated value of the ammonia concentration detected by the sensor.

2. An emission control apparatus of an internal combustion engine, comprising:

a NOx occluding member that is disposed in an exhaust passage of the internal combustion engine, and that occludes a NOx when an air-fuel ratio of an inflow exhaust gas is on a fuel-lean side, and that, when the air-fuel ratio of the inflow exhaust gas changes to a fuel-rich side, allows the NOx occluded to be released and reduced by a reducing agent contained in the exhaust gas;

a controller that performs such a control that the NOx in the exhaust gas is occluded into the NOx occluding member when a combustion is conducted under a fuel-lean air-fuel ratio condition, and changes the air-fuel ratio of the exhaust gas flowing into the NOx occluding member to the fuel-rich side when the NOx is to be released from the NOx occluding member; and a sensor that is disposed in the exhaust passage downstream of the NOx occluding member, and that is capable of detecting an ammonia concentration, wherein when the air-fuel ratio of the exhaust gas flowing into the NOx occluding member is changed to the fuel-rich side, a surplus amount of a reducing agent that is not used to release and reduce the NOx occluded in the NOx occluding member is let out in a form of ammonia from the NOx occluding member, and the controller determines a representative value that indicates the surplus amount of the reducing agent from a change in the ammonia concentration detected by the sensor, and the representative value is a maximum value of the ammonia concentration detected by the sensor.

3. An emission control apparatus of an internal combustion engine, comprising:

a NOx occluding member that is disposed in an exhaust passage of the internal combustion engine, and that occludes a NOx when an air-fuel ratio of an inflow exhaust gas is on a fuel-lean side, and that, when the air-fuel ratio of the inflow exhaust gas changes to a fuel-rich side, allows the NOx occluded to be released and reduced by a reducing agent contained in the exhaust gas;

a controller that performs such a control that the NOx in the exhaust gas is occluded into the NOx occluding member when a combustion is conducted under a fuel-lean air-fuel ratio condition, and changes the air-fuel ratio of the exhaust gas flowing into the NOx occluding member to the fuel-rich side when the NOx is to be released from the NOx occluding member;

a sensor that is disposed in the exhaust passage downstream of the NOx occluding member, and that is capable of detecting an ammonia concentration, wherein when the air-fuel ratio of the exhaust gas flowing into the NOx occluding member is changed to the fuel-rich side, a surplus amount of a reducing agent that is not used to release and reduce the NOx occluded in the NOx occluding member is let out in a form of ammonia from the NOx occluding member, and the controller determines a representative value that indicates the surplus amount of the reducing agent from a change in the ammonia concentration detected by the sensor; and an air-fuel ratio detector disposed in the exhaust passage downstream of the NOx occluding member, wherein if the air-fuel ratio of the exhaust gas flowing into the NOx occluding member is changed to the fuel-rich side and an output signal level of the air-fuel ratio detector exceeds a reference level, the controller changes the air-fuel ratio of the exhaust gas flowing into the NOx occluding member from the fuel-rich side to the fuel-lean side, and the reference level is changed based on the representative value that indicates the surplus amount of the reducing agent.

4. An emission control apparatus according to claim 3, wherein the representative value that indicates the surplus amount of the reducing agent is determined from a change in the ammonia concentration detected by the sensor, and the reference level is changed so that the representative value reaches a target value.

5. An emission control apparatus according to claim 4, wherein the representative value is an integrated value of the ammonia concentration detected by the sensor.

6. An emission control apparatus according to claim 4, wherein the representative value is a maximum value of the ammonia concentration detected by the sensor.

7. An emission control apparatus according to claim 4, wherein the sensor is capable of detecting a NOx concentration in the exhaust gas besides the ammonia concentration in the exhaust gas, and wherein the controller changes the air-fuel ratio of the exhaust gas flowing into the NOx occluding member from the fuel-lean side to the fuel-rich side if a predetermined set value is exceeded by the NOx concentration detected by the sensor while the combustion is conducted under the fuel-lean air-fuel ratio condition.

8. An emission control apparatus according to claim 3, further comprising amount-of-occluded-NOx estimating device that estimates an amount of the NOx occluded in the NOx occluding member, wherein the controller controls a fuel-rich time interval for temporarily changing the air-fuel ratio of the exhaust gas flowing into the NOx occluding member to the fuel-rich side, based on the amount of the NOx estimated by the amount-of-occluded-NOx estimating device.

9. An emission control apparatus according to claim 8, wherein the controller temporarily changes the air-fuel ratio of the exhaust gas flowing into the NOx occluding member from the fuel-lean side to the fuel-rich side when the amount of the NOx occluded estimated by the amount-of-occluded-NOx estimating device exceeds an allowable value.

10. An emission control apparatus according to claim 9, further comprising NOx occluding capability estimating device that estimates a NOx occluding capability of the NOx occluding member, wherein the controller reduces the allowable value as the NOx occluding capability estimated by the NOx occluding capability estimating device decreases.

11. An emission control apparatus according to claim 9, wherein the sensor is capable of detecting a NOx concentration in the exhaust gas besides the ammonia concentration in the exhaust gas, and wherein the controller changes the air-fuel ratio of the exhaust gas flowing into the NOx occluding member from the fuel-lean side to the fuel-rich side if the NOx concentration detected by the sensor exceeds a predetermined set value although the amount of the NOx occluded estimated by the amount-of-occluded-NOx estimating device remains less than or equal to the allowable value while the combustion is conducted under the fuel-lean air-fuel ratio condition.

12. An emission control apparatus according to claim 9, wherein the sensor is capable of detecting a NOx concentration in the exhaust gas besides the ammonia concentration in the exhaust gas, and wherein the controller reduces the allowable value if the NOx concentration detected by the sensor exceeds a predetermined set value although the amount of the NOx occluded estimated by the amount-of-occluded-NOx estimating device remains less than or equal to the allowable value while the combustion is conducted under the fuel-lean air-fuel ratio condition.

13. An emission control apparatus of an internal combustion engine, comprising:

a NOx occluding member that is disposed in an exhaust passage of the internal combustion engine, and that occludes a NOx when an air-fuel ratio of an inflow exhaust gas is on a fuel-lean side, and that, when the air-fuel ratio of the inflow exhaust gas changes to a fuel-rich side, allows the NOx occluded to be released and reduced by a reducing agent contained in the exhaust gas;

an air-fuel ratio detector disposed in the exhaust passage of the engine downstream of the NOx occluding member;

control unit that performs such a control that the NOx in the exhaust gas is occluded into the NOx occluding member when a combustion is conducted under a fuel-lean air-fuel ratio condition, and that changes the air-fuel ratio of the exhaust gas flowing into the NOx occluding member to the fuel-rich side when the NOx is to be released from the NOx occluding member, and that changes the air-fuel ratio of the exhaust gas flowing into the NOx occluding member from the fuel-rich side to the fuel-lean side if an output signal level of the air-fuel ratio detector exceeds a reference level while the output signal level of the air-fuel ratio detector is changing toward a level that indicates a fuel-rich air-fuel ratio, at a time near completion of the release the NOx from the NOx occluding member; and a sensor disposed in the exhaust passage downstream of the NOx occluding member and being capable of detecting an ammonia concentration, wherein the control unit changes the reference level so that when the air-fuel ratio of the exhaust gas flowing into the NOx occluding member is changed to the fuel-rich side, a surplus amount of a reducing agent that is not used to release and reduce the NOx occluded in the NOx occluding member is let out in a form of ammonia from the NOx occluding member, and so that the air-fuel ratio of the exhaust gas is changed from the fuel rich side to the fuel-lean side when a release of the NOx from the NOx occluding member is completed based on a change in the ammonia concentration detected by the sensor.

* * * * *